US010443239B2

(12) United States Patent
Hohmann, Jr. et al.

(10) Patent No.: US 10,443,239 B2
(45) Date of Patent: Oct. 15, 2019

(54) LONG SPAN MASONRY LINTEL SUPPORT SYSTEM

(71) Applicant: Columbia Insurance Company, Omaha, NE (US)

(72) Inventors: Ronald P. Hohmann, Jr., Hauppauge, NY (US); Richard Osmanski, Port Jefferson Station, NY (US); Christopher Mason, Islip, NY (US)

(73) Assignee: Columbia Insurance Company, Omaha, NE (US)

( * ) Notice: Subject to any disclaimer, the term of this patent is extended or adjusted under 35 U.S.C. 154(b) by 123 days.

(21) Appl. No.: 15/368,295

(22) Filed: Dec. 2, 2016

(65) Prior Publication Data

US 2018/0155928 A1 Jun. 7, 2018

(51) Int. Cl.

| | |
|---|---|
| ***E04C 3/02*** | (2006.01) |
| ***E04B 1/32*** | (2006.01) |
| ***E04C 3/07*** | (2006.01) |
| ***E04C 3/29*** | (2006.01) |
| ***E04C 3/44*** | (2006.01) |

(52) U.S. Cl.

CPC ..... *E04C 3/02* (2013.01); *E04B 1/32* (2013.01); *E04C 3/07* (2013.01); *E04C 3/29* (2013.01); *E04C 3/44* (2013.01); *E04B 2001/3217* (2013.01); *E04C 2003/023* (2013.01)

(58) Field of Classification Search

CPC ..... E04C 3/02; E04C 3/04; E04C 2003/023; E04C 2003/026; E04C 2003/0404; E04C 2003/0413; E04C 3/06; E04C 3/40; E04C 2003/046; E01D 4/00; E01D 22/00; E06B 1/006; E04G 23/0218

USPC ..... 52/86, 204.2, 836, 837, 846, 847, 854, 52/650.1, 801.1, 801.11, 838; 29/897.1, 29/897.35

See application file for complete search history.

(56) References Cited

U.S. PATENT DOCUMENTS 424,798 A * 4/1890 Lazell ..... E04C 3/14 52/847
522,736 A * 7/1894 Krause ..... 52/838
(Continued)

FOREIGN PATENT DOCUMENTS

CA 2426567 A1 * 2/2004 ..... E04C 3/02
CA 2426567 A1 8/2004
(Continued)

OTHER PUBLICATIONS

Hagel, M. D., et al., "Monumental Masonry Arches," Construction Canada, accessed from <https://www.constructioncanada.net/monumental-masonry-arches/>, dated Oct. 21, 2014, 5 pages.
(Continued)

*Primary Examiner* — Robert Canfield
(74) *Attorney, Agent, or Firm* — Stinson LLP

(57) ABSTRACT

A lintel system for supporting masonry blocks above an opening in a structure includes a lintel configured to span a width of the opening. The lintel includes a single spanning member having a top edge, a bottom edge, and a side face extending between the top and bottom edge. Supports are disposed at longitudinal ends of the single plate member. A stiffener is attached to the lintel for reinforcing the lintel. The stiffener extends in opposed relation to the side face along at least a portion of the side face.

29 Claims, 85 Drawing Sheets

(56) References Cited

U.S. PATENT DOCUMENTS 542,283 A * 7/1895 Rousseau ..... 52/838
1,158,307 A 10/1915 Schmidt
1,412,477 A 4/1922 McIvor
1,498,526 A * 6/1924 O'Sullivan ..... E04C 3/06 29/897.35
1,634,674 A 7/1927 Mattice
1,638,892 A * 8/1927 Stresau ..... B23K 9/0026 219/137 R
1,696,764 A * 12/1928 Herrick ..... E04C 3/02 52/204.2
1,715,694 A * 6/1929 Coddington ..... E04C 3/06 219/150 V
1,761,306 A 6/1930 McKeown
1,770,932 A * 7/1930 Leake ..... E04G 23/04 105/401
1,773,068 A 8/1930 Vienneau
1,806,508 A 5/1931 Smith
1,954,357 A * 4/1934 Leake ..... E04C 3/06 228/189
1,989,834 A * 2/1935 Watson ..... E04C 3/07 105/416
2,013,820 A 9/1935 Wilson
2,042,463 A * 6/1936 Henderson ..... E04C 3/08 52/364
2,108,373 A * 2/1938 Greulich ..... E04C 3/07 52/842
RE21,921 E * 10/1941 Greulich ..... E04C 3/07 219/107
2,363,917 A 11/1944 Waterman et al.
2,736,397 A 2/1956 Colby, Jr.
2,997,141 A * 8/1961 Wetzler ..... F16B 12/06 5/186.1
3,234,702 A 2/1966 Zibell
3,321,880 A 5/1967 Ferrell et al.
3,374,497 A 3/1968 Meheen
3,572,002 A 3/1971 Nichols
3,605,360 A * 9/1971 Lindal ..... B27H 1/00 52/223.8
3,968,604 A 7/1976 Hills
4,013,253 A 3/1977 Perrault et al.
4,020,612 A * 5/1977 Welch ..... E04C 3/02 52/204.2
4,129,974 A * 12/1978 Ojalvo ..... E04C 3/06 29/897.35
4,333,218 A * 6/1982 Wentworth ..... B23P 6/04 138/99
4,827,684 A 5/1989 Allan
4,894,962 A 1/1990 Conn
5,081,807 A 1/1992 Murdza
5,218,801 A 6/1993 Hereford
5,233,799 A * 8/1993 Abukawa ..... B21D 5/08 52/53
5,245,802 A 9/1993 Davis
5,417,050 A 5/1995 Cosentino
5,505,365 A 4/1996 Olsen
5,619,834 A 4/1997 Chen
5,749,199 A * 5/1998 Allen ..... E04B 1/3555 52/837
5,809,735 A * 9/1998 Leblanc ..... E04C 3/18 52/847
5,816,008 A 10/1998 Hohmann
5,893,254 A 4/1999 Troiani et al.
6,047,516 A * 4/2000 Taylor ..... E04C 3/18 52/715
6,055,788 A * 5/2000 Martin ..... B62D 21/02 296/204
6,082,075 A 7/2000 Rysgaard
6,128,883 A 10/2000 Hatzinikolas
6,560,938 B1 5/2003 Powers, Jr.
6,691,487 B2 * 2/2004 Daudet ..... E04B 1/2403 174/480
6,854,219 B1 2/2005 Kelly et al.
7,043,884 B2 5/2006 Moreno
7,162,842 B2 1/2007 Ribic
7,908,804 B2 3/2011 Vieita
8,039,115 B2 10/2011 Hackius et al.
8,074,958 B1 12/2011 Hoy
8,201,374 B2 6/2012 Hohmann, Jr.
8,240,099 B2 8/2012 Hummel, III
8,365,481 B2 2/2013 Scully et al.
8,511,032 B2 8/2013 Abdel-Rahman et al.
8,561,373 B1 * 10/2013 McDonald ..... E04C 3/14 52/841
8,613,173 B2 12/2013 Ander et al.
8,621,802 B2 1/2014 Spyrou
8,833,025 B2 9/2014 Krause
8,863,460 B2 10/2014 Hohmann, Jr.
8,904,730 B2 12/2014 Hohmann, Jr.
9,121,169 B2 9/2015 Hohmann, Jr.
9,316,004 B1 4/2016 Hatzinikolas
9,447,585 B2 9/2016 Hatzinikolas
9,469,999 B1 10/2016 Aboukhalil
9,499,974 B2 11/2016 Bombino et al.
9,683,367 B1 6/2017 Ting
9,856,655 B2 1/2018 Knight et al.
9,896,840 B2 2/2018 Ting
10,006,202 B2 * 6/2018 Kimura ..... E04B 1/18
2001/0004815 A1 * 6/2001 LePoire ..... E04C 3/02 52/204.2
2002/0108325 A1 * 8/2002 Hulls ..... B60J 5/12 52/204.1
2003/0033764 A1 2/2003 Ting
2003/0150179 A1 8/2003 Moreno
2004/0050013 A1 3/2004 Okada
2005/0204658 A1 9/2005 Patterson
2006/0150571 A1 * 7/2006 Zahner, III ..... E04C 3/02 52/838
2006/0179738 A1 8/2006 Parrino et al.
2007/0039258 A1 2/2007 Walker, III
2009/0183448 A1 7/2009 Kennelly
2009/0315346 A1 * 12/2009 Schelberg ..... B60R 19/18 293/133
2010/0086348 A1 4/2010 Funahashi et al.
2011/0061337 A1 3/2011 O'Shea et al.
2011/0175380 A1 * 7/2011 Kamiya ..... B60R 19/023 293/133
2012/0246937 A1 * 10/2012 Barrett ..... E04G 23/0218 29/897.1
2014/0134394 A1 * 5/2014 Noble ..... E04C 3/28 428/138
2014/0208681 A1 7/2014 Rice
2014/0245674 A1 * 9/2014 Harrison ..... E04B 1/26 52/204.2
2016/0002910 A1 1/2016 Green
2016/0006227 A1 1/2016 Tally et al.
2016/0145875 A1 5/2016 Scully et al.
2017/0234012 A1 * 8/2017 Kimura ..... E04B 1/18 52/835
2017/0362812 A1 12/2017 Garry
2018/0155929 A1 * 6/2018 Hohmann, Jr. ..... E04C 3/02

FOREIGN PATENT DOCUMENTS

CA 2950712 A1 6/2018
CN 202090293 U * 12/2011
DE 862247 C * 1/1953 ..... E04C 3/06
DE 1714716 U1 9/1977
DE 10117199 A1 4/2001
EP 1353021 B1 12/2002
EP 1375777 A1 6/2003
EP 2397622 A1 3/2011
GB 381789 10/1932
GB 2028903 A * 3/1980
GB 2172314 A * 9/1986
GB 2172314 A * 11/1986
GB 2263918 A 1/1992
GB 2288831 A 4/1995
GB 2375552 A 4/2002
GB 2485153 A * 5/2012
GB 2505980 A 4/2013
IE 20130144 A1 11/2013

(56) References Cited

FOREIGN PATENT DOCUMENTS

| | | | | | |
|---|---|---|---|---|---|
| JP | 56105837 | A | * | 8/1981 | ..... E04C 3/07 |
| JP | 60-148685 | A | | 8/1985 | |
| JP | 62-114734 | A | | 5/1987 | |
| JP | 05-57305 | A | | 3/1993 | |
| JP | H07-116684 | B2 | | 12/1995 | |
| JP | 2006-231338 | A | | 9/2006 | |
| JP | 5954942 | B2 | * | 7/2016 | |
| JP | 2017166123 | A | * | 9/2017 | ..... E04C 3/02 |
| JP | 2018-53593 | A | | 4/2018 | |
| KR | 555244 | B1 | * | 3/2006 | |
| WO | 9214007 | A1 | * | 8/1992 | ..... E04C 3/07 |
| WO | 2007/078272 | A2 | | 7/2007 | |
| WO | 2017072389 | A | * | 5/2017 | |

OTHER PUBLICATIONS

Masonry Support & Windpost Systems, IG Steel Lintels, no later than Aug. 21, 2018, pp. 36.
Non-Welded Bracket Angle Support, Ancon Ltd., dated Aug. 21, 2018, pp. 5.
Bespoke Bracket Angle Support, Ancon Ltd., dated Aug. 21, 2018, pp. 6.
Fast, Low-Cost Shelf Angle Installations, FERO Corporation, no later than Aug. 21, 2018, pp. 4.

* cited by examiner

LONG SPAN MASONRY LINTEL SUPPORT SYSTEM

FIELD OF THE INVENTION

The present invention generally relates to a lintels used in building construction, and more specifically, to a long span masonry lintel support system.

BACKGROUND

Relatively large openings such as walkways and archways provide an aesthetically pleasing feature of construction in buildings and other structure. Moreover such architectural features permit passage of large objects through a structure. It can be challenging to construct a lintel over an opening when the construction is masonry. It is necessary to support the masonry as it is being built over the opening. This can be done by providing support underneath, but this does not provide a clean look in the finished structure because they are exposed. Concealed lintel support systems are known for use in constructing masonry lintels, but have limitations as the span of the opening in the structure increases.

SUMMARY

In one aspect, a lintel system for supporting masonry blocks above an opening in a structure generally comprises a lintel configured to span a width of the opening. The lintel comprises a single spanning member having a top edge, a bottom edge, and a side face extending between the top and bottom edge of the spanning member. Supports are disposed at longitudinal ends of the single spanning member. Support plates each have an opening within a perimeter of the support plate and a slot therein for receiving the spanning member therein for mounting the support plate on the spanning member. A support rod is receivable through the opening in the support plate and configured to be received through the masonry blocks for connecting the masonry blocks to the spanning member. A stiffener is attached to the spanning member for reinforcing the spanning member. The stiffener extends in opposed relation to the side face along at least a portion of the side face.

In another aspect, a lintel system for supporting masonry blocks above an opening in a structure generally comprises a lintel configured to span a width of the opening. The lintel comprises a spanning member having a length greater than the width of the opening, and having a top edge, a bottom edge, and a planar side face extending between the top and bottom edge. The spanning member has a height and a thickness. Support plates each have an opening within a perimeter of the support plate and a slot therein for receiving the spanning member therein for mounting the support plate on the spanning member. A support rod is receivable through the opening in the support plate and configured to be received through the masonry blocks for connecting the masonry blocks to the spanning member. A stiffener is attached to the spanning member for reinforcing the spanning member. The stiffener has a height extending parallel to the height of the spanning member and a thickness extending parallel to the thickness of the spanning member. The height of the stiffener is greater than the thickness of the stiffener. The stiffener extends in opposed relation to the planar side face along at least a portion of the planar side face.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
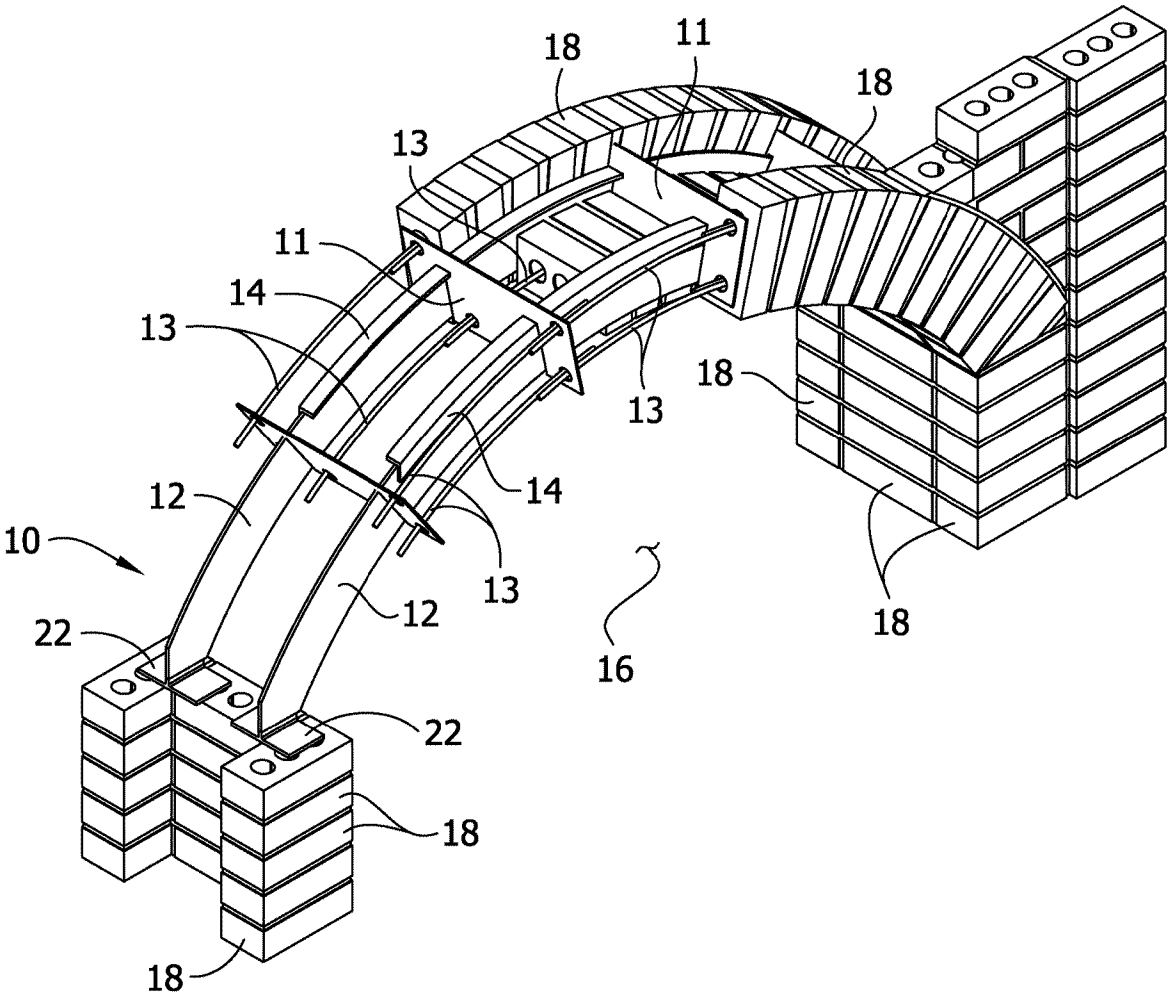
FIG. 1 is an illustration of a masonry archway with portions removed showing a lintel system of the present invention.
Figure 2:
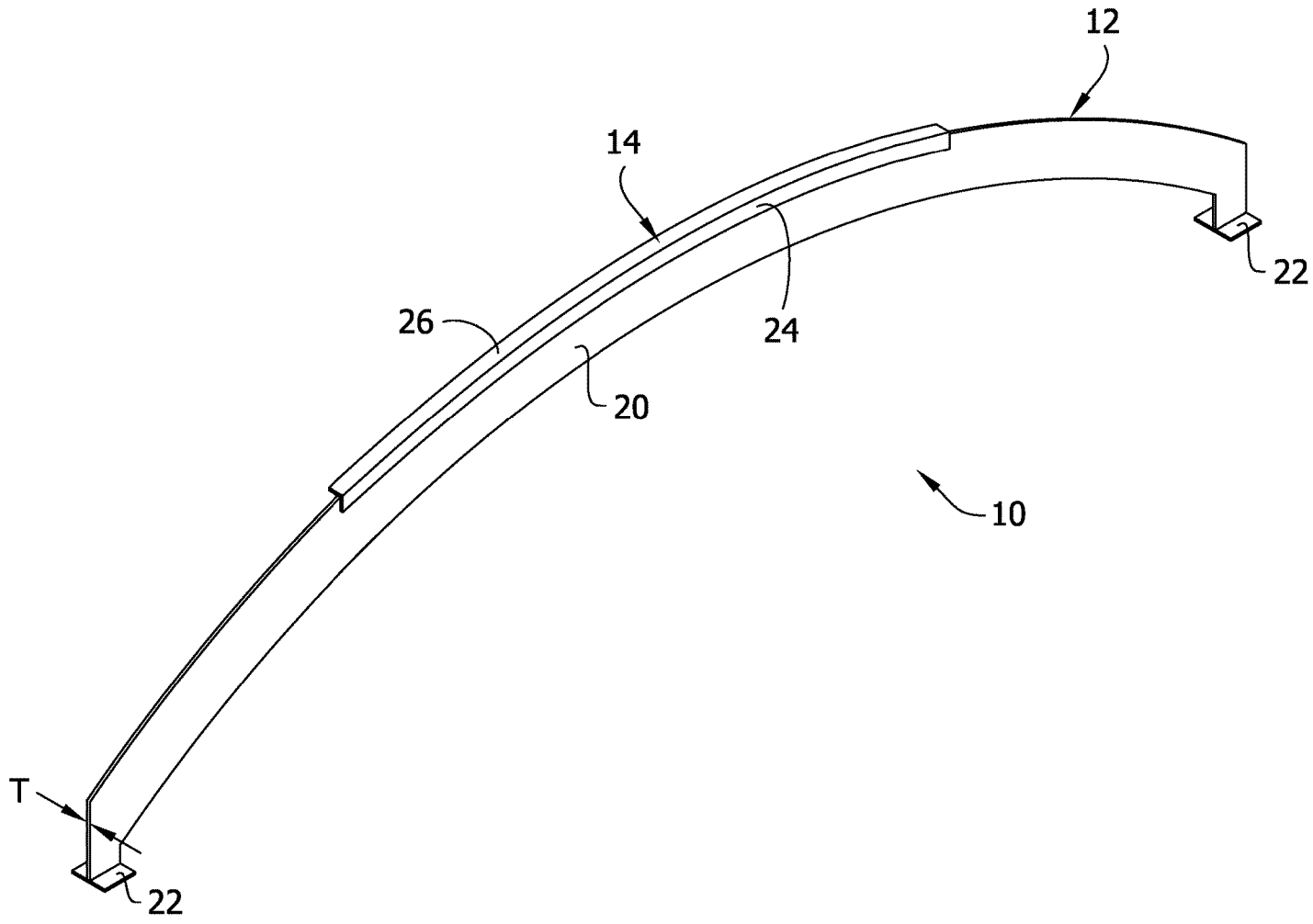
FIG. 2 is a perspective of a lintel of the system.

Referring to FIGS. 1-3A, a lintel system indicated generally at 10 includes support plates 11 mounted between a pair of lintels 12. Masonry support rods 13 extend through openings in the support plates 11 and between adjacent ones of the support plates. The support plates have slots that receive portions of the lintels 12 for mounting the support plates on the lintels. Each lintel 12 includes a stiffener 14 attached to the lintel. The lintel system 10 spans the width of an archway opening 16 formed by masonry blocks in the form of bricks 18 having openings that receive the support rods 13. The support rods transfer the weight of the bricks 18 to the support plates 11, which in turn transfer the weight to the lintels 12. In this way, the lintel system 10 supports the weight of the bricks 18 above the archway opening 16. The lintel system 10 is configured such that it is concealed within the bricks 18 when the archway is complete. Although two lintels 12 are shown in the lintel system 10, a lintel system may include fewer or additional lintels. The stiffener 14 provides additional strength and reinforcement to the lintel 12 so that the system 10 is capable of supporting the weight of the bricks 18 over longer spans without significant alteration of the envelope of the lintel system 10.

The lintel 12 further comprises an arch-shaped spanning member 20 and base members 22 disposed at longitudinal ends of the arch shaped spanning member for supporting the lintel on the bricks 18. The base members 22 extend laterally from the arch shaped spanning member 20. As shown in FIG. 1, in use, the base members 22 are configured to rest on horizontal surfaces of the bricks 18 to position the lintel system 10 above side walls of the archway opening 16. In one embodiment, the lintel 12 is formed from steel and has a length L of about 12 feet (4 meters) and a thickness T of about 0.38 inches (0.97 cm). Other dimensions for the lintel are envisioned without departing from the scope of the disclosure. Broadly, the lintel 12 is a "plate type" lintel. The lintel could have over configurations such box type without departing from the scope of the disclosure.

Figure 3:
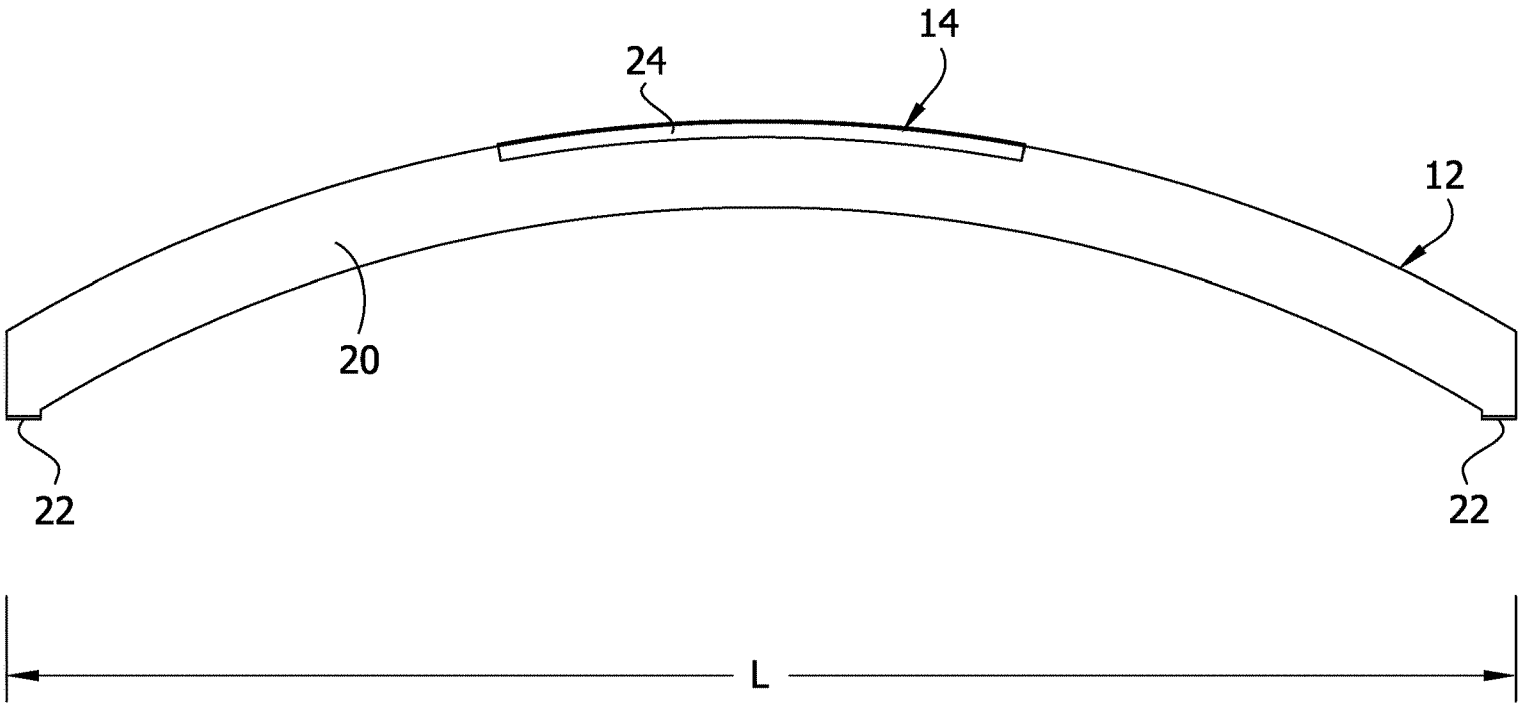
FIG. 3 is a front elevation of the lintel of FIG. 2.
Figure 3A:
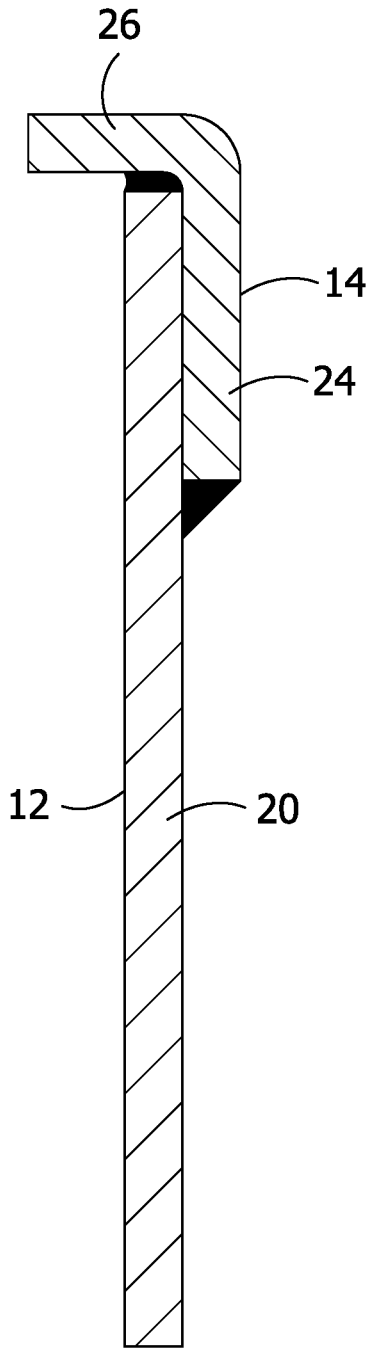
FIG. 3A is a cross section of the lintel of FIG. 2.
Figure 4:
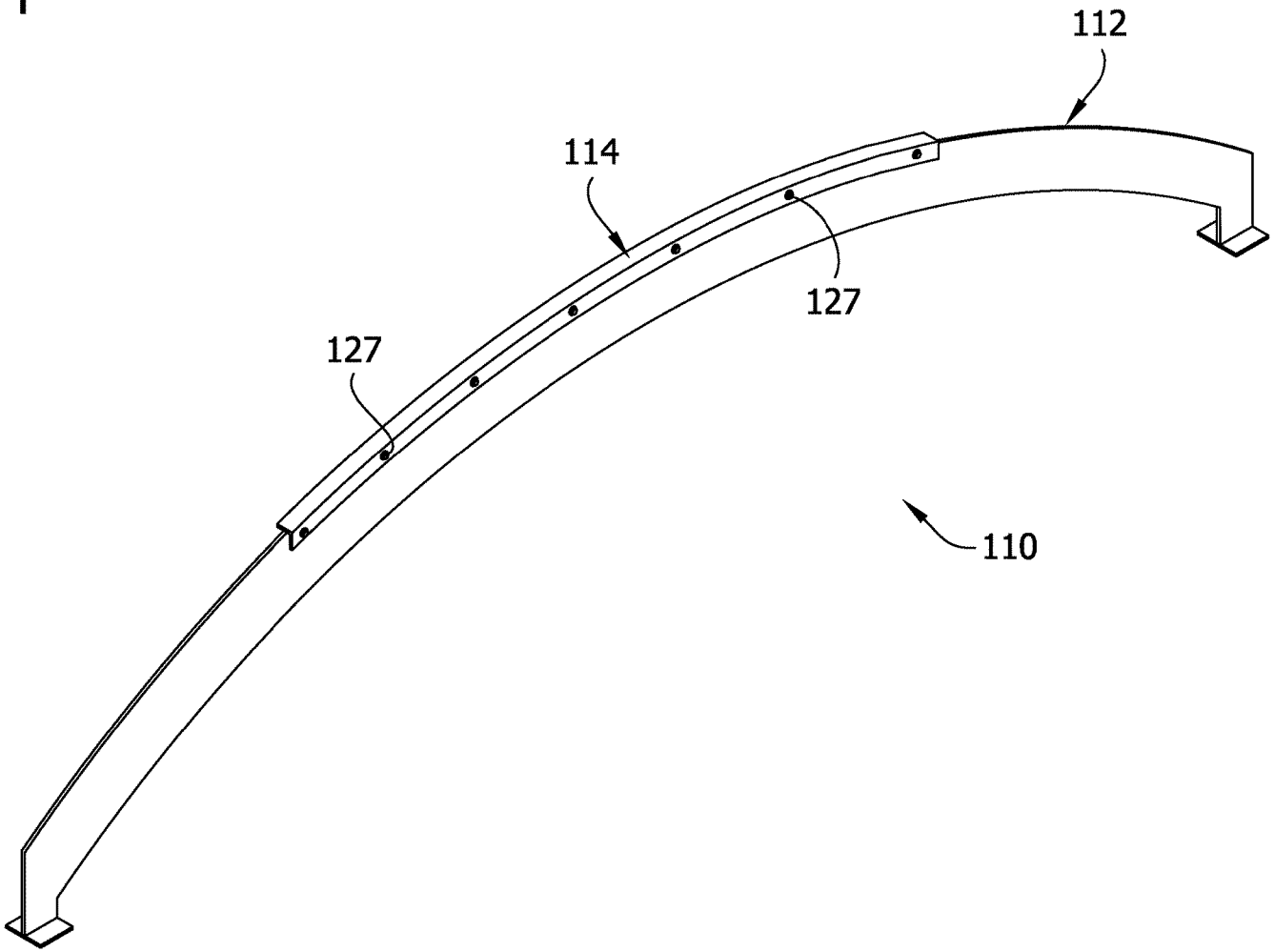
FIG. 4 is a perspective of a lintel of a lintel system of another embodiment.
Figure 5:
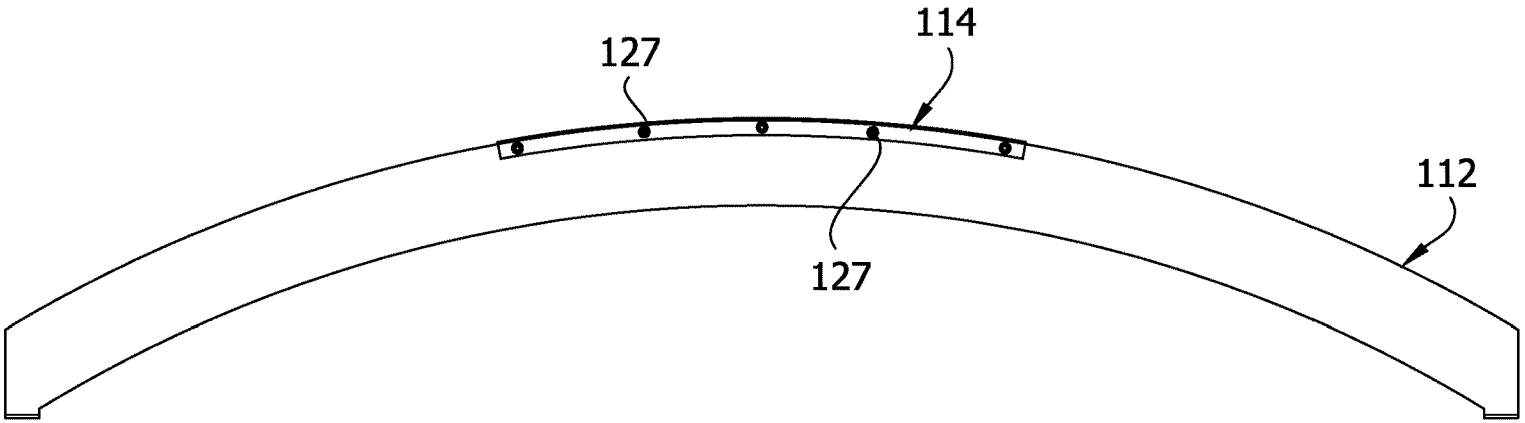
FIG. 5 is a front elevation of the lintel of FIG. 4.
Figure 5A:
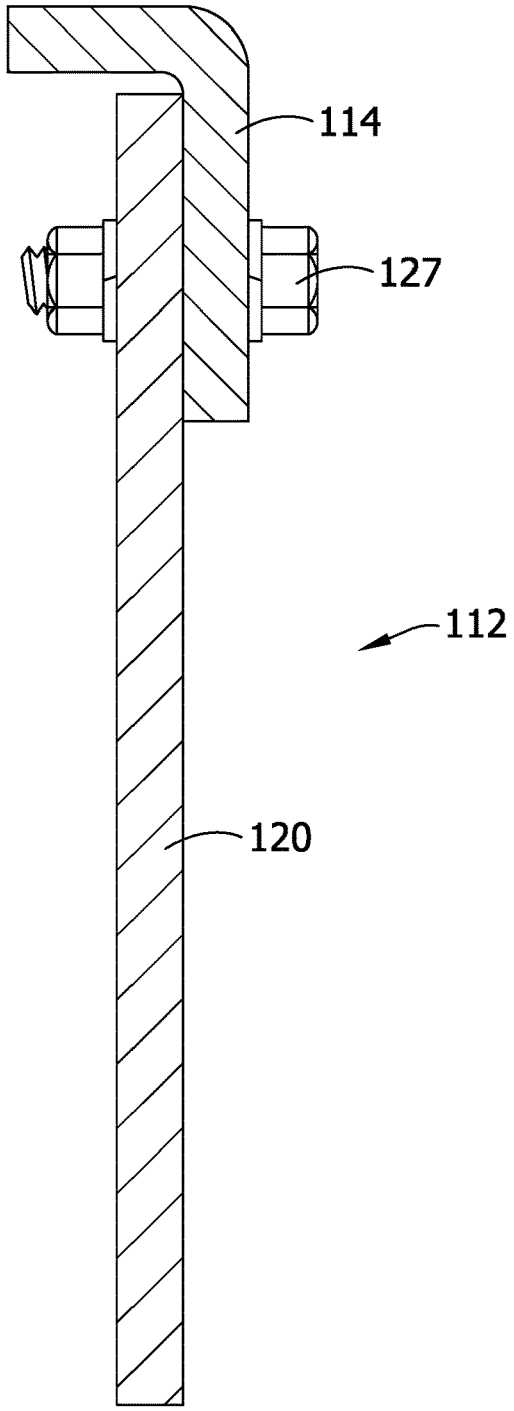
FIG. 5A is a cross section of the lintel of FIG. 4.

The stiffener 14 comprises an L-shaped member that is curved a long its length in conformity with a top edge of the lintel 12, and is disposed generally at the top edge of the lintel 12. The stiffener 14 provides additional structure to the lintel system 10 allowing the thickness T of the lintel 12 to remain relatively small without sacrificing the overall strength of the lintel system. The stiffener 14 extends partially along a top curved portion of the arch-shaped spanning member 20 such that a first portion 24 is positioned opposite a front side face of the arch-shaped spanning member, and a second portion 26 is positioned opposite a top edge of the arch-shaped spanning member. As shown, the first and second portions 24, 26 extend transverse to each other at an angle of about 90°. In the illustrated embodiment, the first and second portions 24, 26 each comprise plate sections of the stiffener 14. The first portion 24 has a height extending parallel to a height H of the spanning member 20 and a thickness extending parallel to the thickness T of the spanning member. The height of the first portion 24 is greater than its thickness. In one embodiment, the first portion 24 extends down from the top edge less than half of a height of the side face of the arch-shaped spanning member 20. In another embodiment, the first portion 24 extends down from the top edge less than a quarter of the height of the side face of the arch-shaped spanning member 20. In one embodiment, the stiffener 14 extends over less than about 60% of a length of the arch-shaped spanning member 20. In another embodiment, the stiffener 14 extends over less than about 50% of the length of the arch-shaped spanning member 20. In the illustrated embodiment, the stiffener 14 is welded to the lintel 12. As shown in FIG. 3A, the first portion 24 of the stiffener 14 is welded to the side face of the arch-shaped spanning member, and the second portion 26 is welded to the top edge of the arch-shaped spanning member. However other ways of attaching the stiffener to the lintel are envisioned. For example, as shown in FIGS. 4-5A, a lintel system 110, substantially identical to lintel system 10, comprises a stiffener 114 bolted to lintel 112 by bolts 127.

Figure 6:
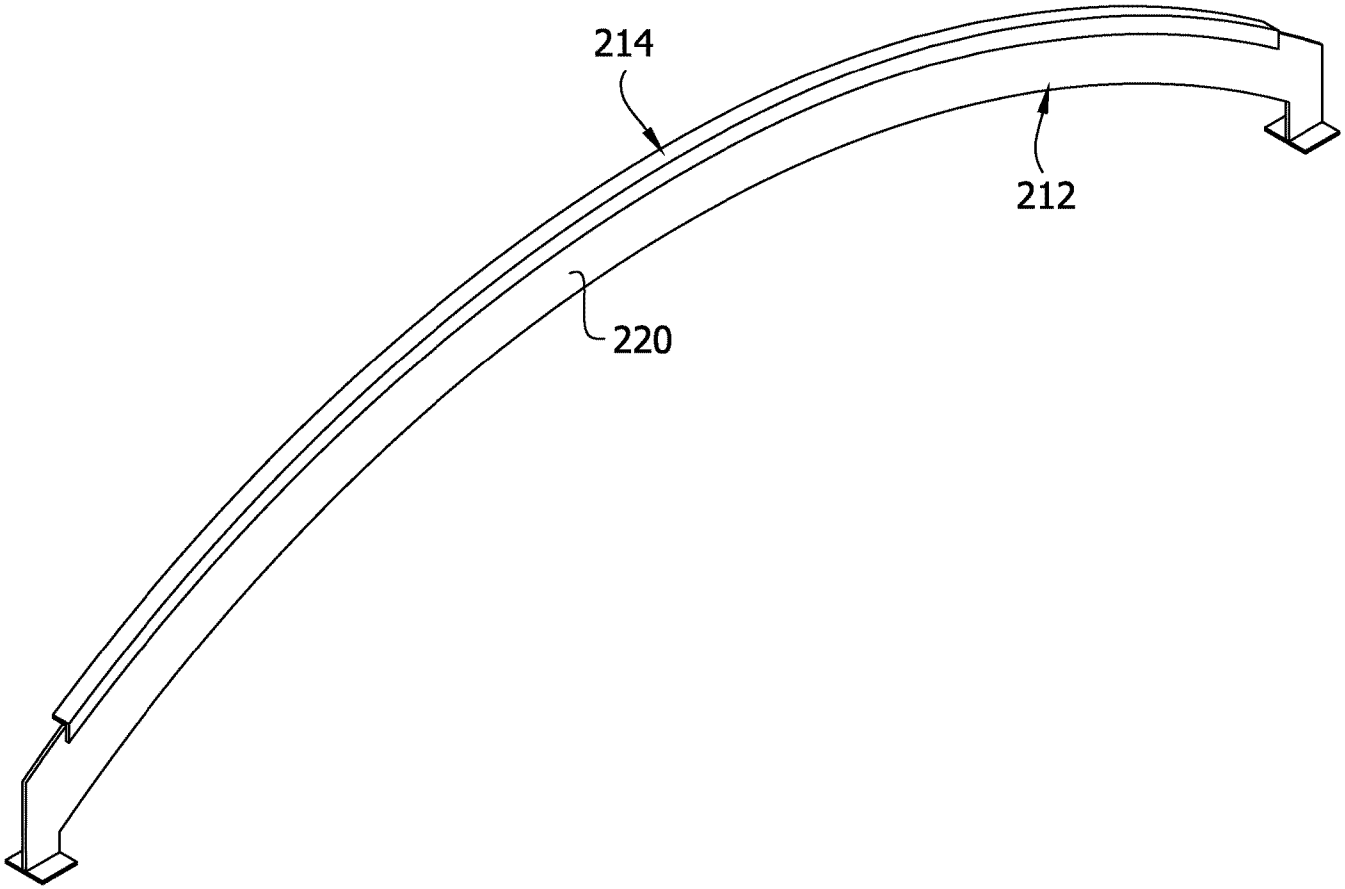
FIG. 6 is a perspective of a lintel of a lintel system of another embodiment.
Figure 7:
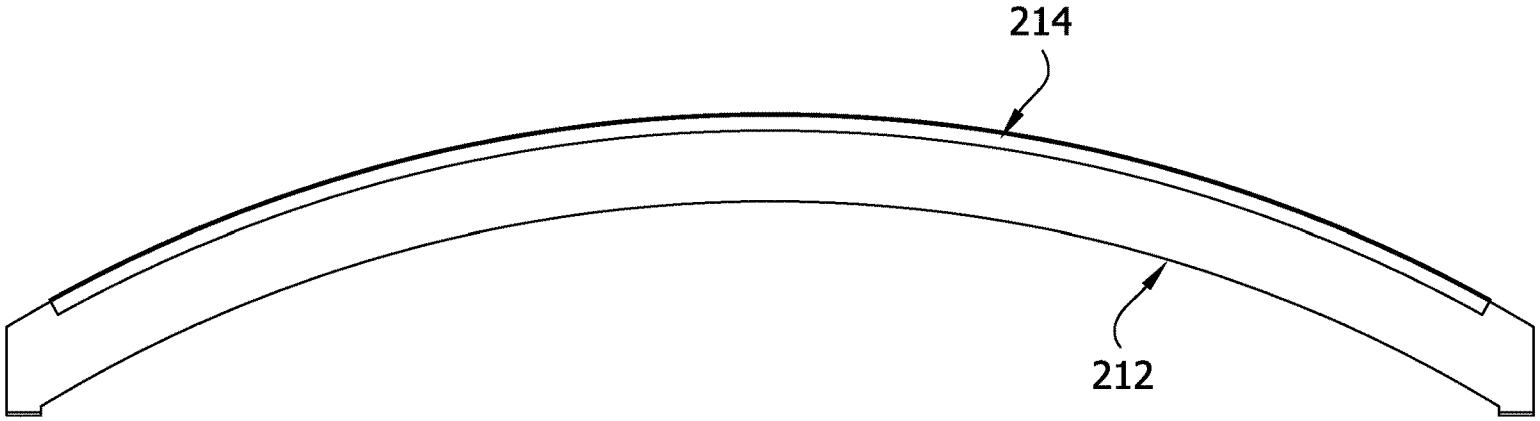
FIG. 7 is a front elevation of the lintel of FIG. 6.
Figure 8:
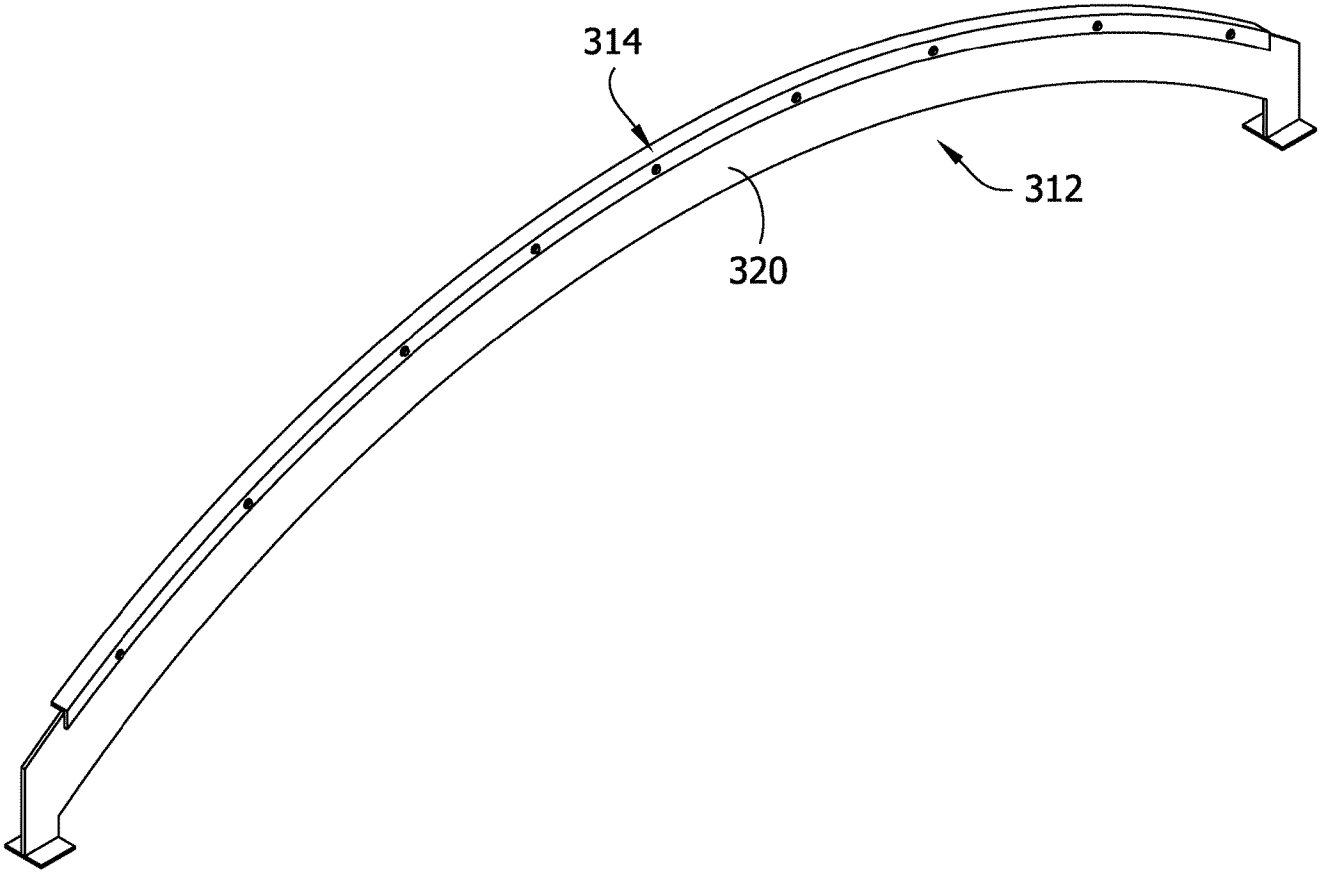
FIG. 8 is a perspective of a lintel of a lintel system of another embodiment.
Figure 9:
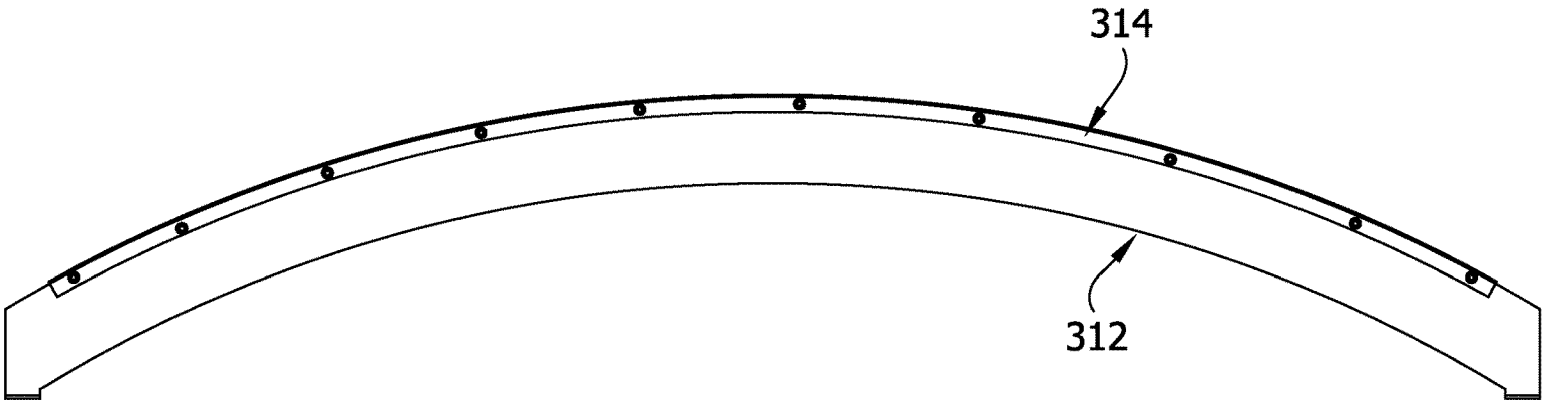
FIG. 9 is a front elevation of the lintel of FIG. 8.

Referring to FIGS. 6 and 7, a lintel indicated generally at 212 includes a stiffener 214 attached to an arch-shaped spanning member 220. The lintel 212 is substantially similar to the lintel 12 of the first embodiment except stiffener 214 extends substantially along an entire length of the curved top portion of the arch-shaped spanning member 220 of the lintel 212. In one embodiment, the stiffener 214 extends over at least about 80% of a length of the arch-shaped spanning member 220. In another embodiment, the stiffener 214 extends over at least about 90% of the length of the arch-shaped spanning member 220. In the illustrated embodiment, the stiffener 214 is welded to the arch-shaped spanning member 220. However other ways of attaching the stiffener to the lintel are envisioned. For example, as shown in FIGS. 8 and 9, a lintel 312, substantially identical to lintel 212, comprises a stiffener 314 bolted to arch-shaped spanning member 320.

Figure 10:
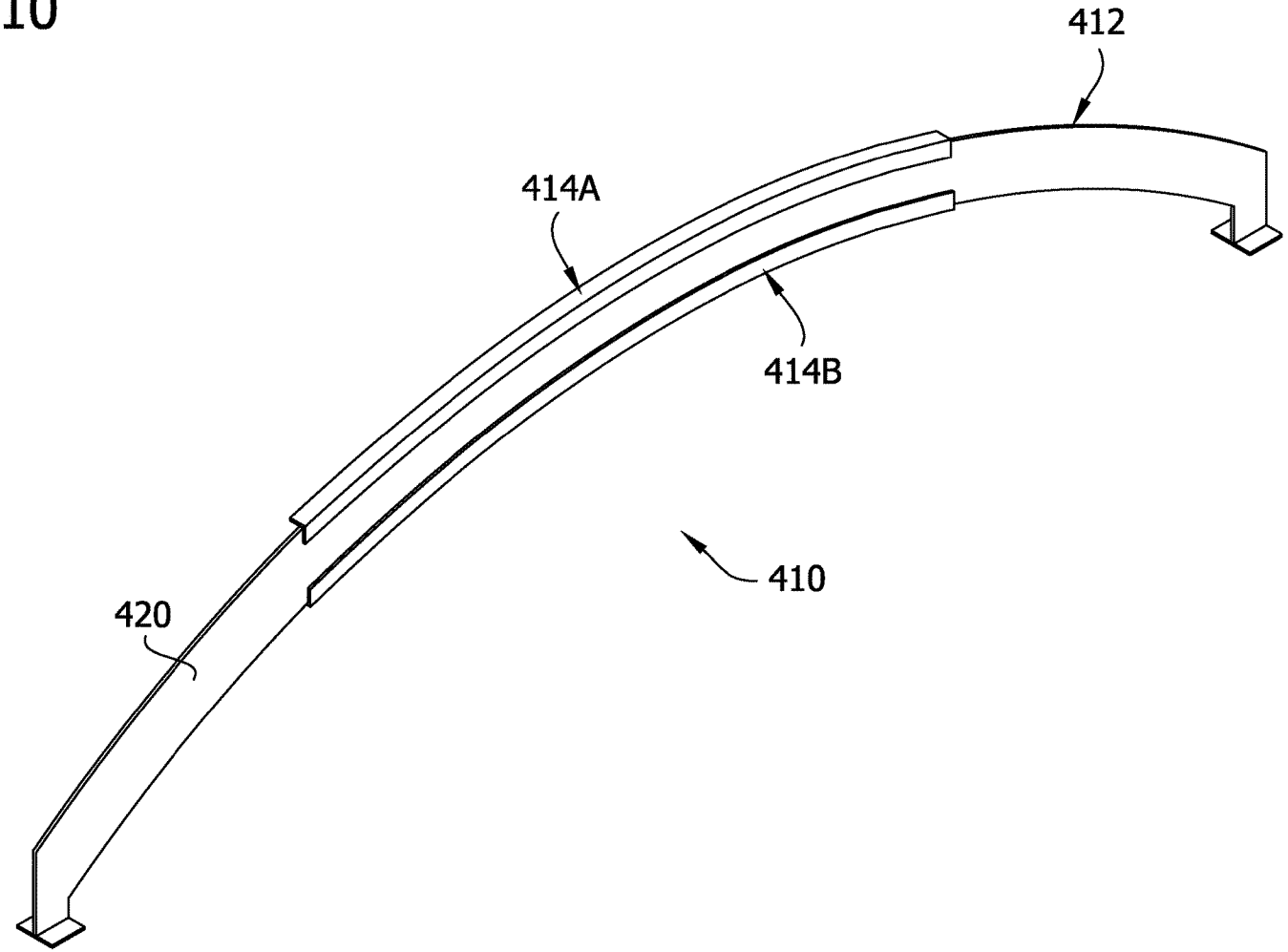
FIG. 10 is a perspective of a lintel of a lintel system of another embodiment.
Figure 11:
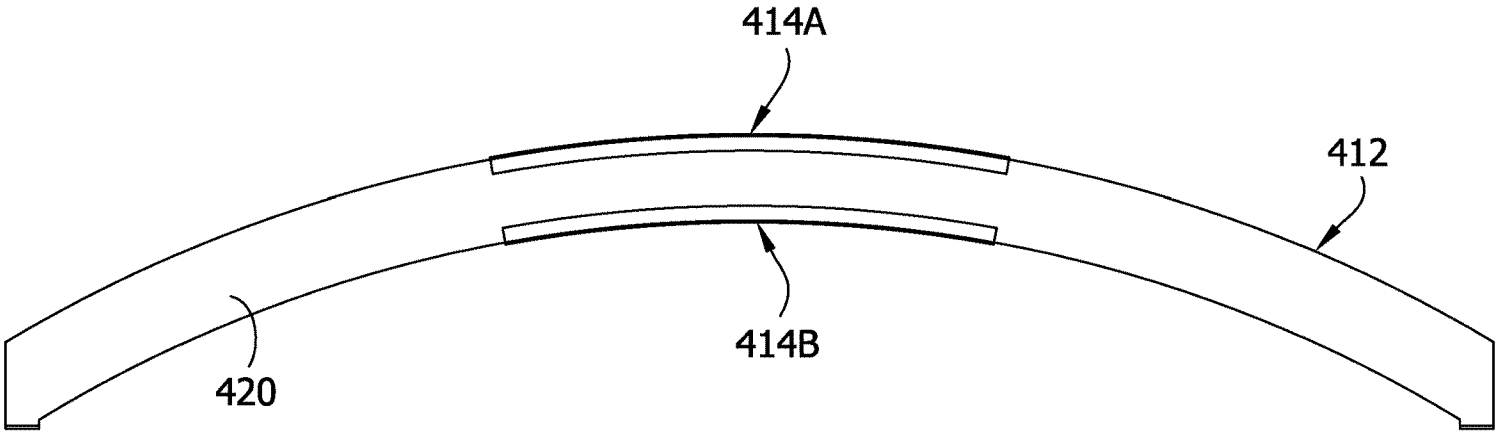
FIG. 11 is a front elevation of the lintel of FIG. 10.
Figure 11A:
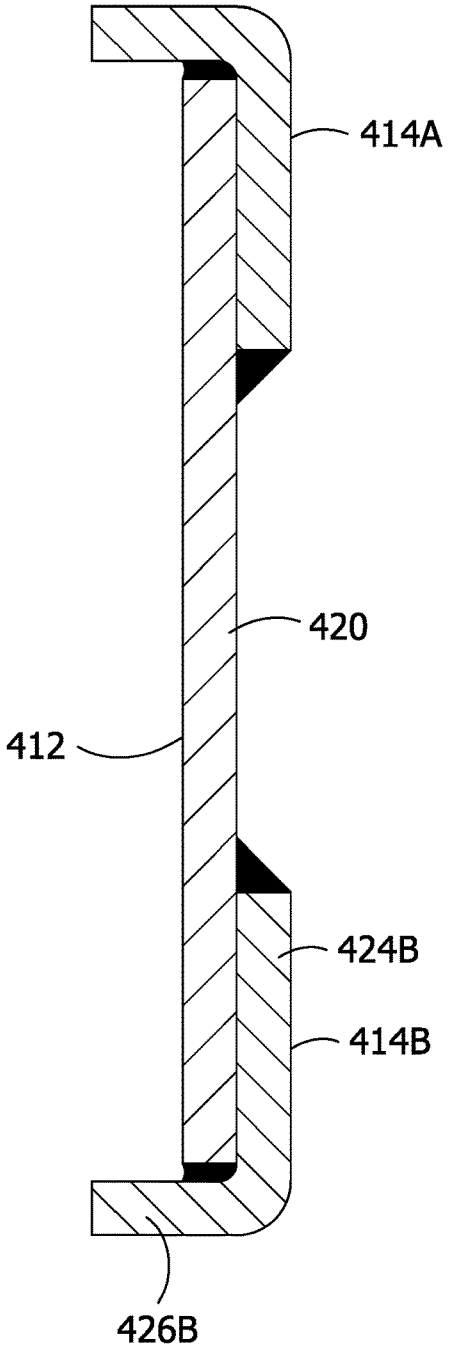
FIG. 11A is a cross section of the lintel of FIG. 10.
Figure 12:
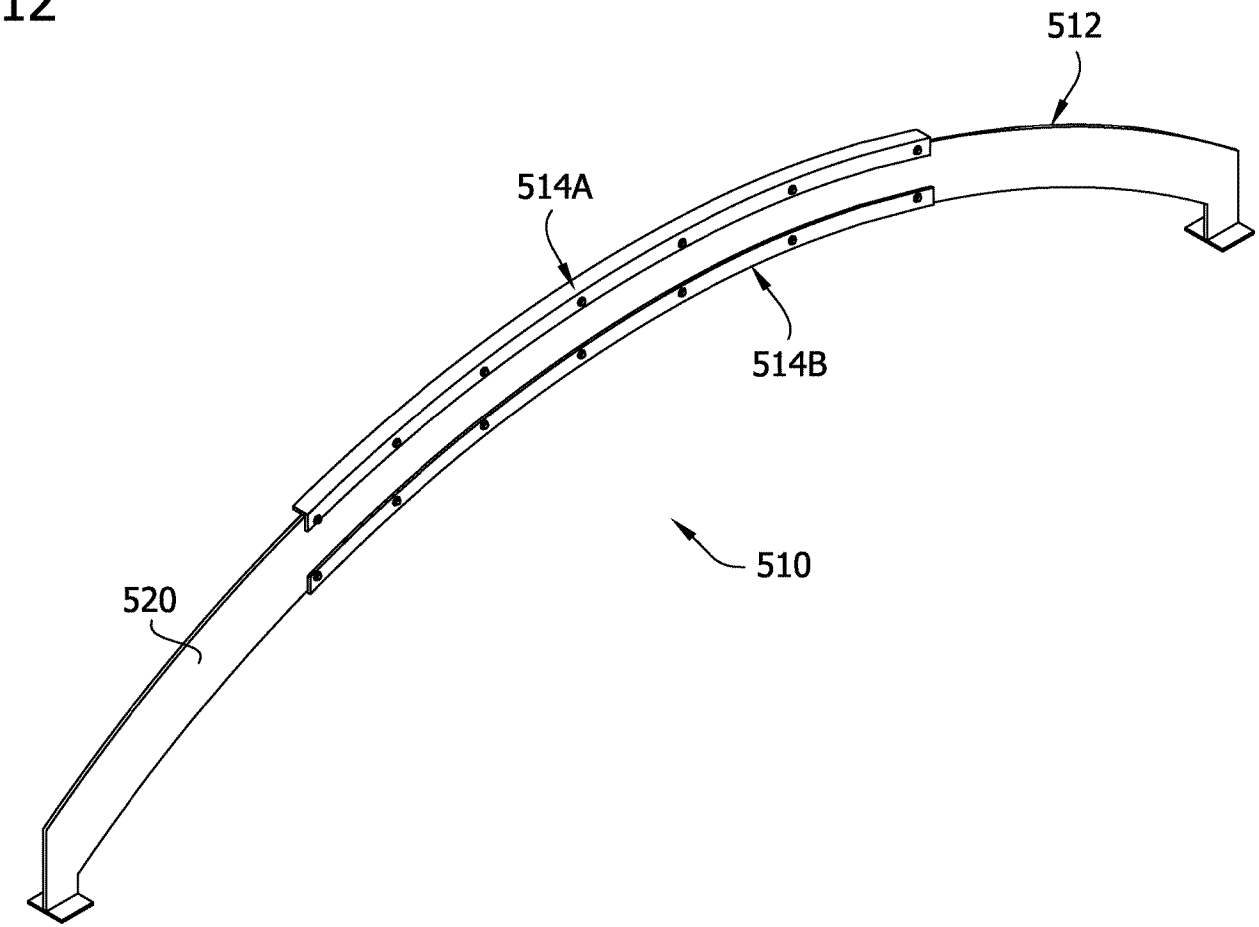
FIG. 12 is a perspective of a lintel of a lintel system of another embodiment.
Figure 13:
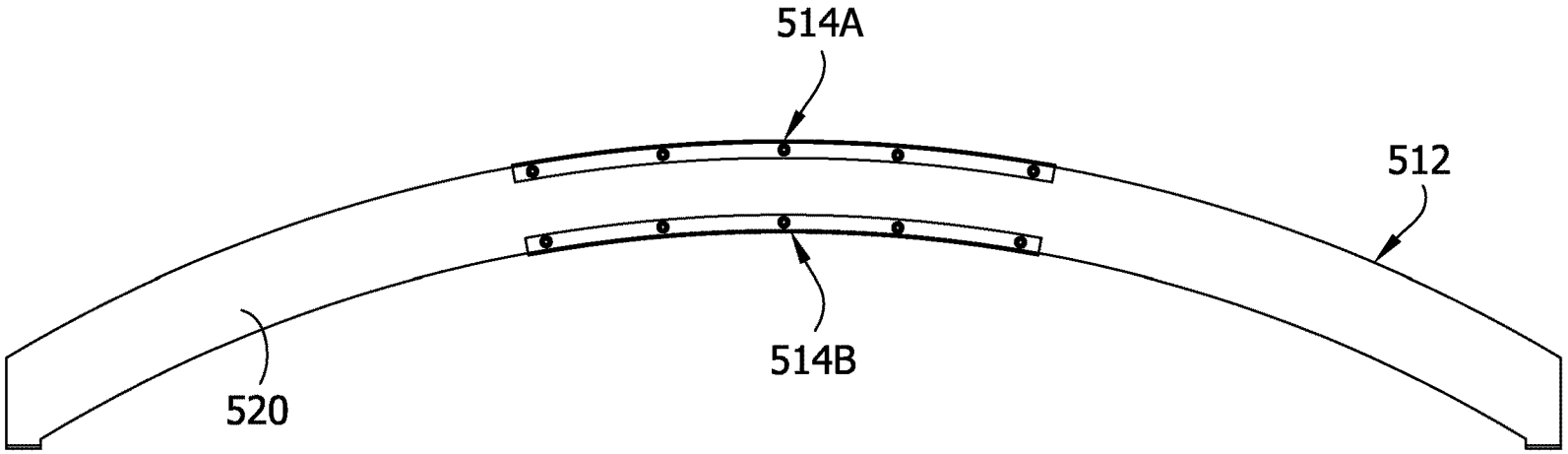
FIG. 13 is a front elevation of the lintel of FIG. 12.
Figure 13A:
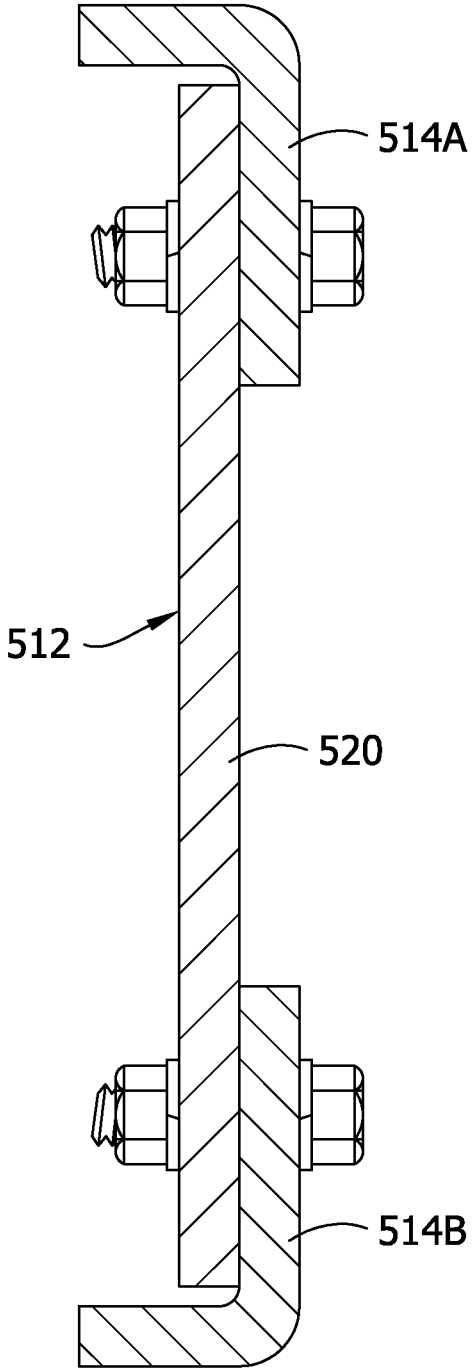
FIG. 13A is a cross section of the lintel of FIG. 12.

Referring to FIGS. 10-11A, a lintel 412 includes a pair of stiffeners 414A, 414B attached to arch-shaped spanning member 420. The lintel 412 is substantially similar to the lintel 12 of the first embodiment except an additional stiffener 414B extends along a bottom curve of arch-shaped spanning member 420. The stiffener 414B extends partially along the bottom curved portion of the arch-shaped spanning member 420 such that a first portion 424B is positioned opposite a front side face of the arch-shaped spanning member, and a second portion 426B is positioned opposite a bottom edge of the arch-shaped spanning member. The first and second portions 424A, 424B extend transverse to each other. As shown, the first and second portions 424A, 424B are at right angles to each other. In one embodiment, the stiffeners 414A, 414B extend over less than about 60% of a length of the arch-shaped spanning member 420. In another embodiment, the stiffeners 414A, 414B extend over less than about 50% of the length of the arch-shaped spanning member 420. In the illustrated embodiment, the stiffeners 414A, 414B are welded to the arch-shaped spanning member 420. However other ways of attaching the stiffeners to the lintel are envisioned. For example, as shown in FIGS. 12-13A, a lintel 512, substantially identical to lintel 412, comprises stiffeners 514A, 514B bolted to arch-shaped spanning member 420.

Figure 14:
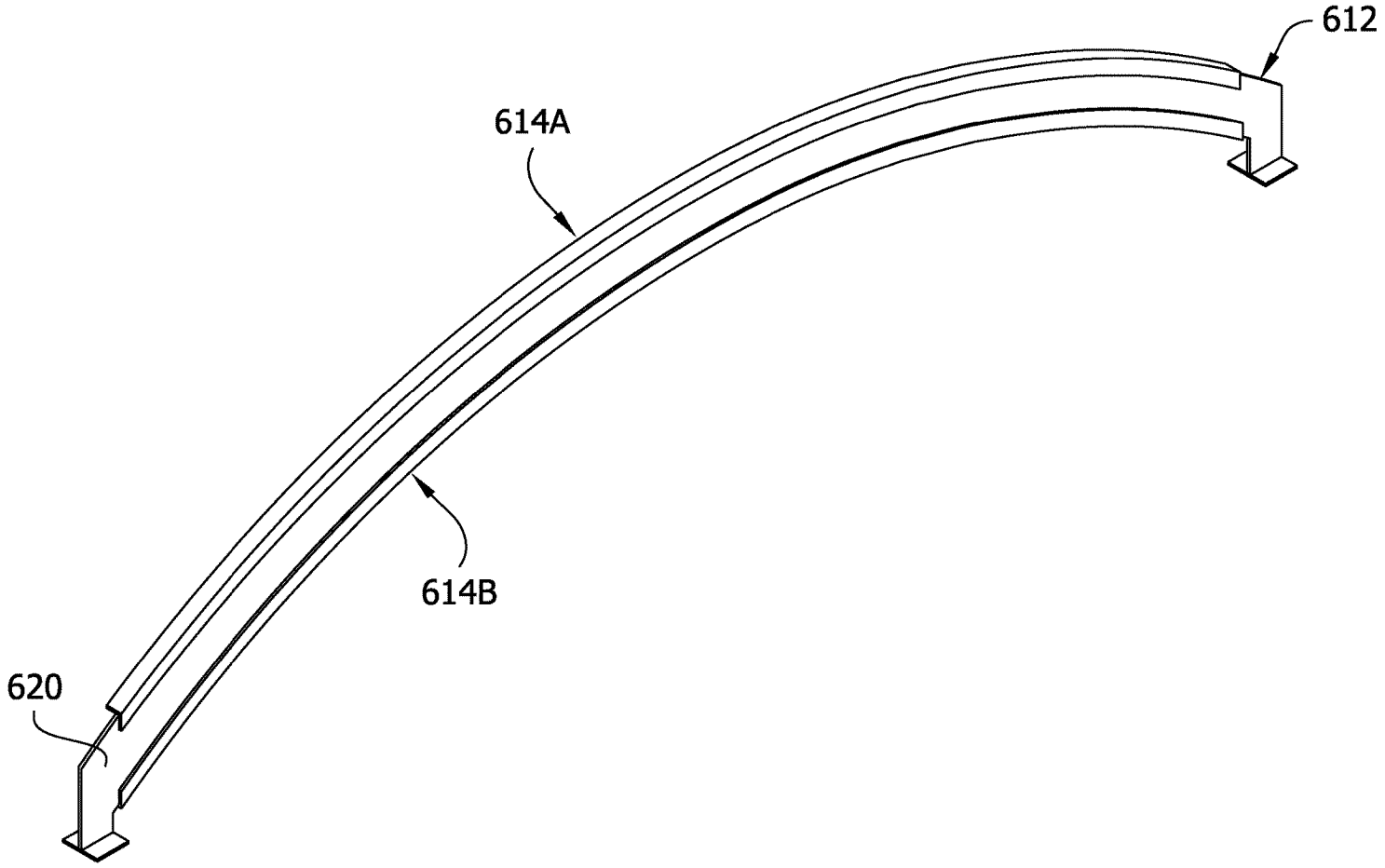
FIG. 14 is a perspective of a lintel of a lintel system of another embodiment.
Figure 15:
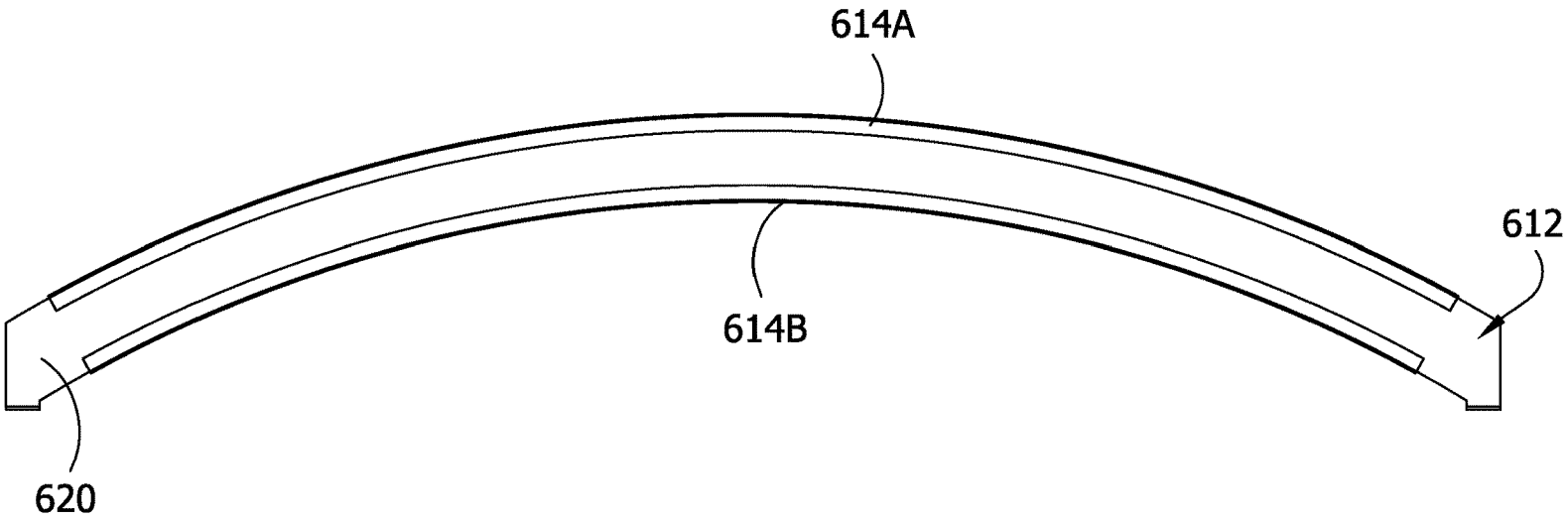
FIG. 15 is a front elevation of the lintel of FIG. 14.
Figure 16:
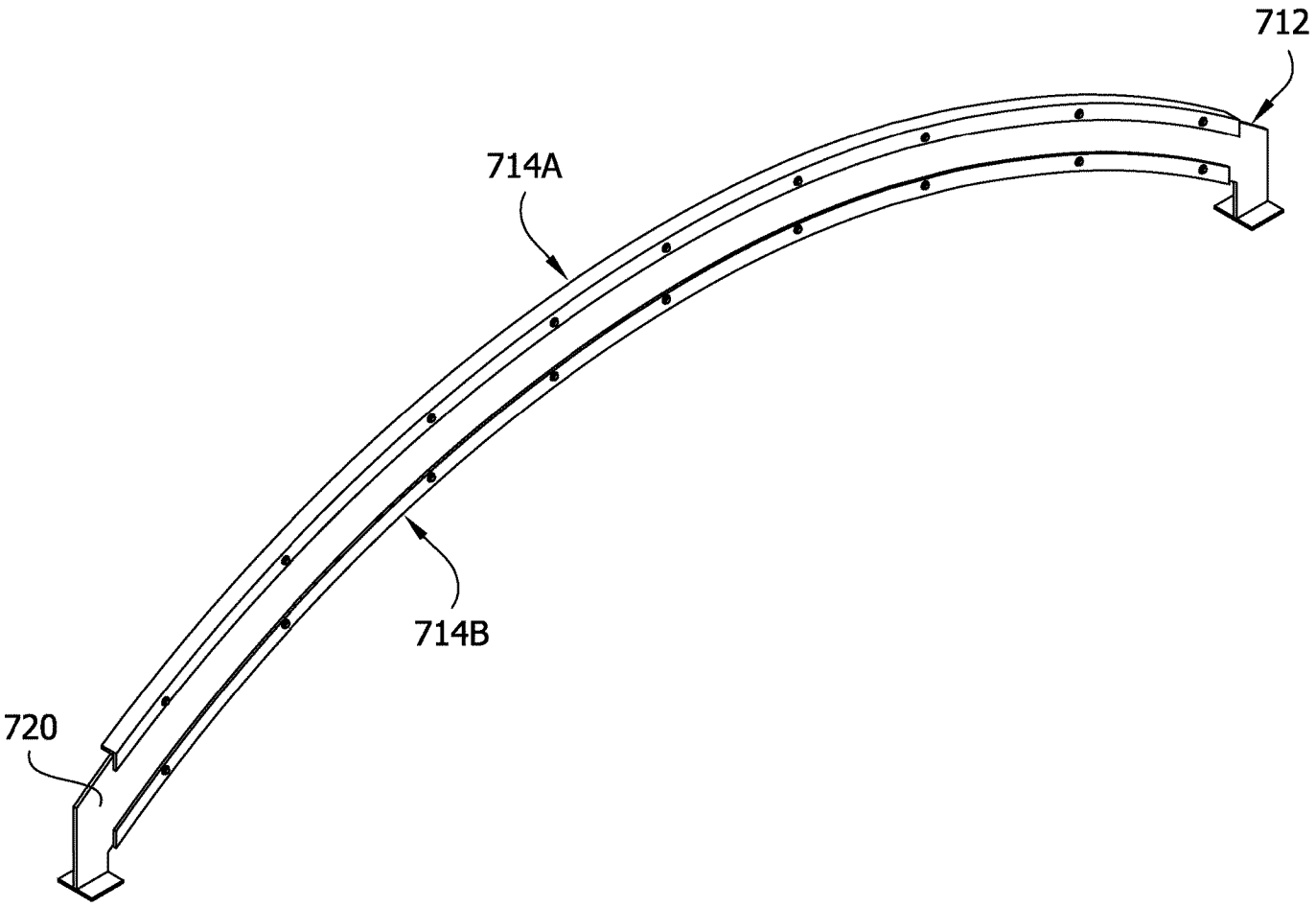
FIG. 16 is a perspective of a lintel of a lintel system of another embodiment.
Figure 17:
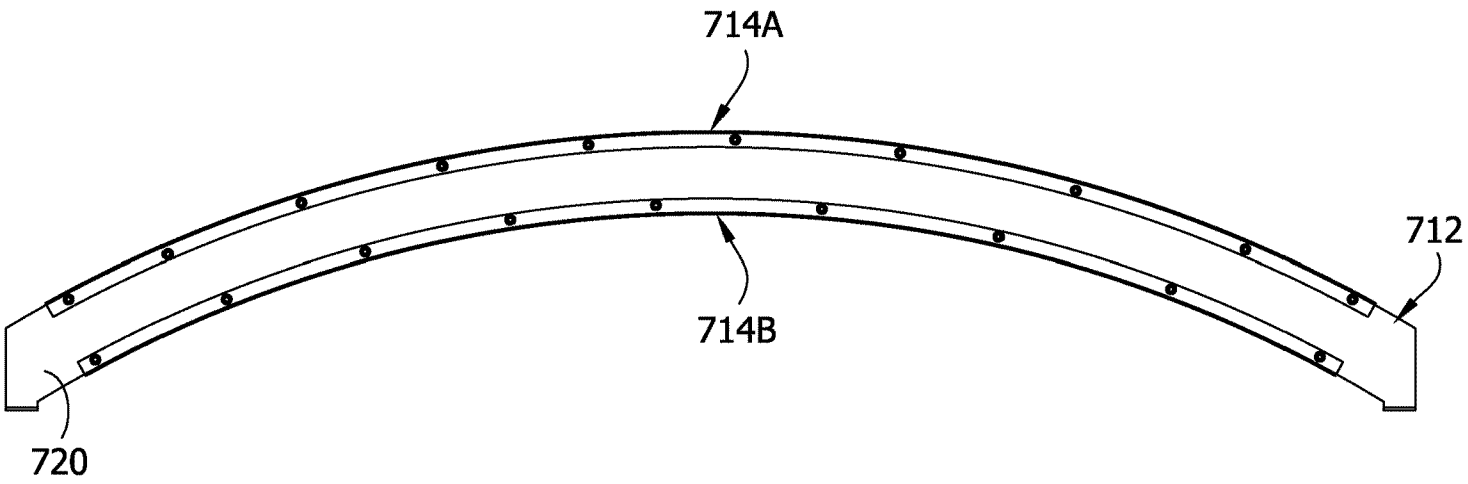
FIG. 17 is a front elevation of the lintel of FIG. 16.

Referring to FIGS. 14 and 15, a lintel 612 comprises stiffeners 614A, 614B attached to an arch-shaped spanning member 620. The lintel 612 is substantially similar to the lintel 512 except stiffeners 614A, 614B extend substantially along an entire length of the curved top and bottom portions of the arch-shaped spanning member 620 of the lintel 612. In one embodiment, the stiffeners 614A, 614B extend over at least about 80% of a length of the arch-shaped spanning member 620. In another embodiment, the stiffeners 614A, 614B extend over at least about 90% of the length of the arch-shaped spanning member 620. In the illustrated embodiment, the stiffeners 614A, 614B are welded to the lintel 612. However other ways of attaching the stiffener to the lintel are envisioned. For example, as shown in FIGS. 16 and 17, a lintel 712, substantially identical to lintel 612, comprises stiffeners 714A, 714B bolted to arch-shaped spanning member 720.

Figure 18:
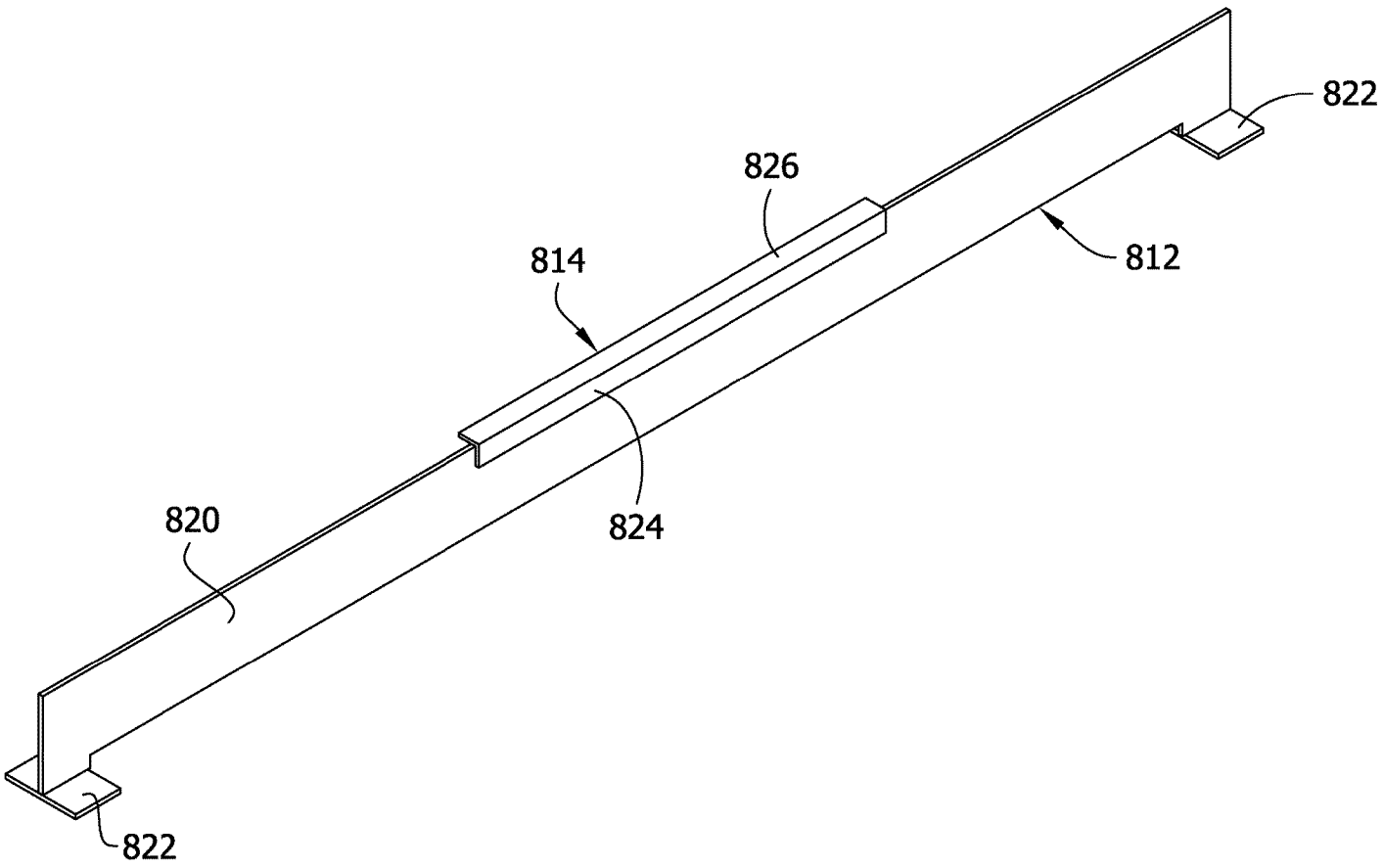
FIG. 18 is a perspective of a lintel of a lintel system of another embodiment.
Figure 19:
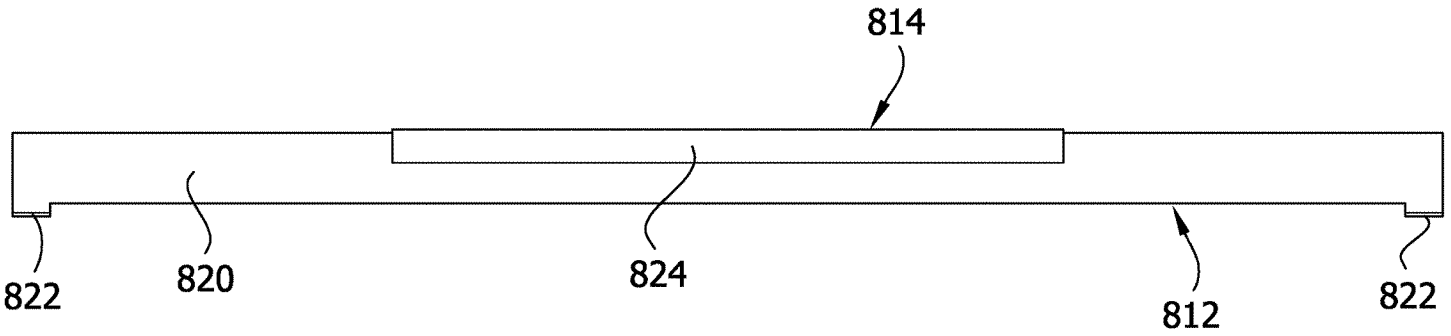
FIG. 19 is a front elevation of the lintel of FIG. 18.

Referring to FIGS. 18 and 19, a lintel 812 of a lintel system comprises a stiffener 814 attached to a rectangular-shaped spanning member 820. The lintel 812 further comprises base members 822 disposed at longitudinal ends of the rectangular-shaped spanning member 820. The base members 822 extend laterally from the rectangular-shaped spanning member 820. The rectangular-shaped spanning member 820 is straight for use with masonry construction across an opening that is not arched.

Figure 20:
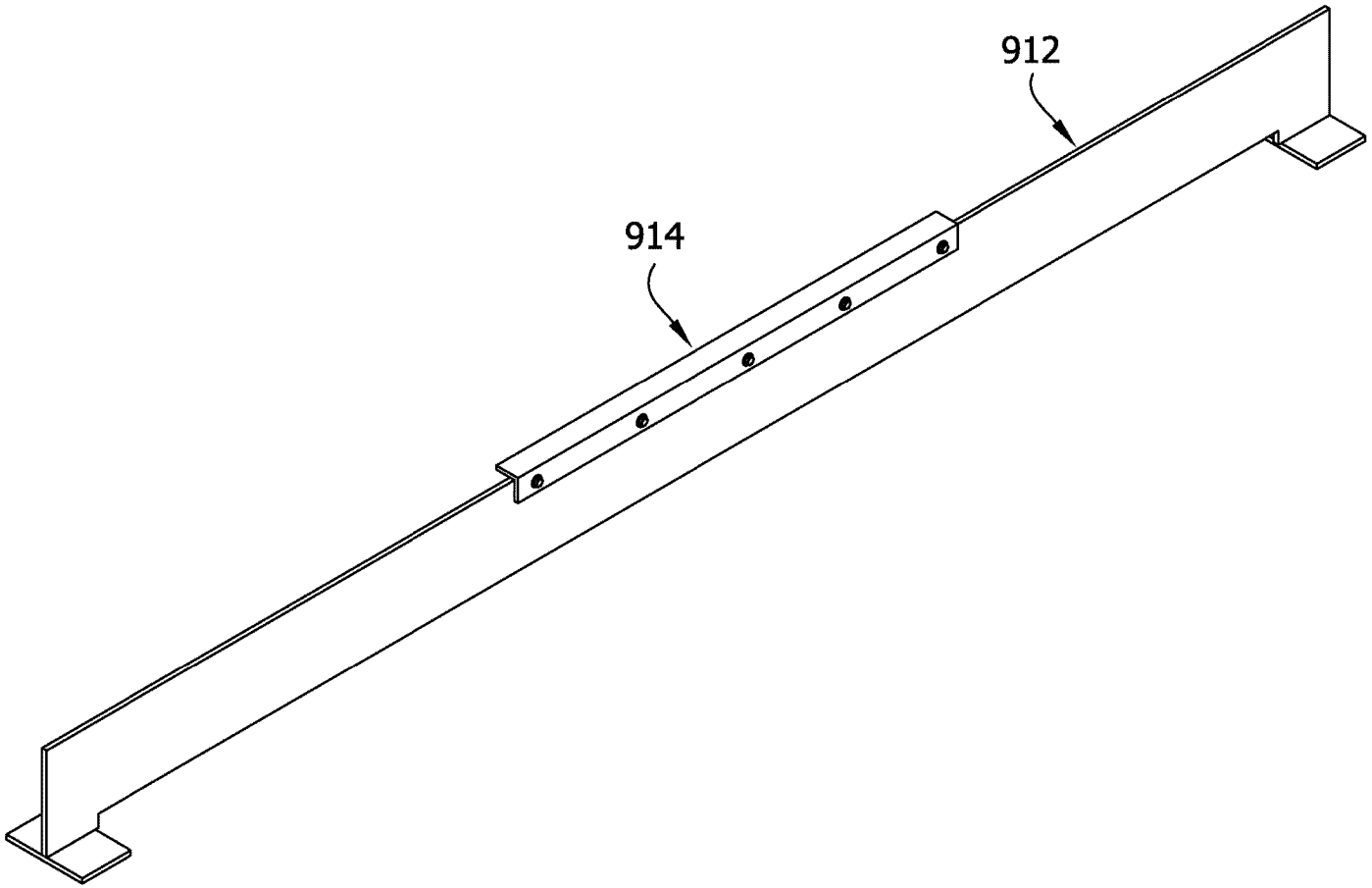
FIG. 20 is a perspective of a lintel of a lintel system of another embodiment.
Figure 21:
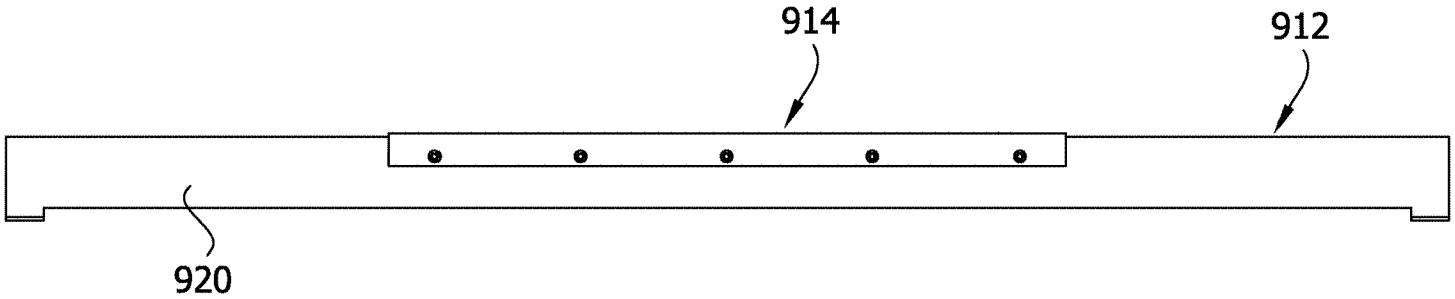
FIG. 21 is a front elevation of the lintel of FIG. 20.

The stiffener 814 comprises an L-shaped member disposed generally at a top of the lintel 812. The stiffener 814 extends partially along a top portion of the rectangular-shaped spanning member 820 such that a first portion 824 is positioned opposite a front side face of the rectangular-shaped spanning member, and a second portion 826 is positioned opposite a top edge of the rectangular-shaped spanning member. The first and second portions 824, 826 are transverse to each other. In one embodiment, the first portion 824 extends down from the top edge less than half of a height of the side face of the rectangular-shaped spanning member 820. In another embodiment, the first portion 824 extends down from the top edge about a quarter of the height of the side face of the rectangular-shaped spanning member 820. In one embodiment, the stiffener 814 extends over less than about 60% of a length of the rectangular-shaped spanning member 820. In another embodiment, the stiffener 814 extends over less than about 50% of the length of the rectangular-shaped spanning member 820. In the illustrated embodiment, the stiffener 814 is welded to the lintel 812. However other ways of attaching the stiffener to the lintel are envisioned. For example, as shown in FIGS. 20 and 21, a lintel 912, substantially identical to lintel 812, comprises a stiffener 914 bolted to rectangular-shaped spanning member 920.

Figure 22:
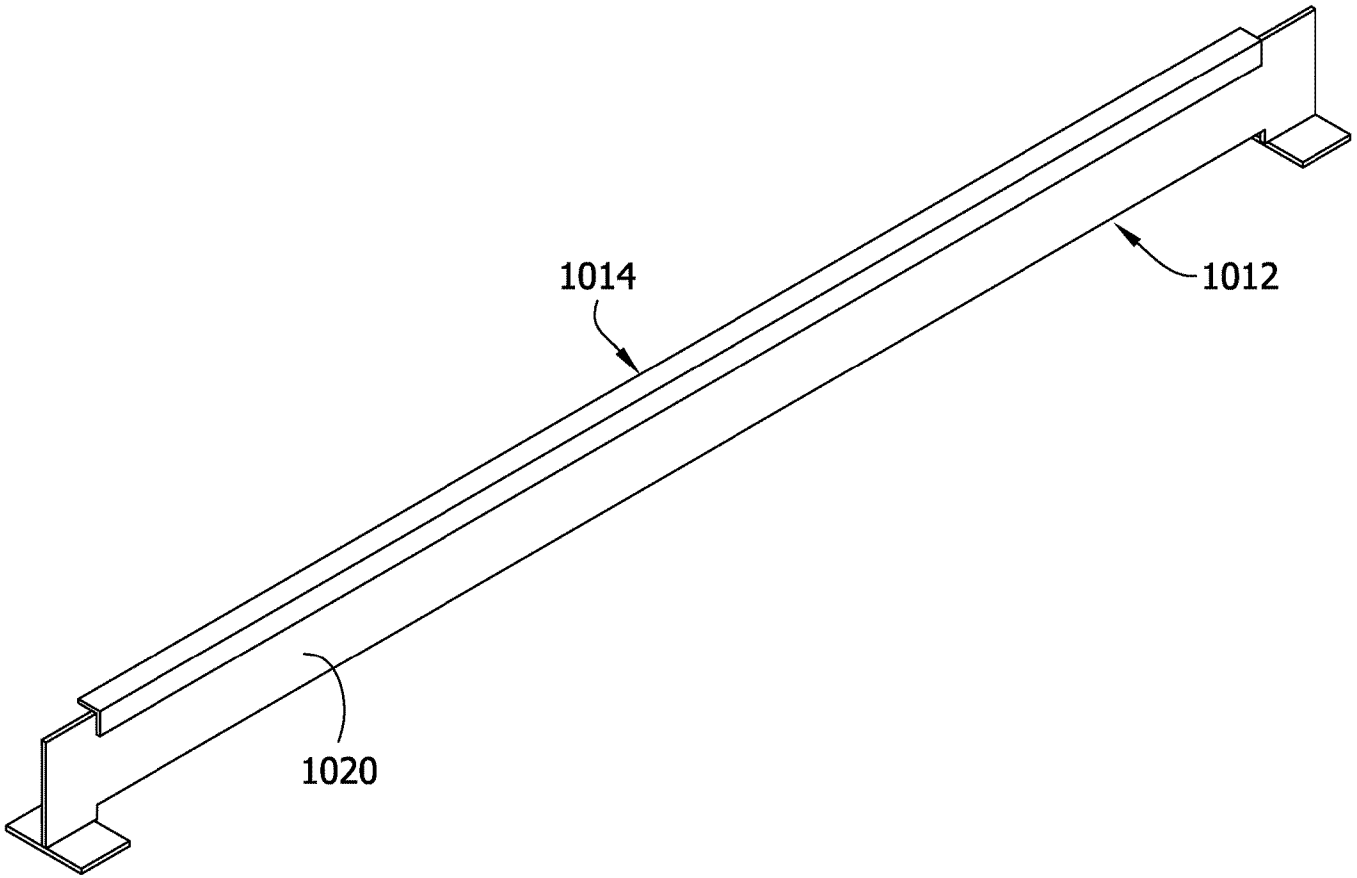
FIG. 22 is a perspective of a lintel of a lintel system of another embodiment.
Figure 23:
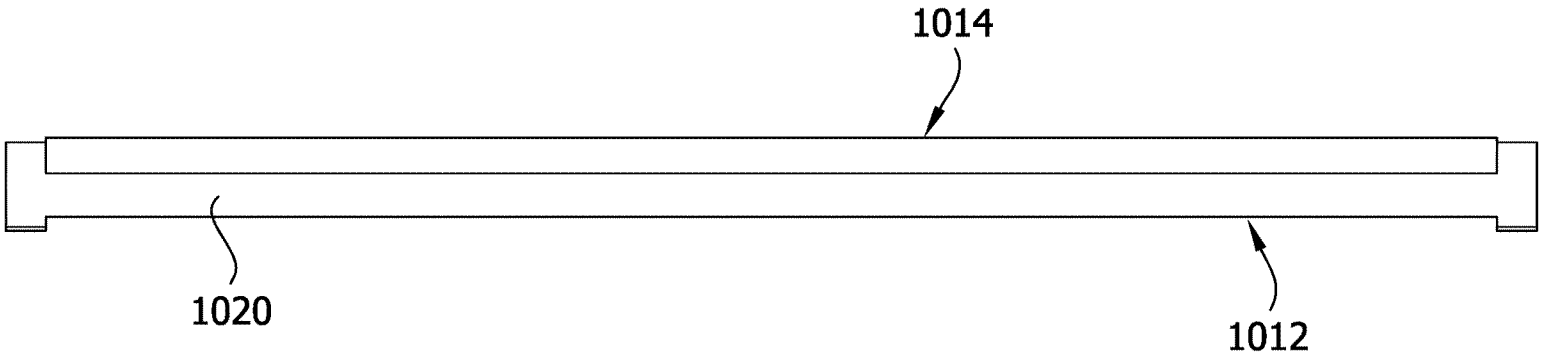
FIG. 23 is a front elevation of the lintel of FIG. 22.
Figure 24:
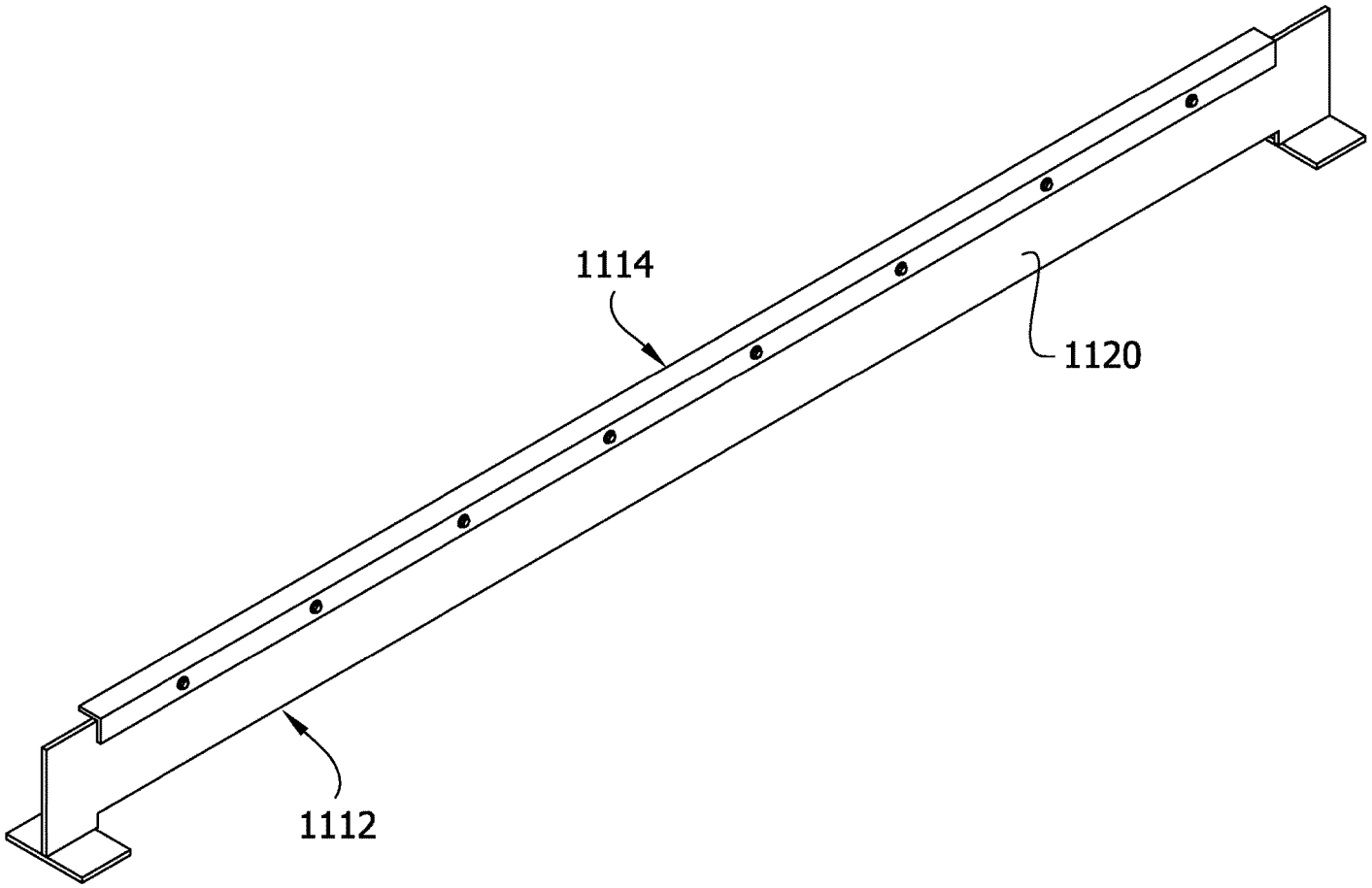
FIG. 24 is a perspective of a lintel of a lintel system of another embodiment.
Figure 25:
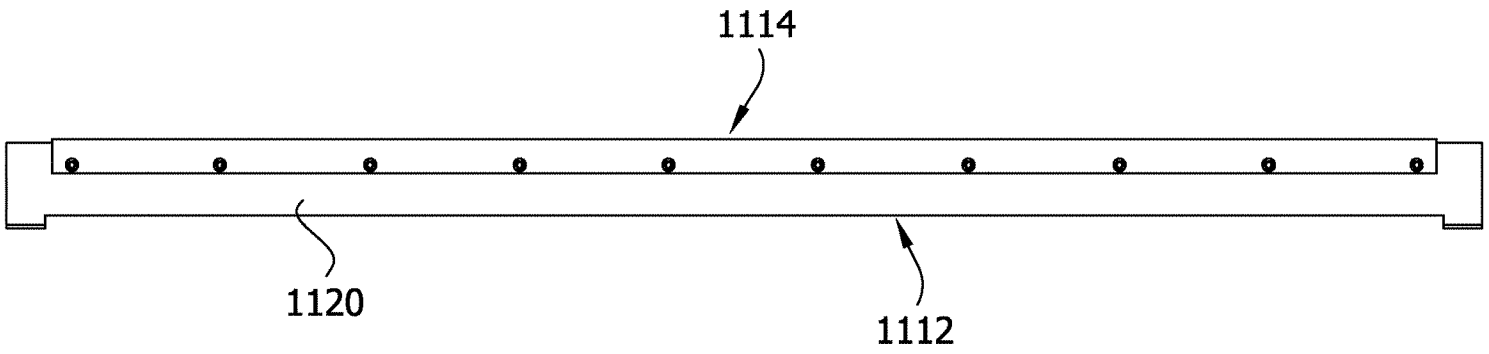
FIG. 25 is a front elevation of the lintel of FIG. 24.

Referring to FIGS. 22 and 23, a lintel includes a stiffener 1014 attached to a rectangular-shaped spanning member 1020. The lintel 1012 is substantially similar to the lintel 812 except stiffener 1014 extends substantially along an entire length of the top portion of the rectangular-shaped spanning member 1020 of the lintel 1012. In one embodiment, the stiffener 1014 extends over at least about 80% of a length of the rectangular-shaped spanning member 1020. In another embodiment, the stiffener 1014 extends over at least about 90% of the length of the rectangular-shaped spanning member 1020. In the illustrated embodiment, the stiffener 1014 is welded to the lintel 1012. However other ways of attaching the stiffener to the lintel are envisioned. For example, as shown in FIGS. 24 and 25, a lintel 1112, comprises a stiffener 1114 bolted to a rectangular-shaped spanning member 1120.

Figure 26:
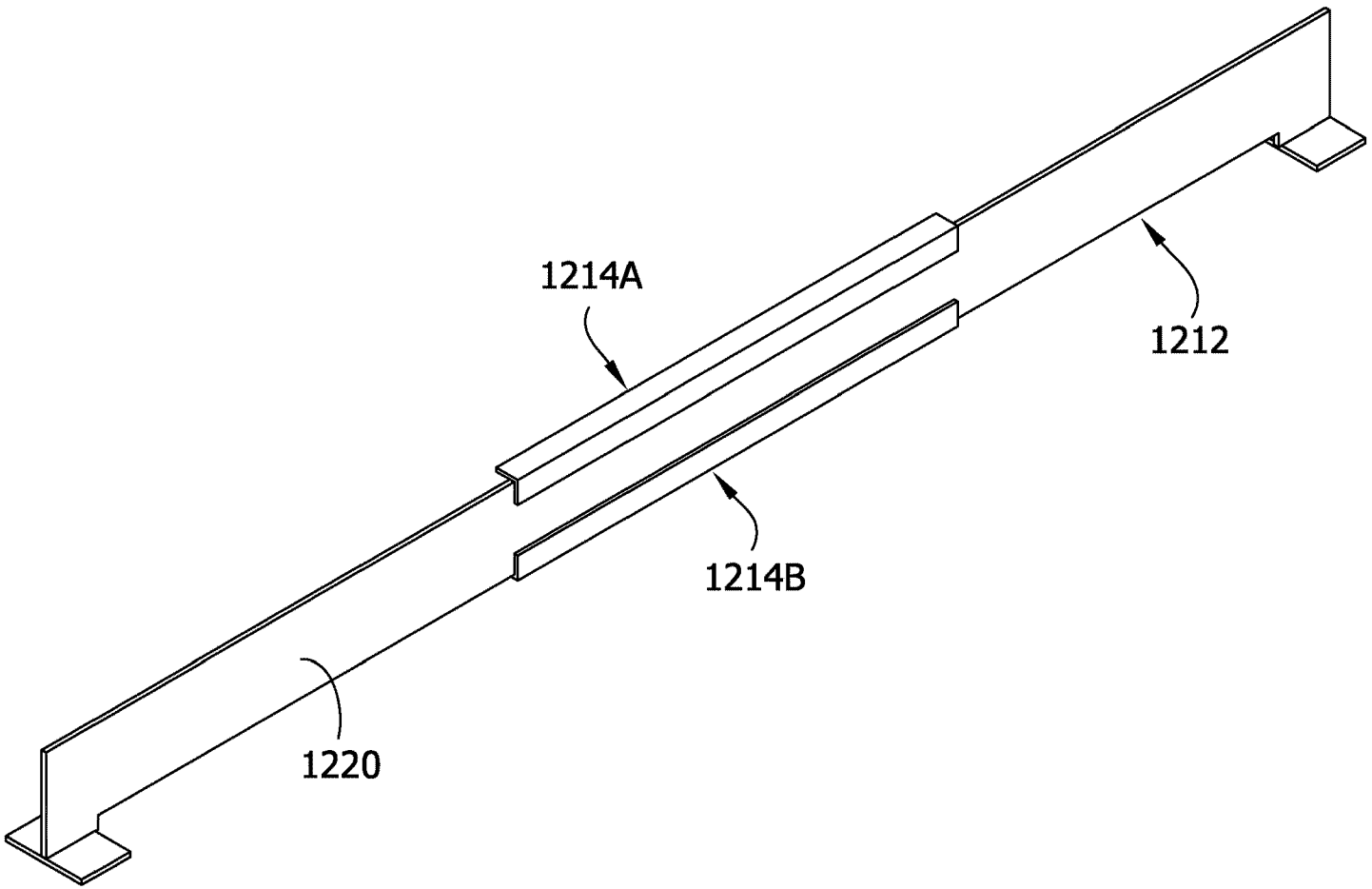
FIG. 26 is a perspective of a lintel of a lintel system of another embodiment.
Figure 27:
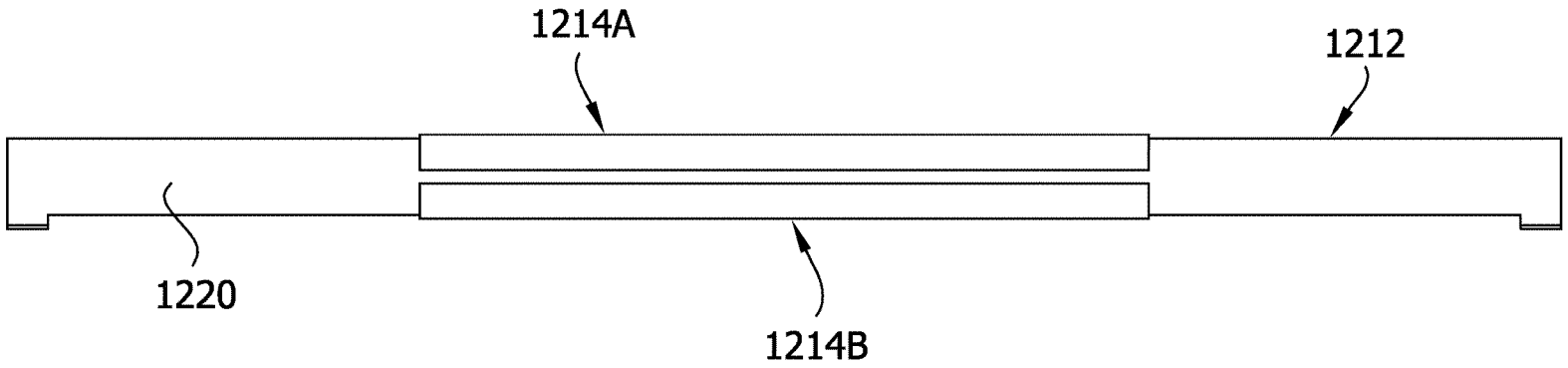
FIG. 27 is a front elevation of the lintel of FIG. 26.
Figure 28:
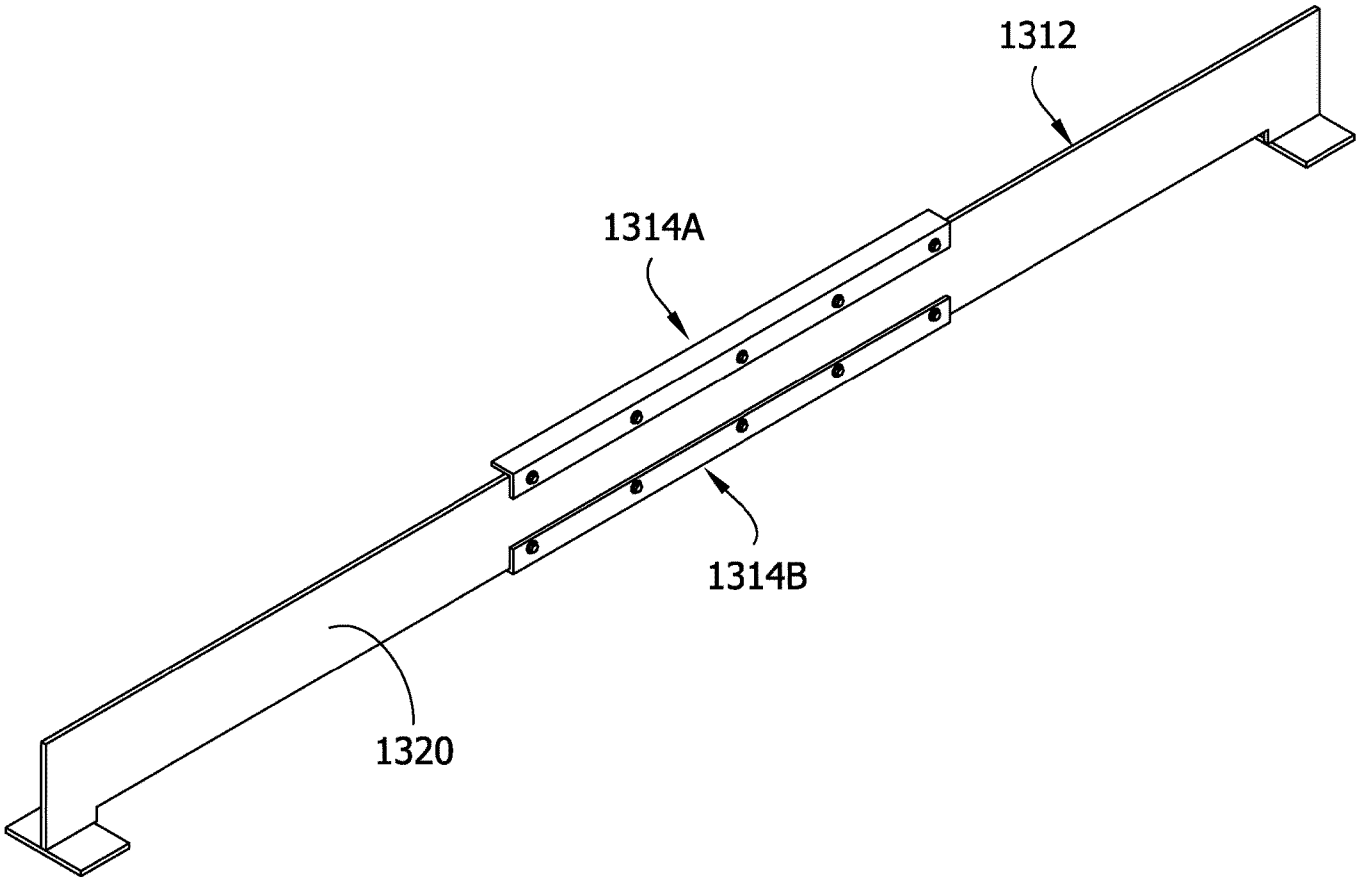
FIG. 28 is a perspective of a lintel of a lintel system of another embodiment.
Figure 29:
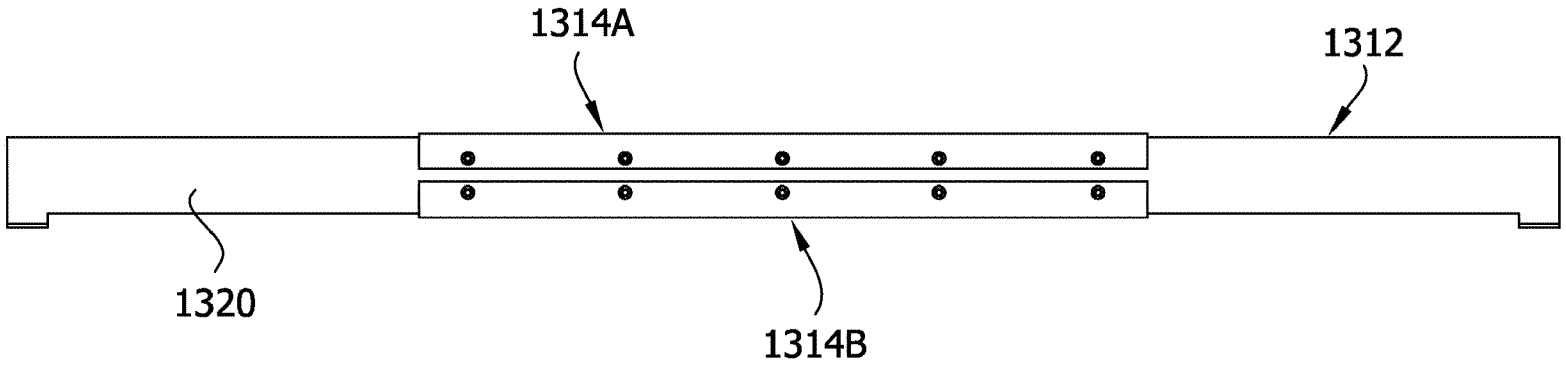
FIG. 29 is a front elevation of the lintel of FIG. 28.

Referring to FIGS. 26 and 27, a lintel 1212 comprises a pair of stiffeners 1214A, 1241B attached to a rectangular-shaped spanning member 1220. The lintel 1212 is substantially similar to the lintel 812 except an additional stiffener 1214B extends substantially along a bottom of rectangular-shaped spanning member 1220. In one embodiment, the stiffeners 1214A, 1214B extend over less than about 60% of a length of the rectangular-shaped spanning member 1220. In another embodiment, the stiffeners 1214A, 1214B extend over less than about 50% of the length of the rectangular-shaped spanning member 1220. In the illustrated embodiment, the stiffeners 1214A, 1214B are welded to the lintel 1212. However other ways of attaching the stiffeners to the lintel are envisioned. For example, as shown in FIGS. 28 and 29, a lintel system 1310, substantially identical to lintel system 1210, comprises stiffeners 1314A, 1314B bolted to lintel 1312.

Figure 30:
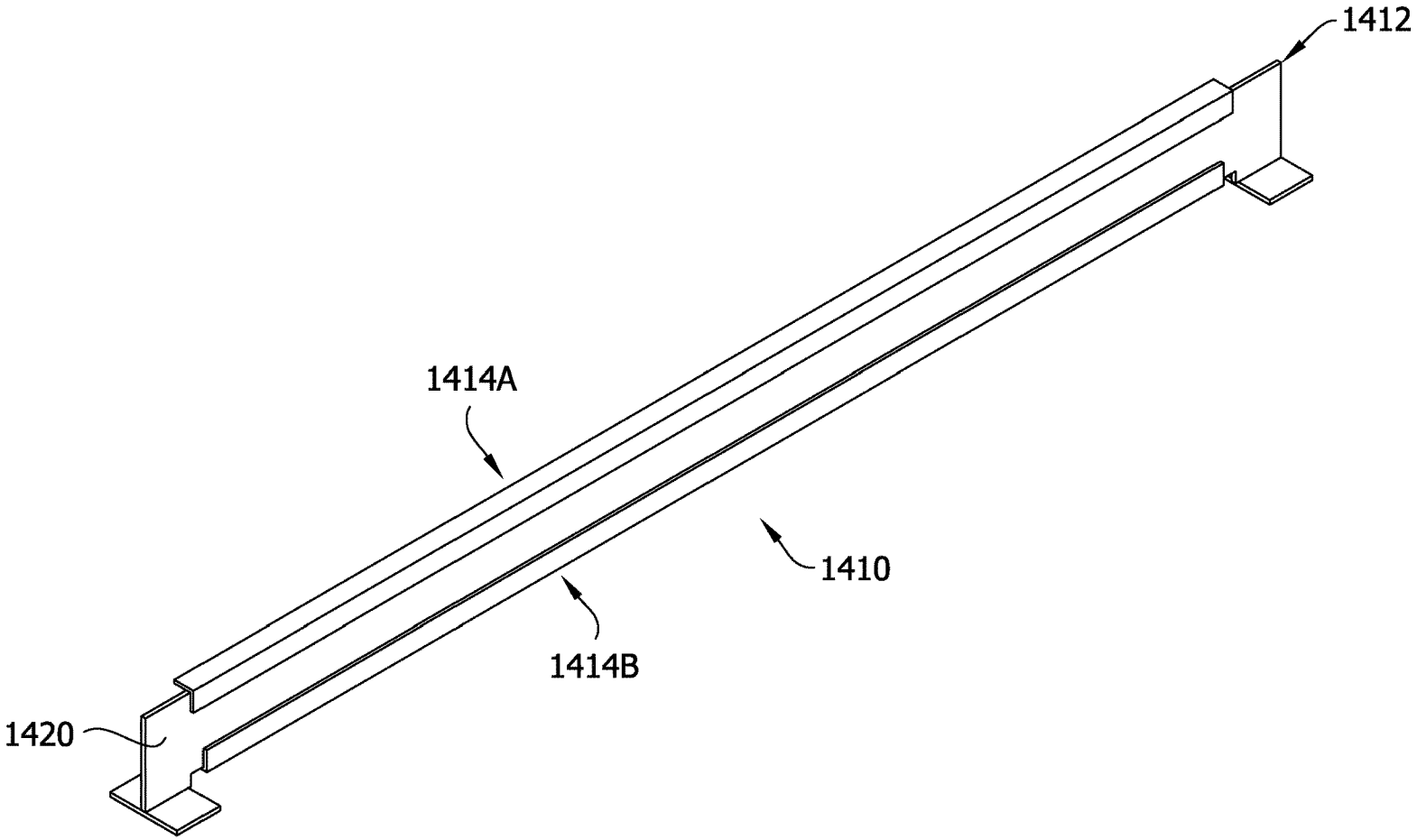
FIG. 30 is a perspective of a lintel of a lintel system of another embodiment.
Figure 31:
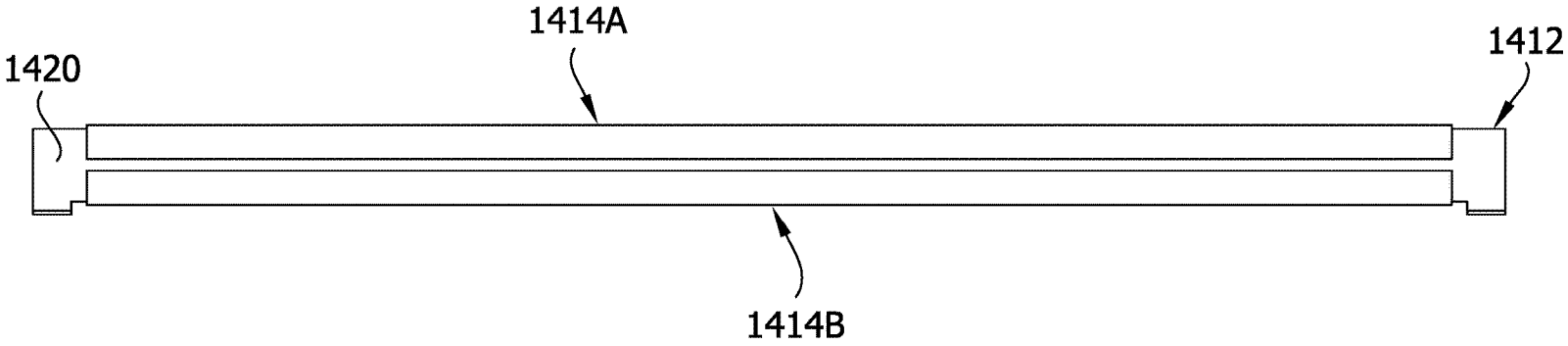
FIG. 31 is a front elevation of the lintel of FIG. 30.
Figure 32:
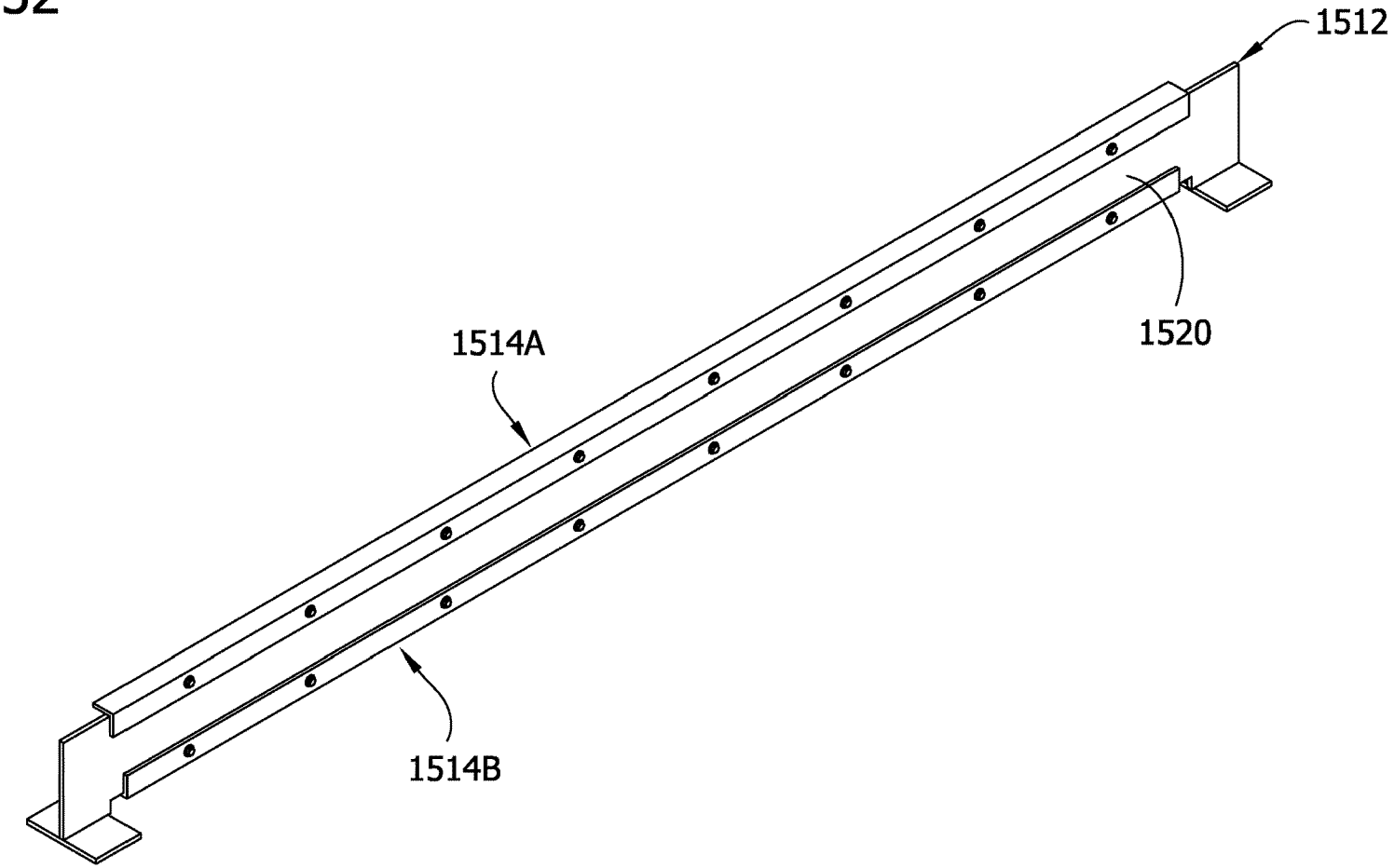
FIG. 32 is a perspective of a lintel of a lintel system of another embodiment.
Figure 33:
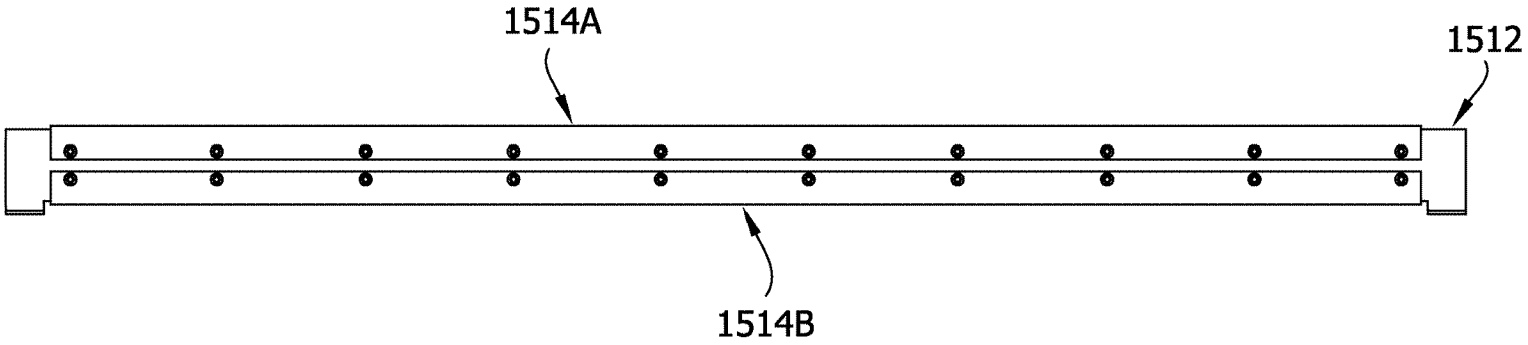
FIG. 33 is a front elevation of the lintel of FIG. 32.

Referring to FIGS. 30 and 31, a lintel 1412 includes stiffeners 1414A, 1414B attached to a rectangular-shaped spanning member 1420. The lintel 1412 is substantially similar to the lintel system 1210 except stiffeners 1414A, 1414B extend substantially along an entire length of the top and bottom edges of the rectangular-shaped spanning member 1420 of the lintel 1412. In one embodiment, the stiffeners 1414A, 1414B extend over at least about 80% of a length of the rectangular-shaped spanning member 1420. In another embodiment, the stiffeners 1414A, 1414B extend over at least about 90% of the length of the rectangular-shaped spanning member 1420. In the illustrated embodiment, the stiffeners 1414A, 1414B are welded to the lintel 1412. However other ways of attaching the stiffener to the lintel are envisioned. For example, as shown in FIGS. 32 and 33, a lintel 1512, substantially identical to lintel 1412, comprises stiffeners 1514A, 1514B bolted to rectangular-shaped spanning member 1520.

Figure 34:
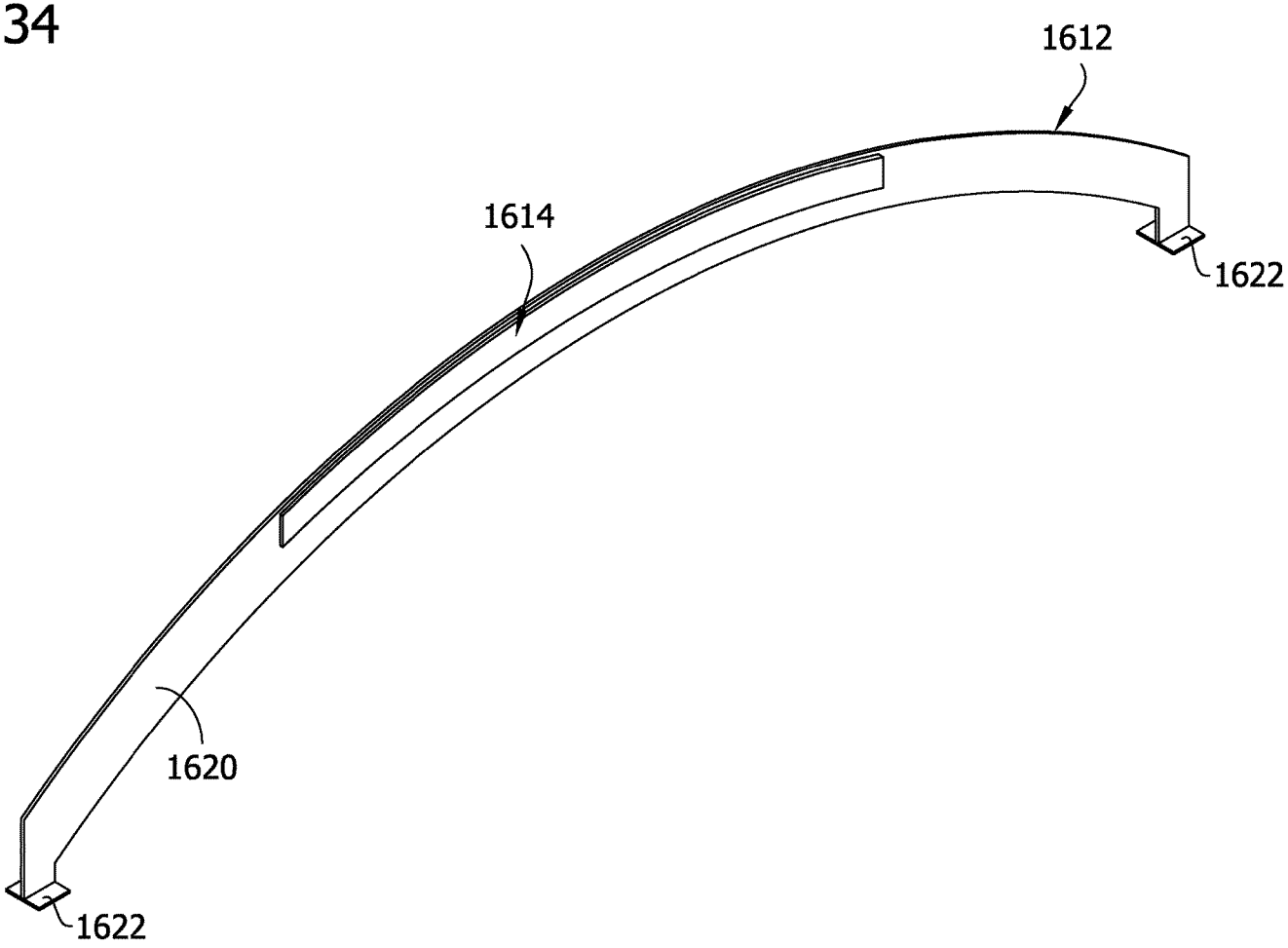
FIG. 34 is a perspective of a lintel of a lintel system of another embodiment.
Figure 35:
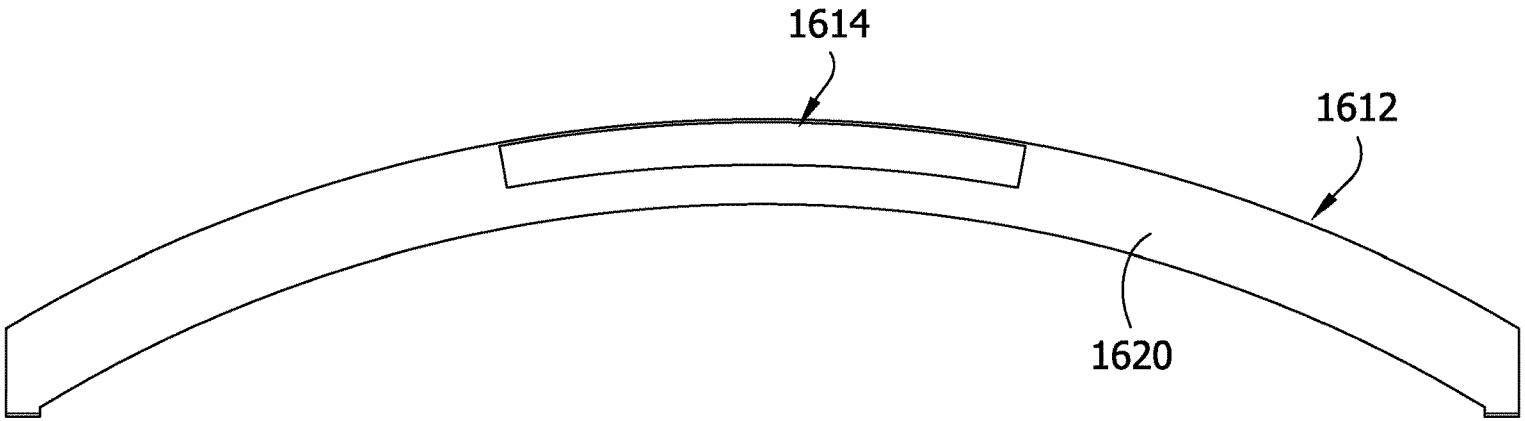
FIG. 35 is a front elevation of the lintel of FIG. 34.
Figure 35A:
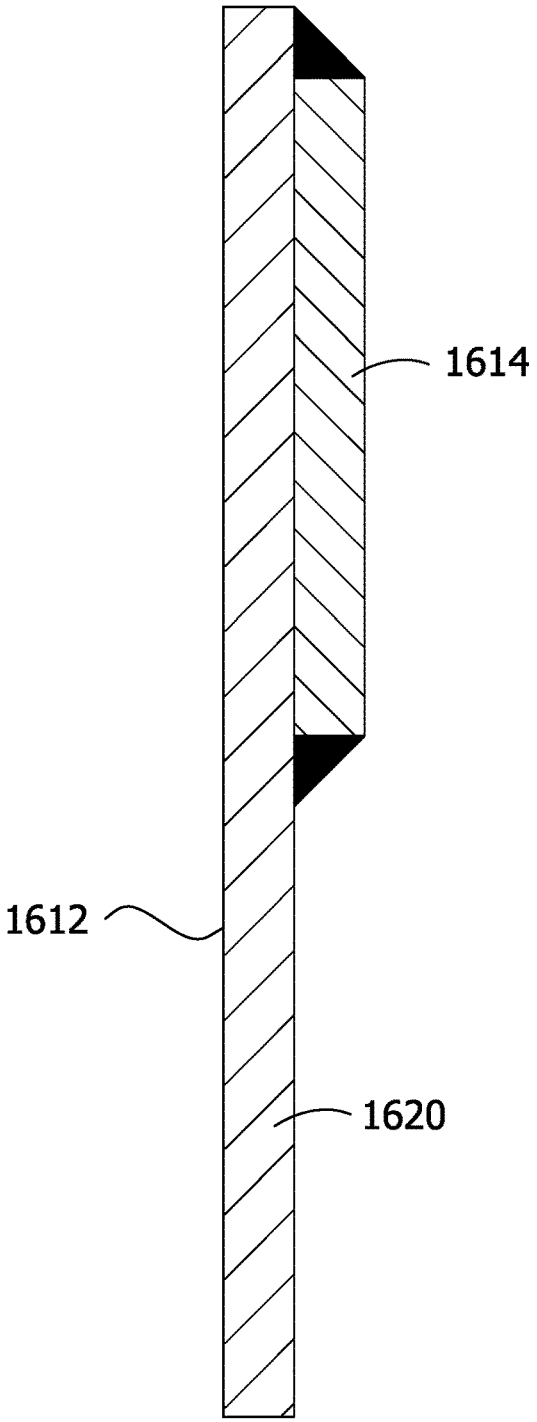
FIG. 35A is a section of the lintel of FIG. 34.

Referring to FIGS. 34-35A, a lintel 1612 comprises a stiffener 1614 attached to an arched-shaped spanning member 1620. The lintel 1612 comprises an arch-shaped spanning member 1620 and base members 1622 disposed at longitudinal ends of the arch-shaped spanning member. The base members 1622 extend laterally from the arch-shaped spanning member 1620.

Figure 36:
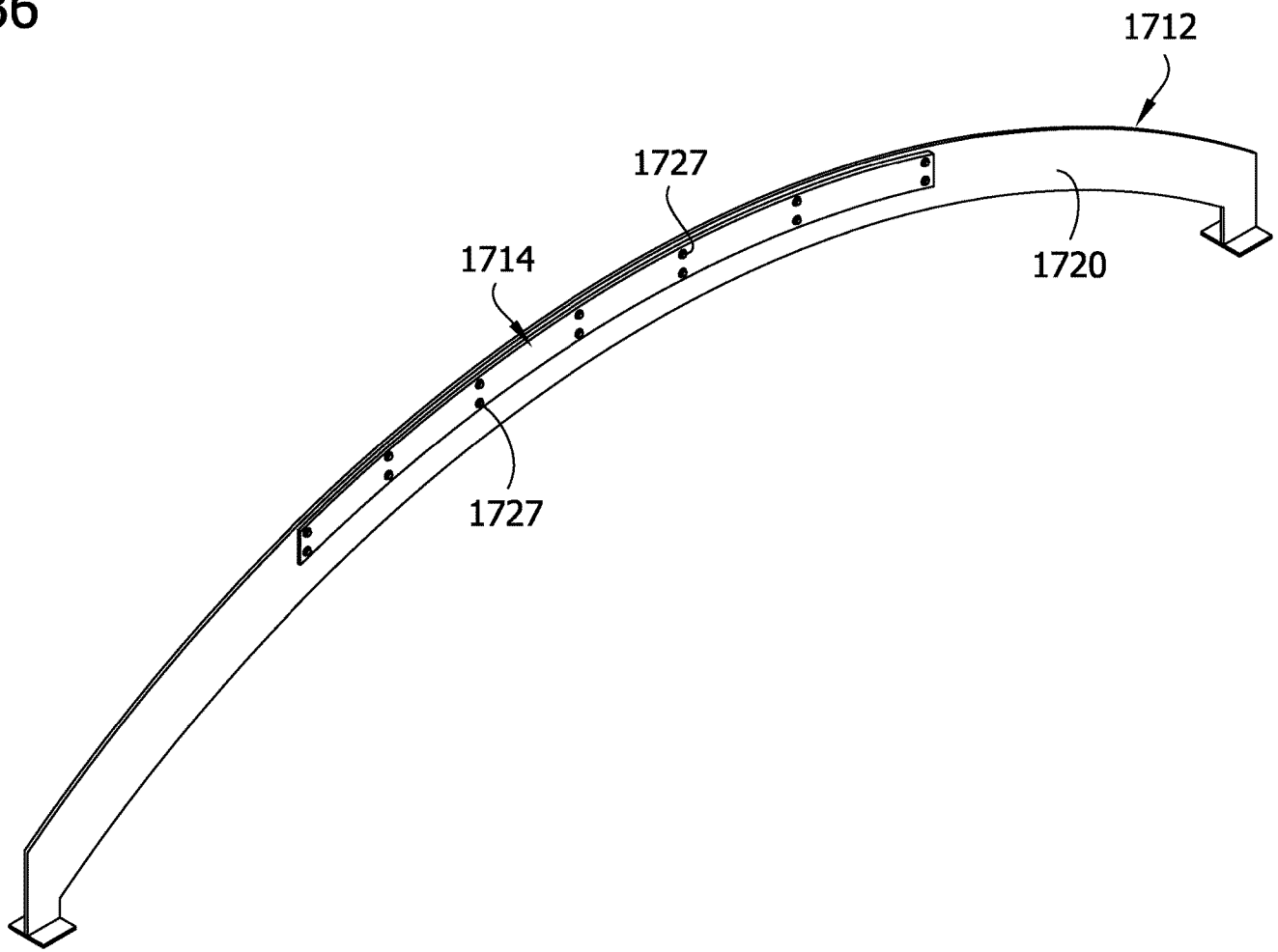
FIG. 36 is a perspective of a lintel of a lintel system of another embodiment.
Figure 37:
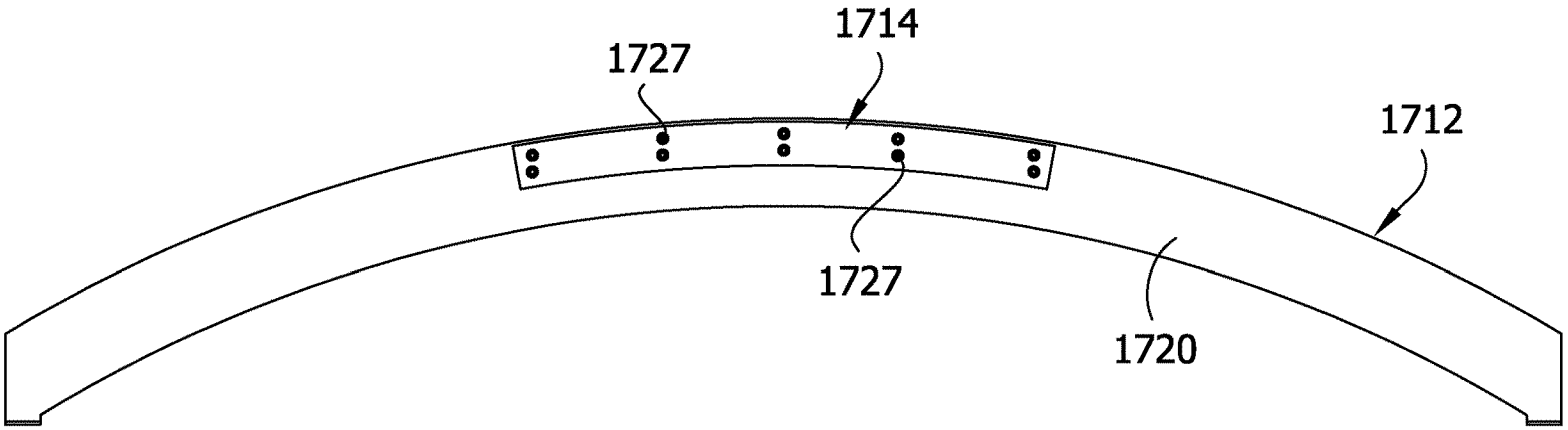
FIG. 37 is a front elevation of the lintel of FIG. 36.
Figure 37A:
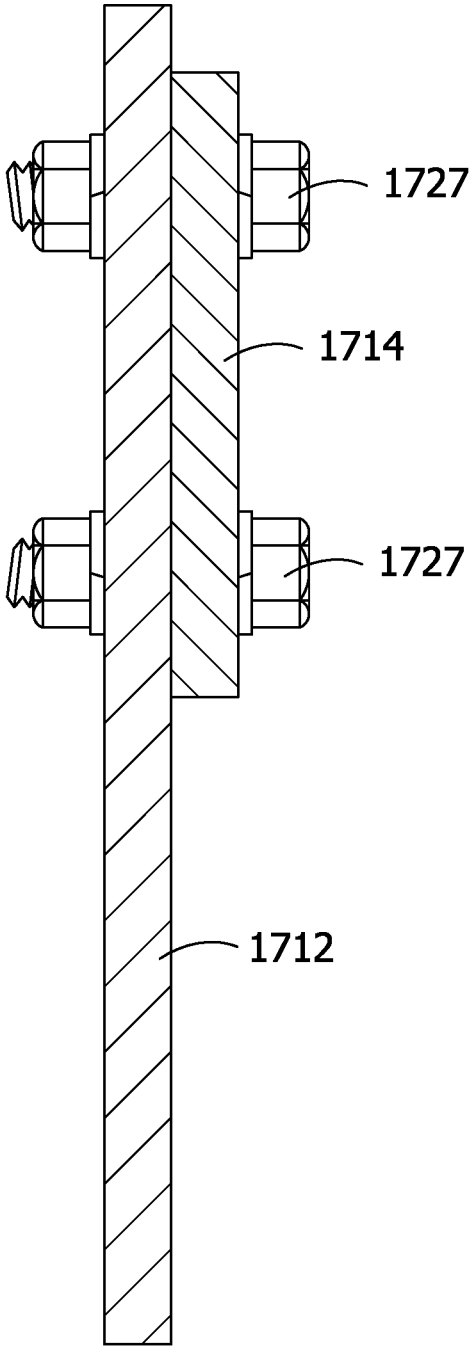
FIG. 37A is a cross section of the lintel of FIG. 36.

The stiffener 1614 comprises a plate that is curved a long its length in conformance with the arch-shaped spanning member 1620. The stiffer 1614 is disposed generally at a top of the arched-shaped spanning member 1620. The stiffener 1614 extends partially along the arch-shaped spanning member 1620 and is positioned opposite a front side face of the arch-shaped spanning member. In one embodiment, the stiffener 1614 extends down from adjacent a top edge of the arch-shaped spanning member 1620 less than half of a height of the side face of the arch-shaped spanning member. In one embodiment, the stiffener 1614 extends over less than about 60% of a length of the arch-shaped spanning member 1620. In another embodiment, the stiffener 1614 extends over less than about 50% of the length of the arch-shaped spanning member 1620. In the illustrated embodiment, the stiffener 1614 is welded to the lintel 1612. As shown in FIG. 35A, the stiffener 1614 is welded to the front side face of the arch-shaped spanning member 1620 along top and bottom edges of the stiffener. The ends may also be welded. However other ways of attaching the stiffener to the lintel are envisioned. For example, as shown in FIGS. 36-37A, a lintel 1712, substantially identical to lintel 1612, comprises a stiffener 1714 attached to arch-shaped spanning member 1720 by bolts 1727. In the illustrated embodiment, the bolts 1727 are arranged in rows extending along a length of the stiffener 1714.

Figure 38:
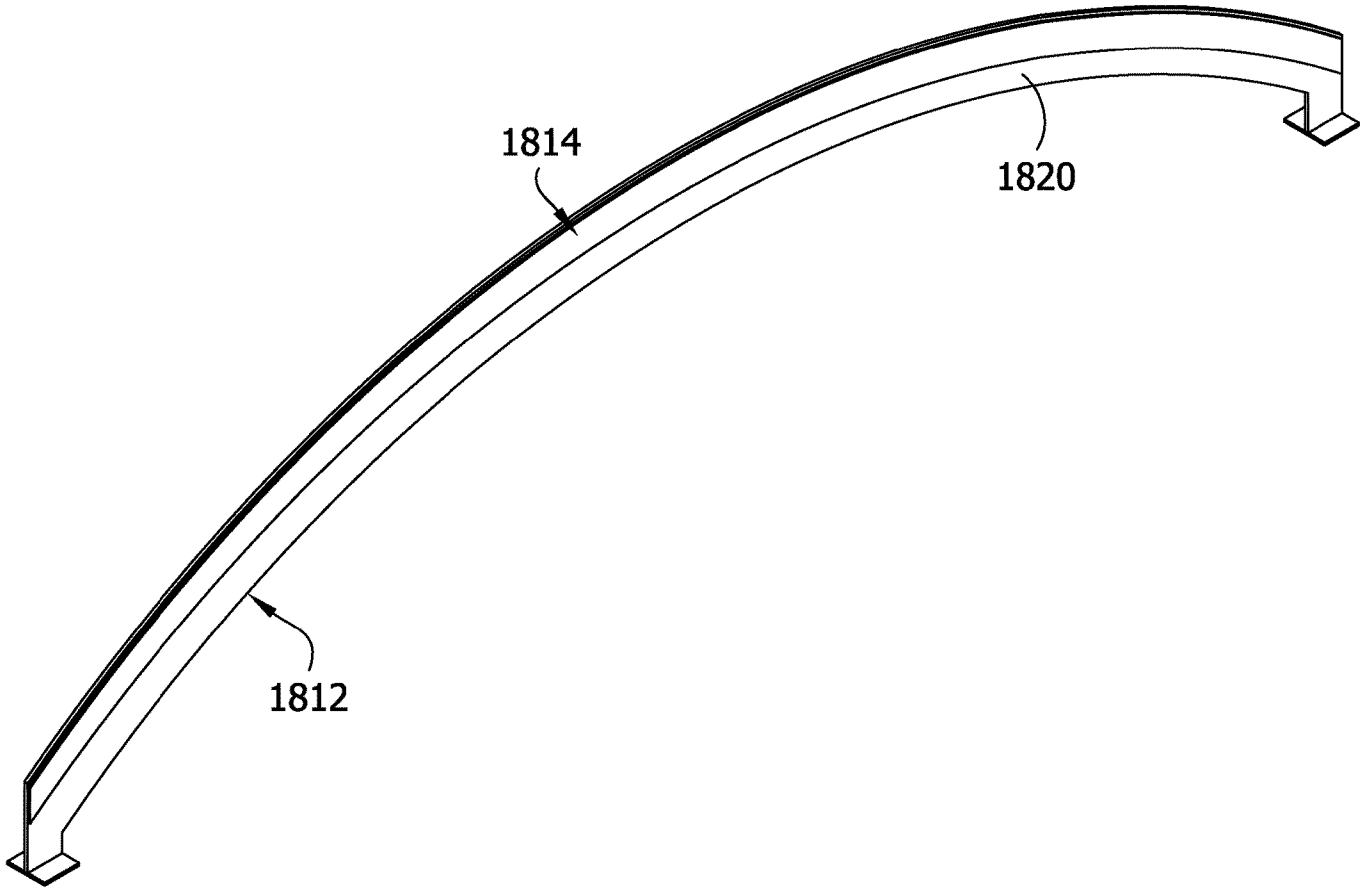
FIG. 38 is a perspective of a lintel of a lintel system of another embodiment.
Figure 39:
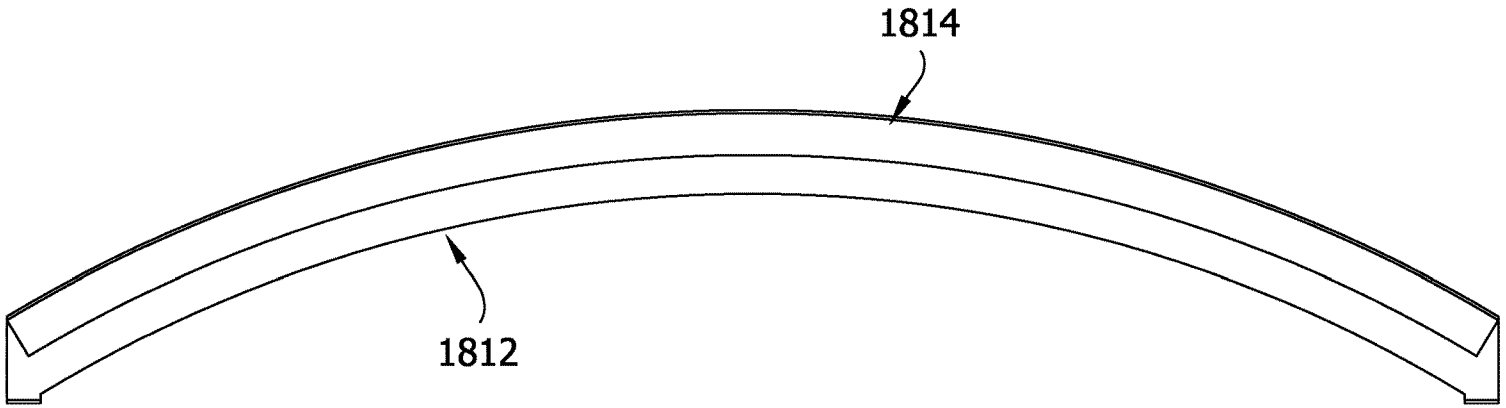
FIG. 39 is a front elevation of the lintel system of FIG. 38.
Figure 40:
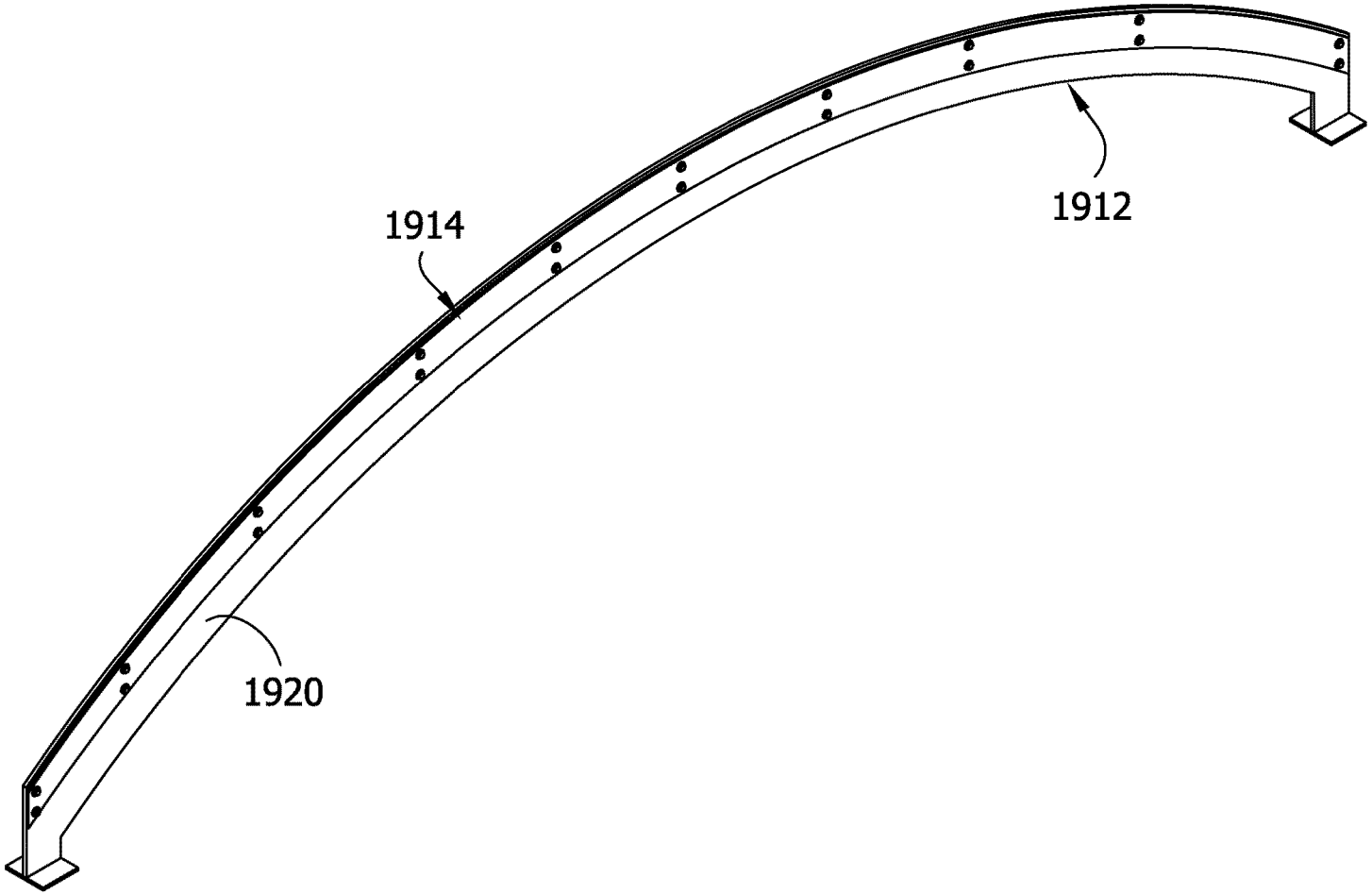
FIG. 40 is a perspective of a lintel of a lintel system of another embodiment.
Figure 41:
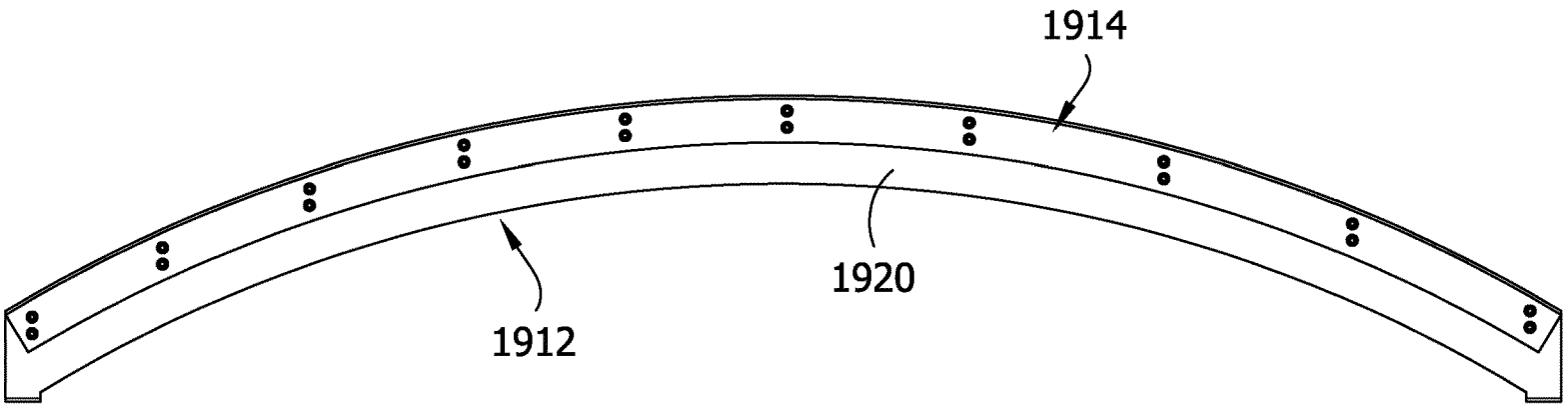
FIG. 41 is a front elevation of the lintel of FIG. 40.

Referring to FIGS. 38 and 39, a lintel 1812 comprises a stiffener 1814 attached to arched-shaped spanning member 1820. The lintel 1812 is substantially similar to the lintel 1612 except stiffener 1814 extends substantially along an entire length of the arch-shaped spanning member 1820 of the lintel 1812. In one embodiment, the stiffener 1814 extends over at least about 80% of a length of the arch-shaped spanning member 1820. In another embodiment, the stiffener 1814 extends over at least about 90% of the length of the arch-shaped spanning member 1820. In the illustrated embodiment, the stiffener 1814 is welded to the arch-shaped spanning member. However other ways of attaching the stiffener to the lintel are envisioned. For example, as shown in FIGS. 40 and 41, a lintel 1912, substantially identical to lintel, comprises a stiffener 1914 bolted to arch-shaped spanning member 1920.

Figure 42:
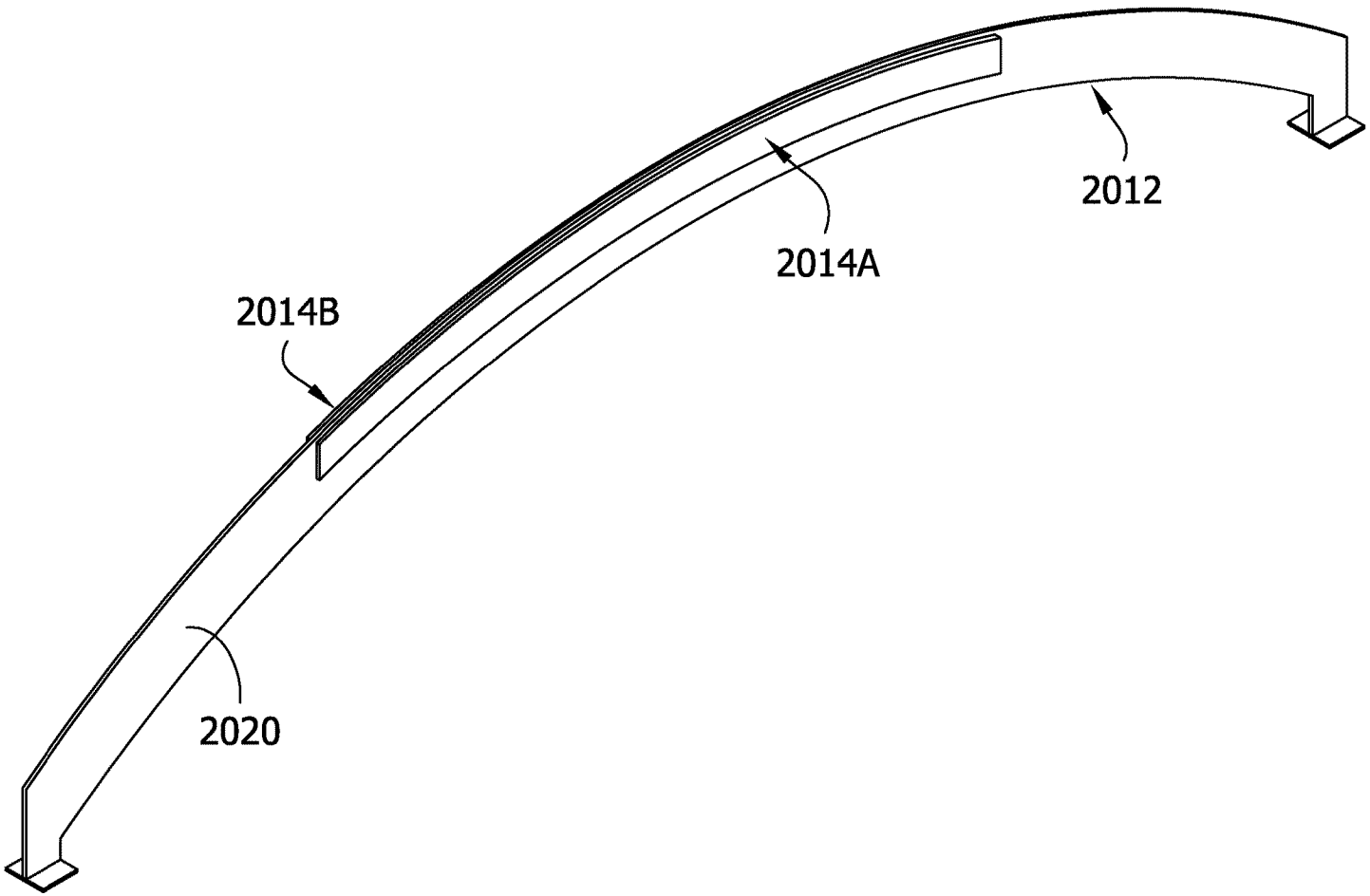
FIG. 42 is a perspective of a lintel of a lintel system of another embodiment.
Figure 42A:
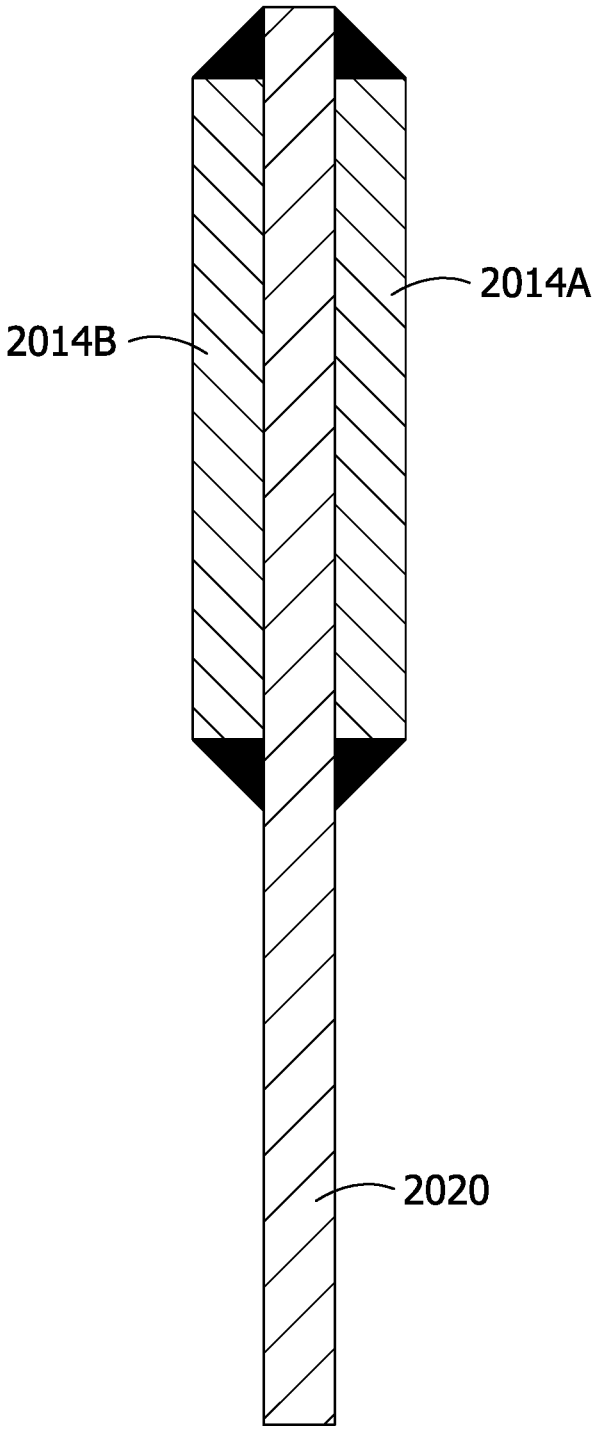
FIG. 42A is a cross section of the lintel of FIG. 42.
Figure 43:
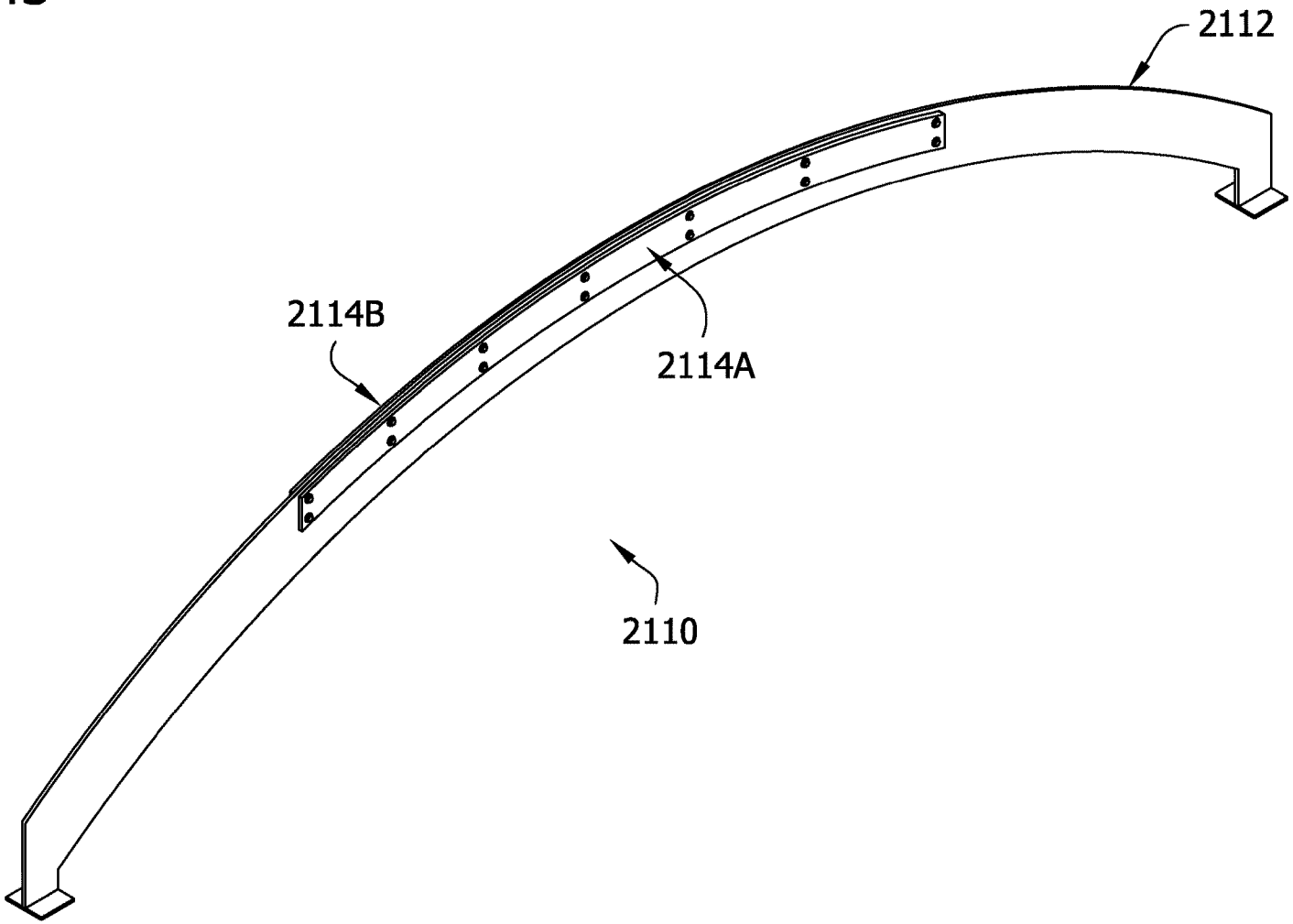
FIG. 43 is a perspective of a lintel of a lintel system of another embodiment.
Figure 43A:
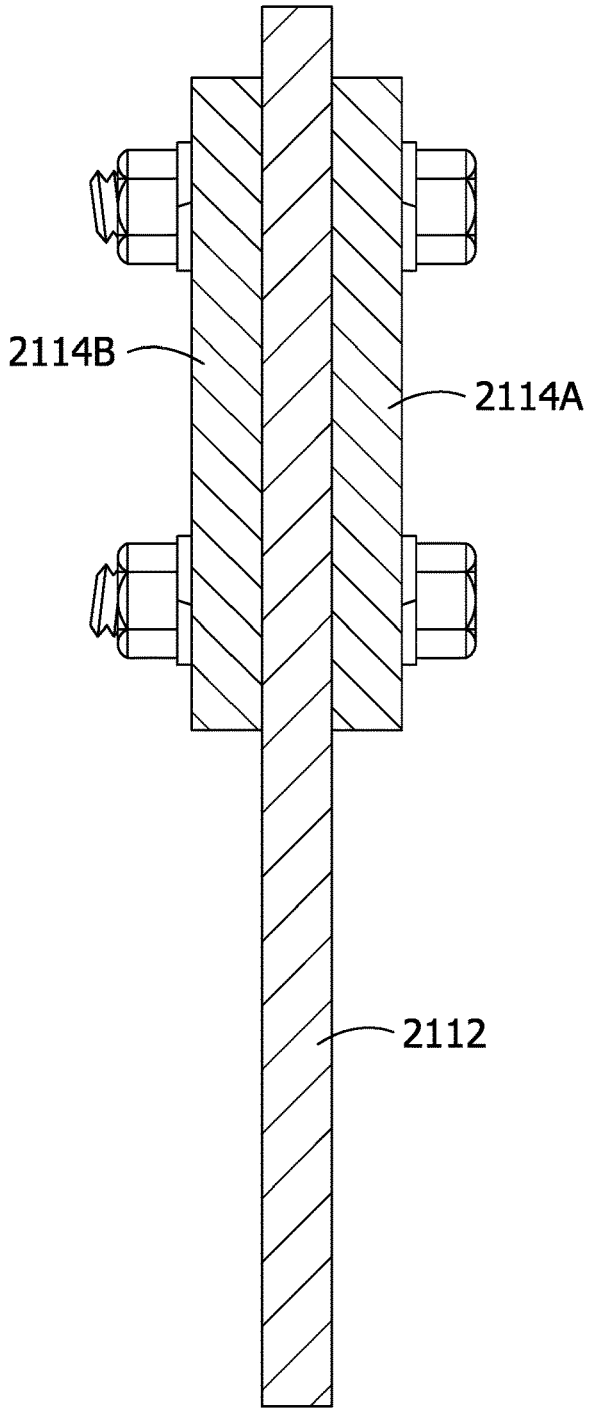
FIG. 43A is a cross section of the lintel of FIG. 43.

Referring to FIGS. 42 and 42A, a lintel 2012 includes pair of stiffeners 2014A, 2014B attached to arched-shaped spanning member 2020. The lintel 2012 is substantially similar to the lintel 1612 except an additional stiffener 2014B extends substantially along an opposite rear side face of arch-shaped spanning member 2020. In one embodiment, the stiffeners 2014A, 2014B extend over less than about 60% of a length of the arch-shaped spanning member 2020. In another embodiment, the stiffeners 2014A, 2014B extend over less than about 50% of the length of the arch-shaped spanning member 2020. In the illustrated embodiment, the stiffeners 2014A, 2014B are welded to the lintel 2012. However other ways of attaching the stiffeners to the lintel are envisioned. For example, as shown in FIGS. 43 and 43A, a lintel 2112, substantially identical to lintel 2012, comprises stiffeners 2114A, 2114B bolted to arched-shaped spanning member 2120.

Figure 44:
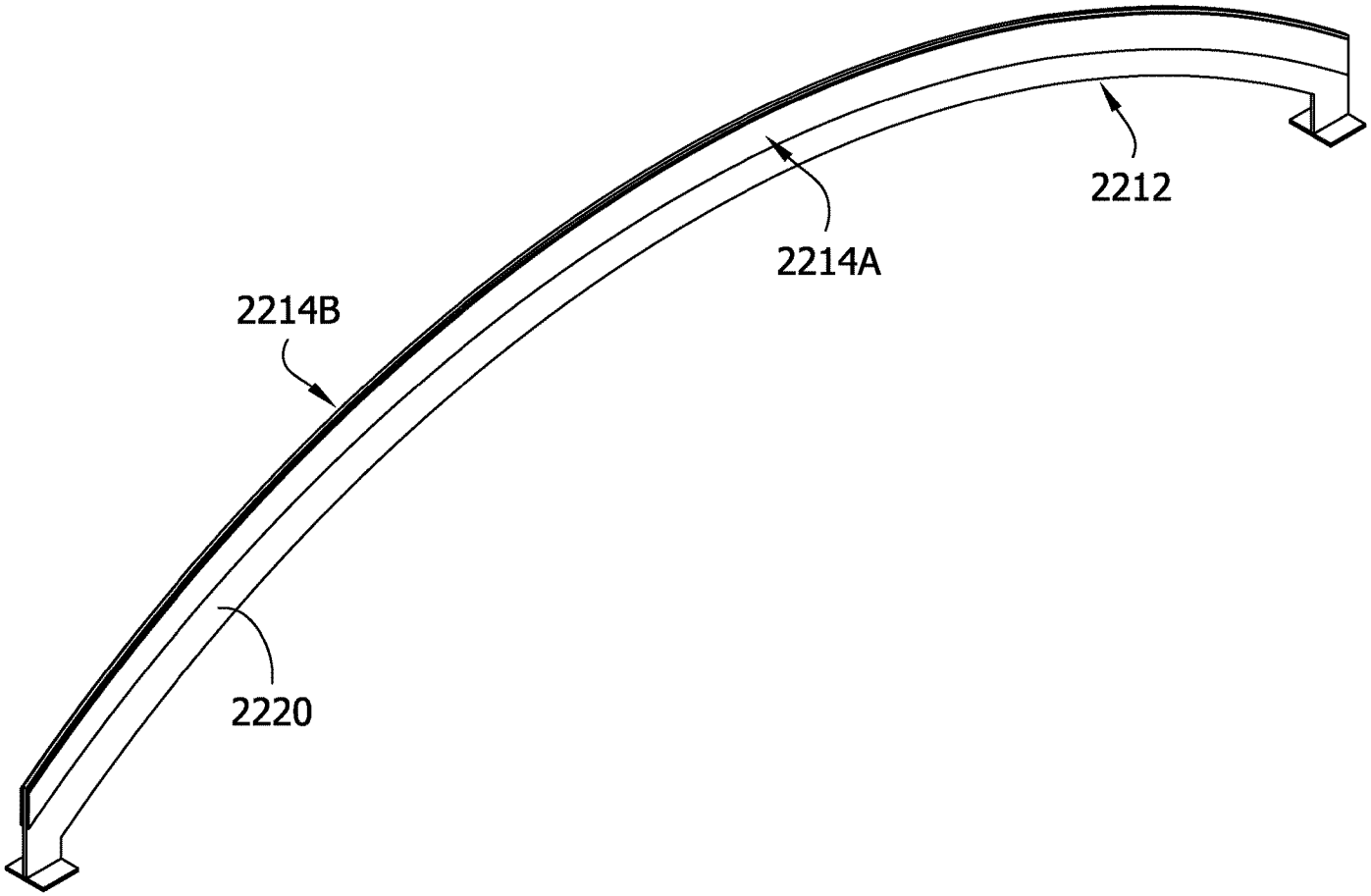
FIG. 44 is a perspective of a lintel of a lintel system of another embodiment.
Figure 45:
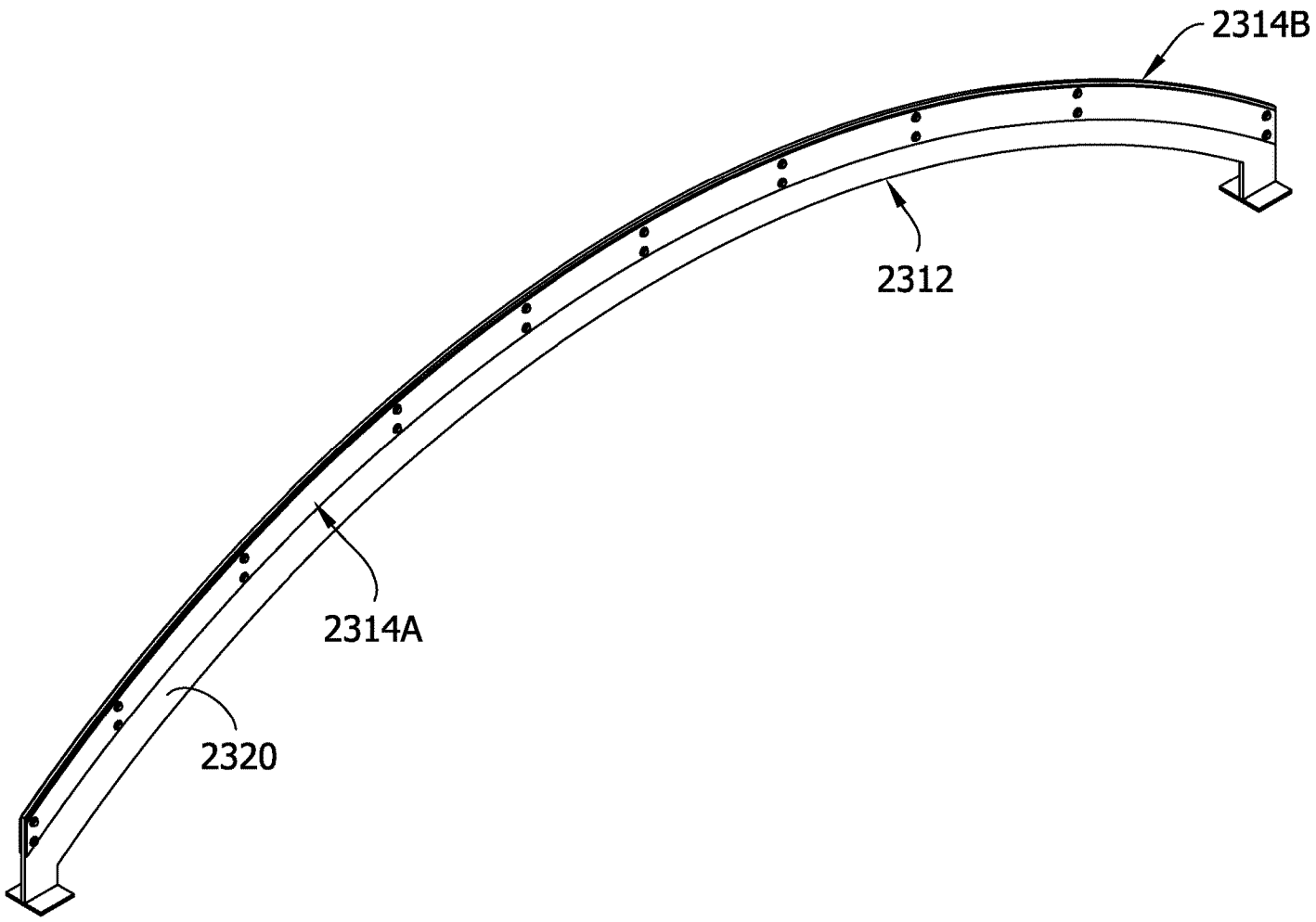
FIG. 45 is a perspective of a lintel of a lintel system of another embodiment.

Referring to FIG. 44, a lintel 2212 includes stiffeners 2214A, 2214B attached to arched-shaped spanning member 2220. The lintel 2212 is substantially similar to the lintel 2012 except stiffeners 2214A, 2214B extend substantially along an entire length of the arch-shaped spanning member 2220 of the lintel 2212. In one embodiment, the stiffeners 2214A, 2214B extend over at least about 80% of a length of the arch-shaped spanning member 2220. In another embodiment, the stiffeners 2214A, 2214B extend over at least about 90% of the length of the arch-shaped spanning member 2220. In the illustrated embodiment, the stiffeners 2214A, 2214B are welded to the lintel 2212. However other ways of attaching the stiffener to the lintel are envisioned. For example, as shown in FIG. 45, a lintel 2312, substantially identical to lintel 2212, comprises stiffeners 2314A, 2314B bolted to arched-shaped spanning member 2320.

Figure 46:
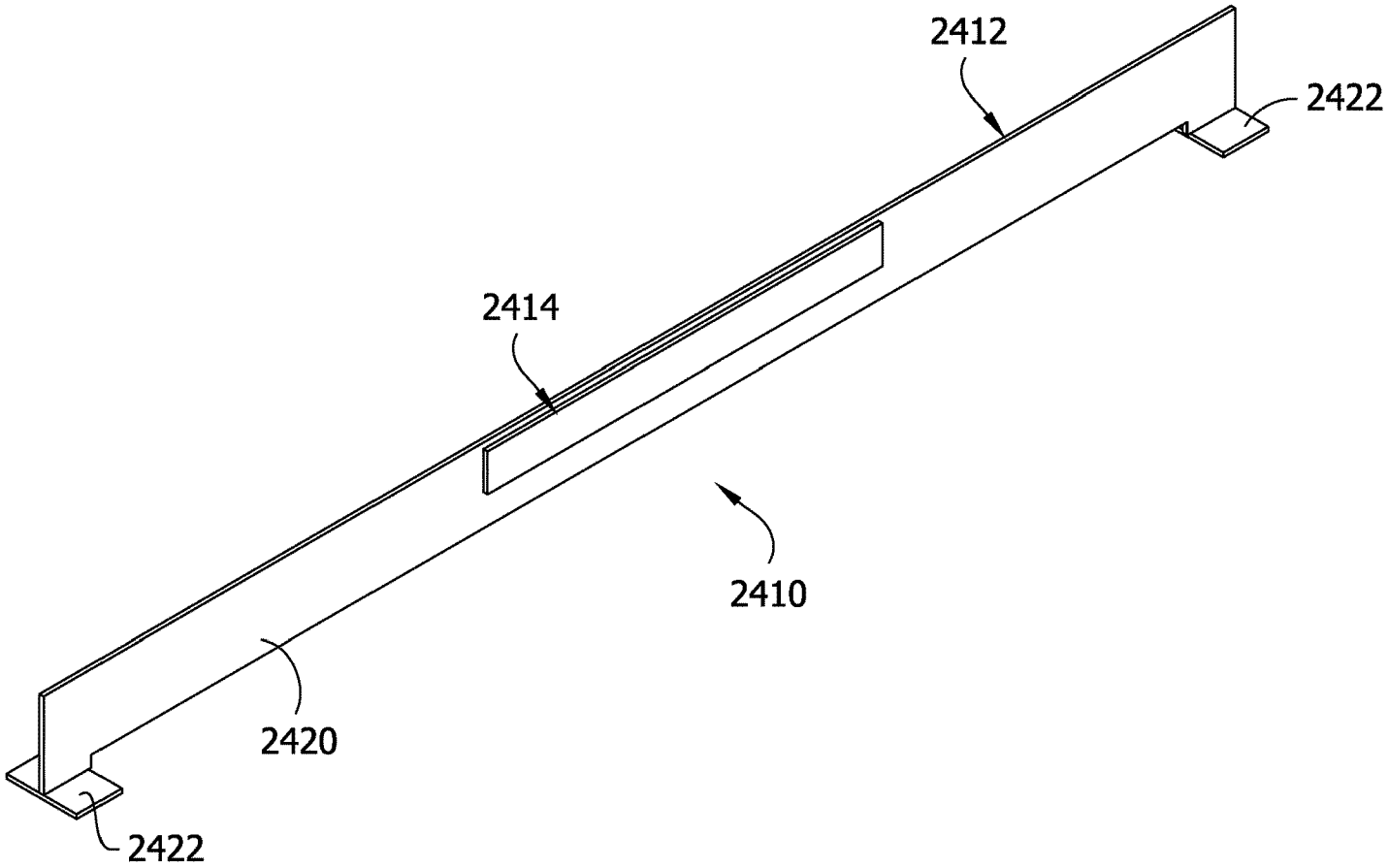
FIG. 46 is a perspective of a lintel of a lintel system of another embodiment.
Figure 47:
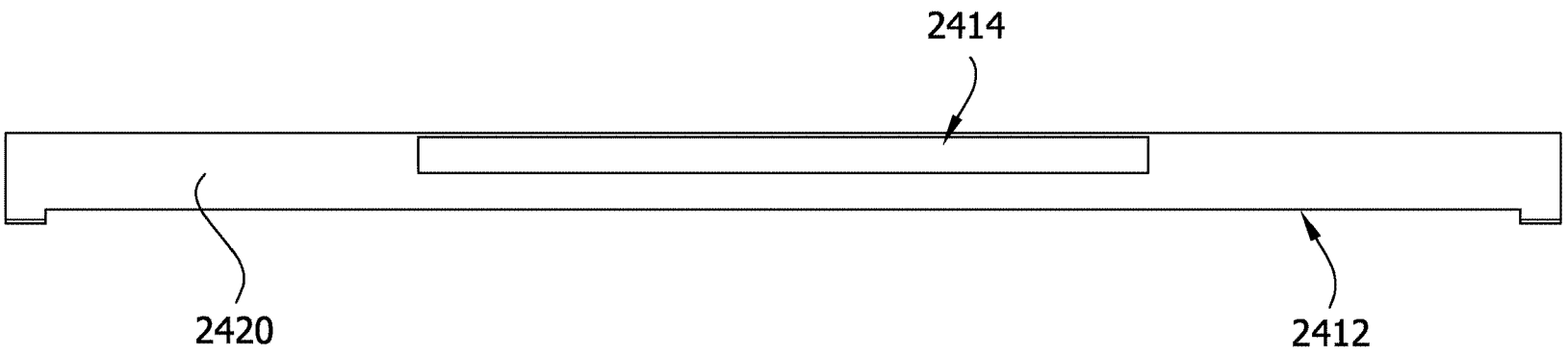
FIG. 47 is a front elevation of the lintel of FIG. 46.

Referring to FIGS. 46 and 47, a lintel 2412 includes a stiffener 2414 attached to rectangular-shaped spanning member 2420. The lintel 2412 further comprises base members 2422 disposed at longitudinal ends of the rectangular-shaped spanning member 2420. The base members 2422 extend laterally from the rectangular-shaped spanning member 2420.

Figure 48:
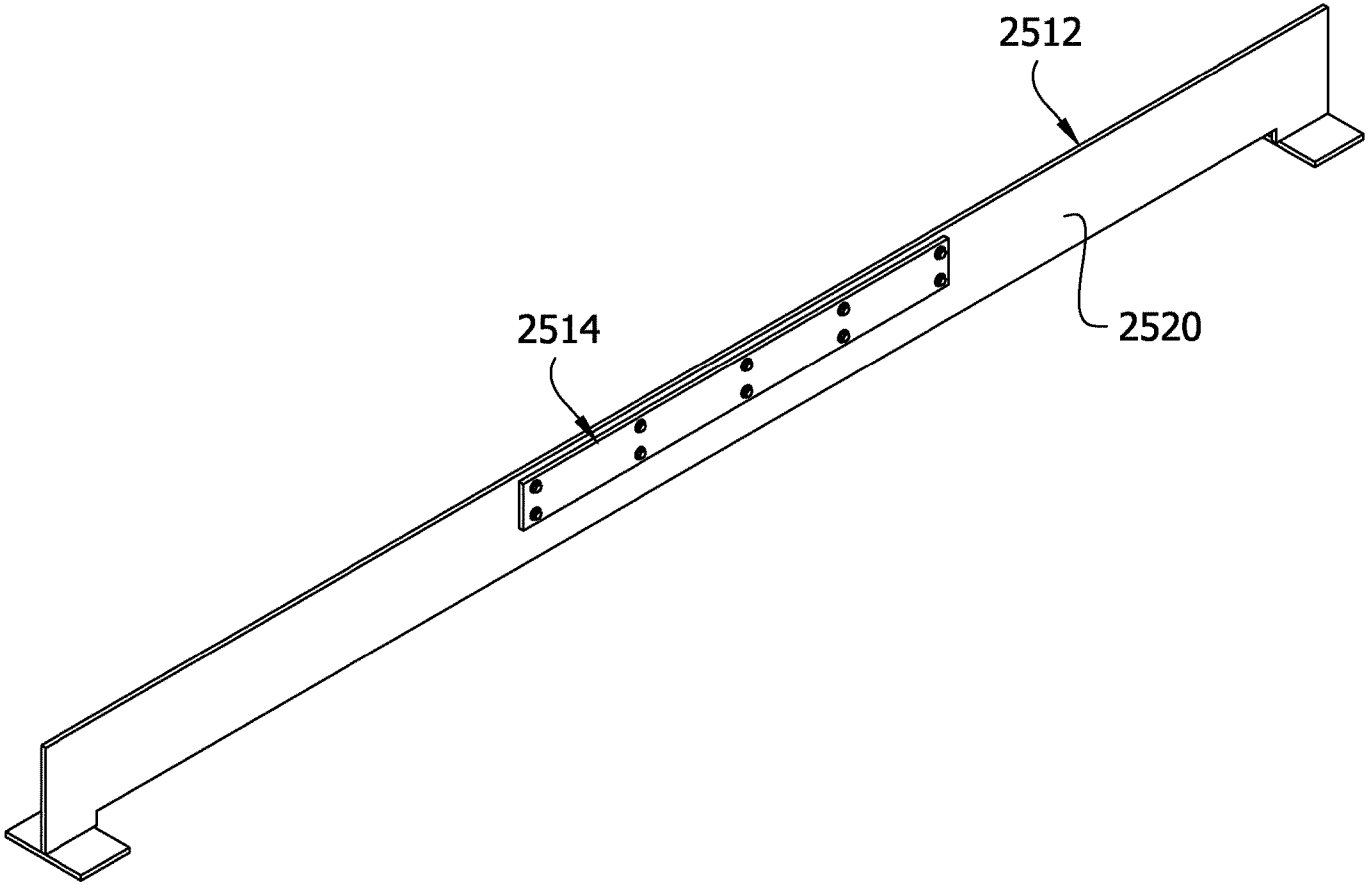
FIG. 48 is a perspective of a lintel of a lintel system of another embodiment.
Figure 49:
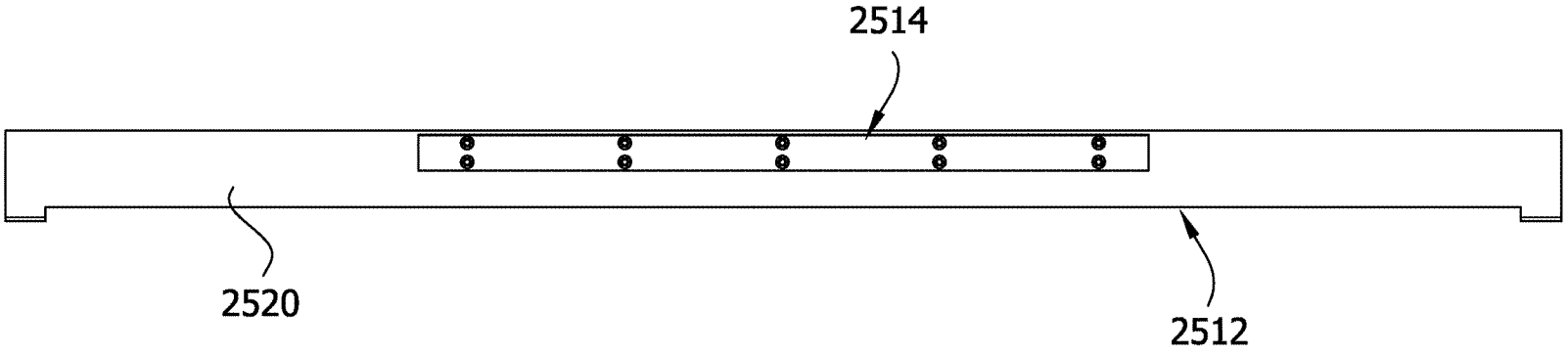
FIG. 49 is a front elevation of the lintel of FIG. 48.

The stiffener 2414 comprises a straight member disposed on a front side face of the rectangular-shaped spanning member 2420 2412. The stiffener 2414 extends partially along the rectangular-shaped spanning member 2420. In one embodiment, the stiffener 2414 extends down from adjacent a top edge less than half of a height of the front side face of the rectangular-shaped spanning member 2420. In one embodiment, the stiffener 2414 extends over less than about 60% of a length of the rectangular-shaped spanning member 2420. In another embodiment, the stiffener 2414 extends over less than about 50% of the length of the rectangular-shaped spanning member 2420. In the illustrated embodiment, the stiffener 2414 is welded to the lintel 2112. However other ways of attaching the stiffener to the lintel are envisioned. For example, as shown in FIGS. 48 and 49, a lintel 2512, substantially identical to lintel 2412, comprises a stiffener 2514 bolted to rectangular shaped portion 2520.

Figure 50:
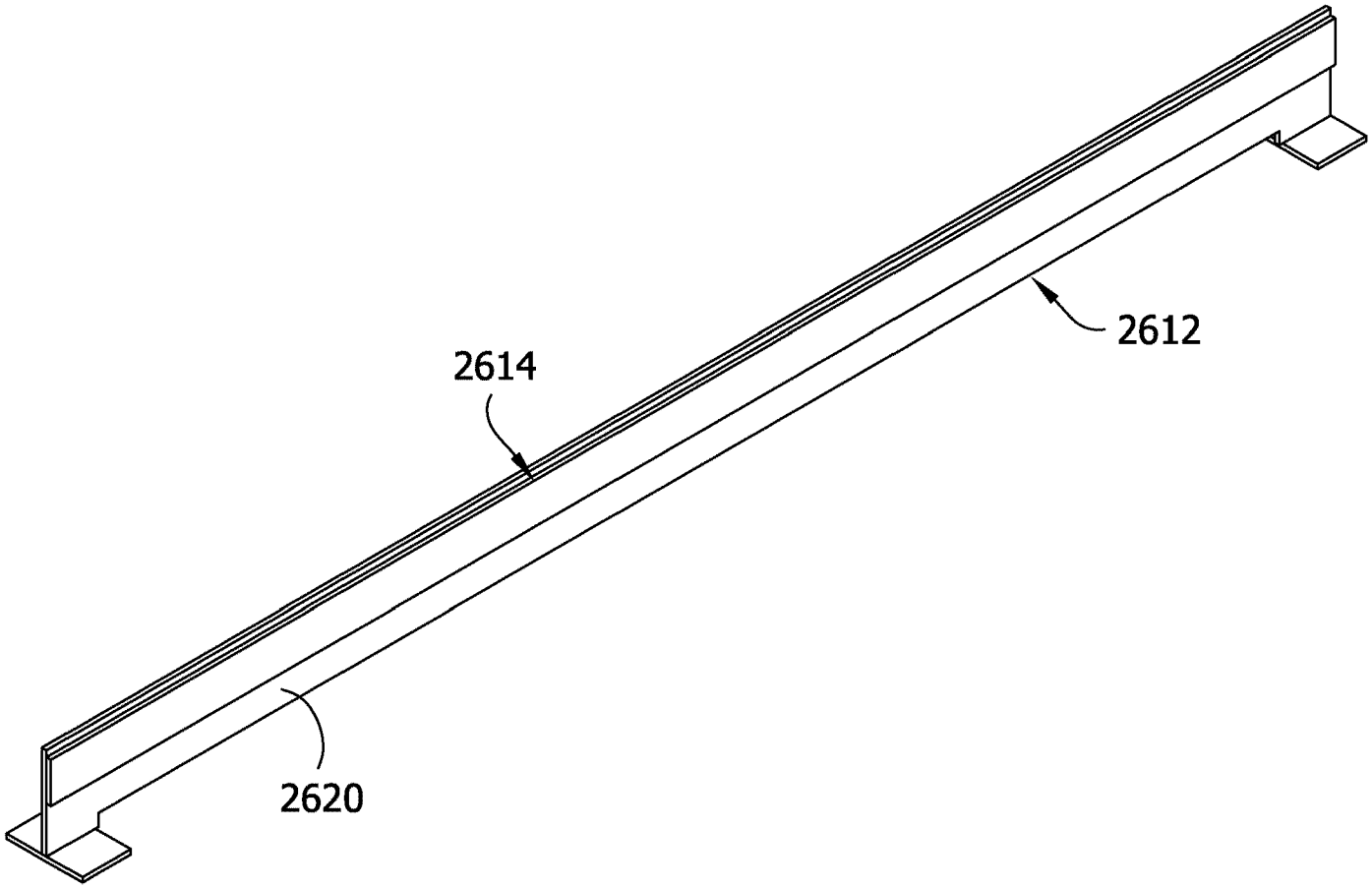
FIG. 50 is a perspective of a lintel of a lintel system of another embodiment.
Figure 51:
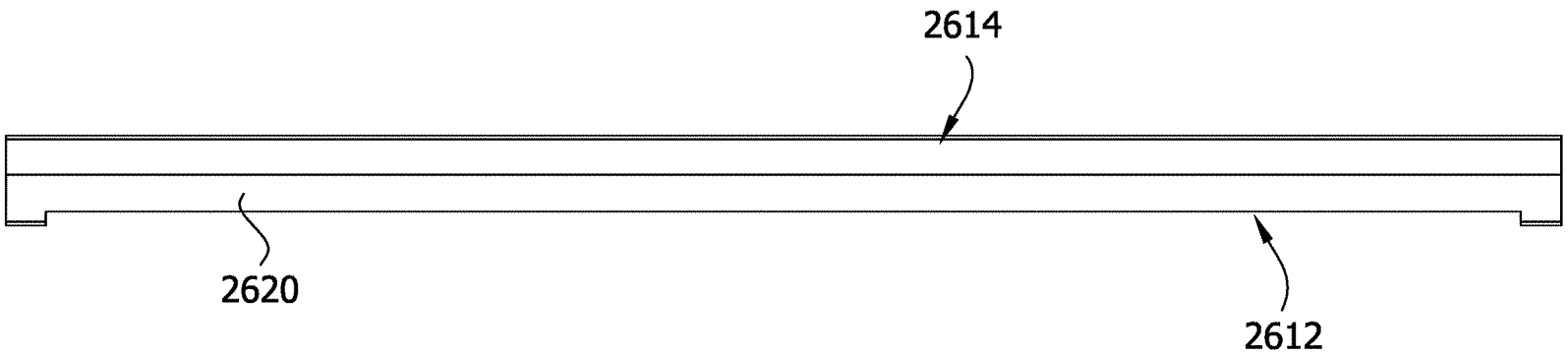
FIG. 51 is a front elevation of the lintel of FIG. 50.
Figure 52:
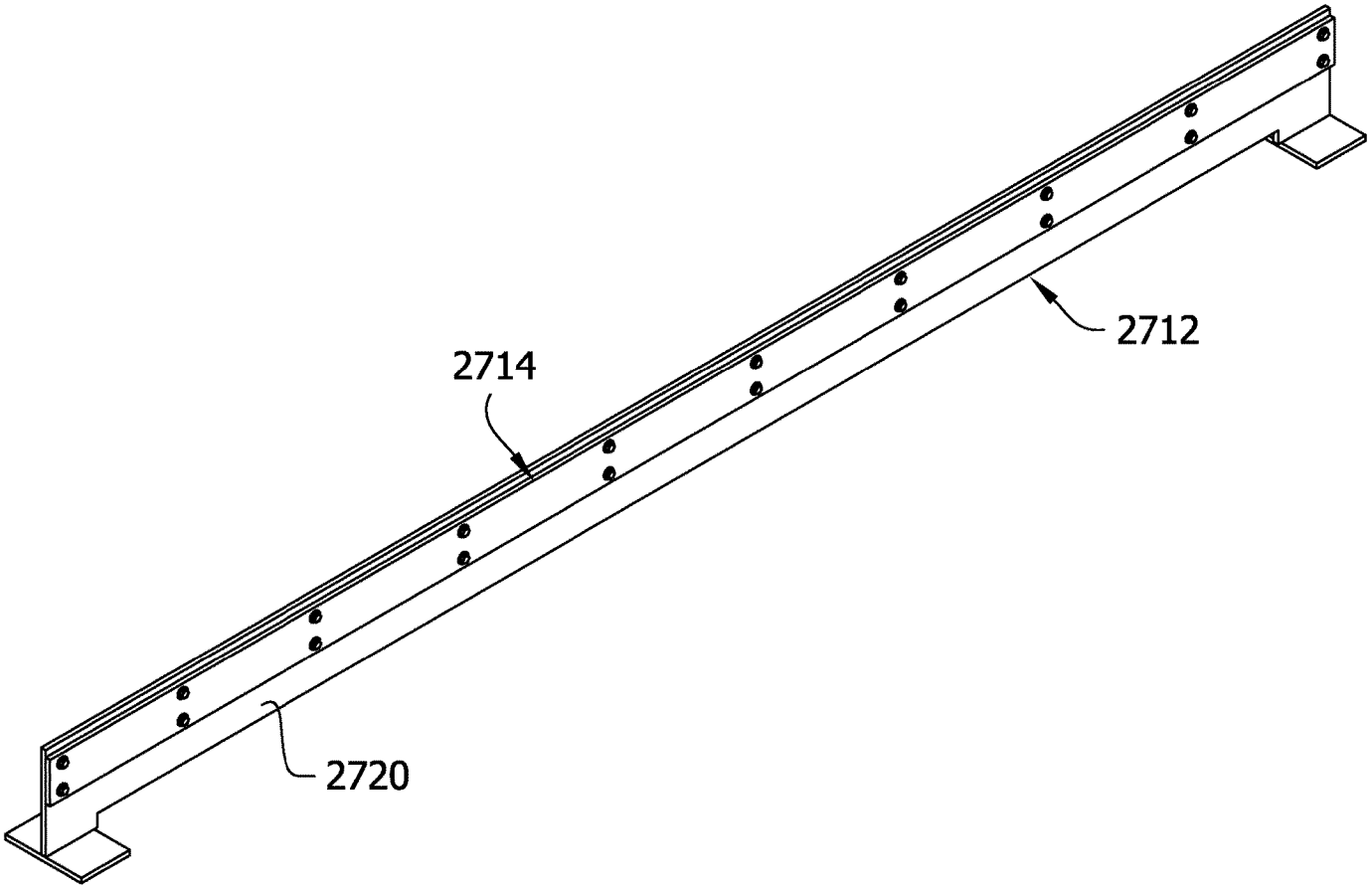
FIG. 52 is a perspective of a lintel of another embodiment.
Figure 53:
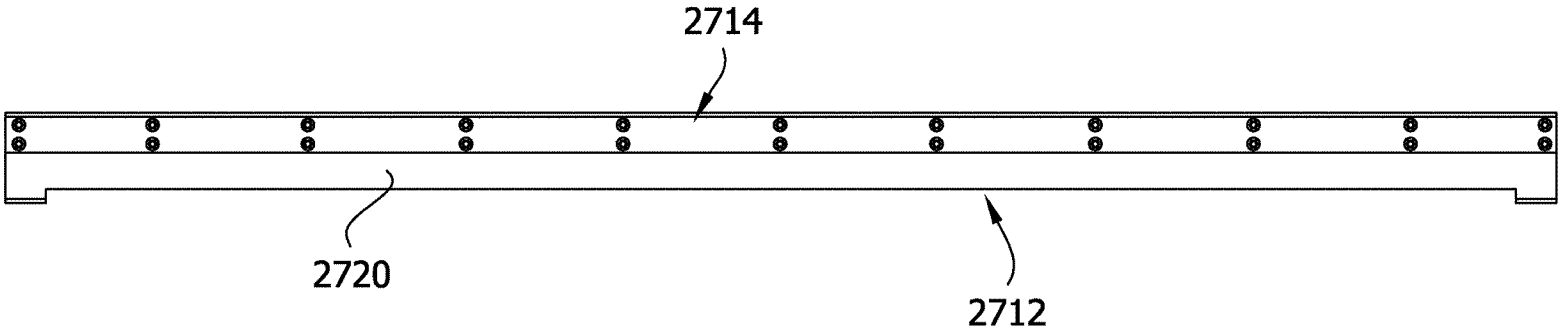
FIG. 53 is a front elevation of the lintel of FIG. 52.

Referring to FIGS. 50 and 51, a lintel 2612 includes a stiffener 2614 attached to rectangular-shaped spanning member 2620. The lintel 2612 is substantially similar to the lintel 2412 except stiffener 2614 extends substantially along an entire length of the rectangular-shaped spanning member 2620. In one embodiment, the stiffener 2614 extends over at least about 80% of a length of the rectangular-shaped spanning member 2620. In another embodiment, the stiffener 2614 extends over at least about 90% of the length of the rectangular-shaped spanning member 2620. In another embodiment, the stiffener 2614 extends over 100% of the length of the rectangular-shaped spanning member 2620. In the illustrated embodiment, the stiffener 2614 is welded to the rectangular-shaped spanning member 2620. However other ways of attaching the stiffener to the rectangular-shaped spanning member are envisioned. For example, as shown in FIGS. 52 and 53, a lintel 2712, substantially identical to lintel 2612, comprises a stiffener 2714 bolted to rectangular-shaped spanning member 2720.

Figure 54:
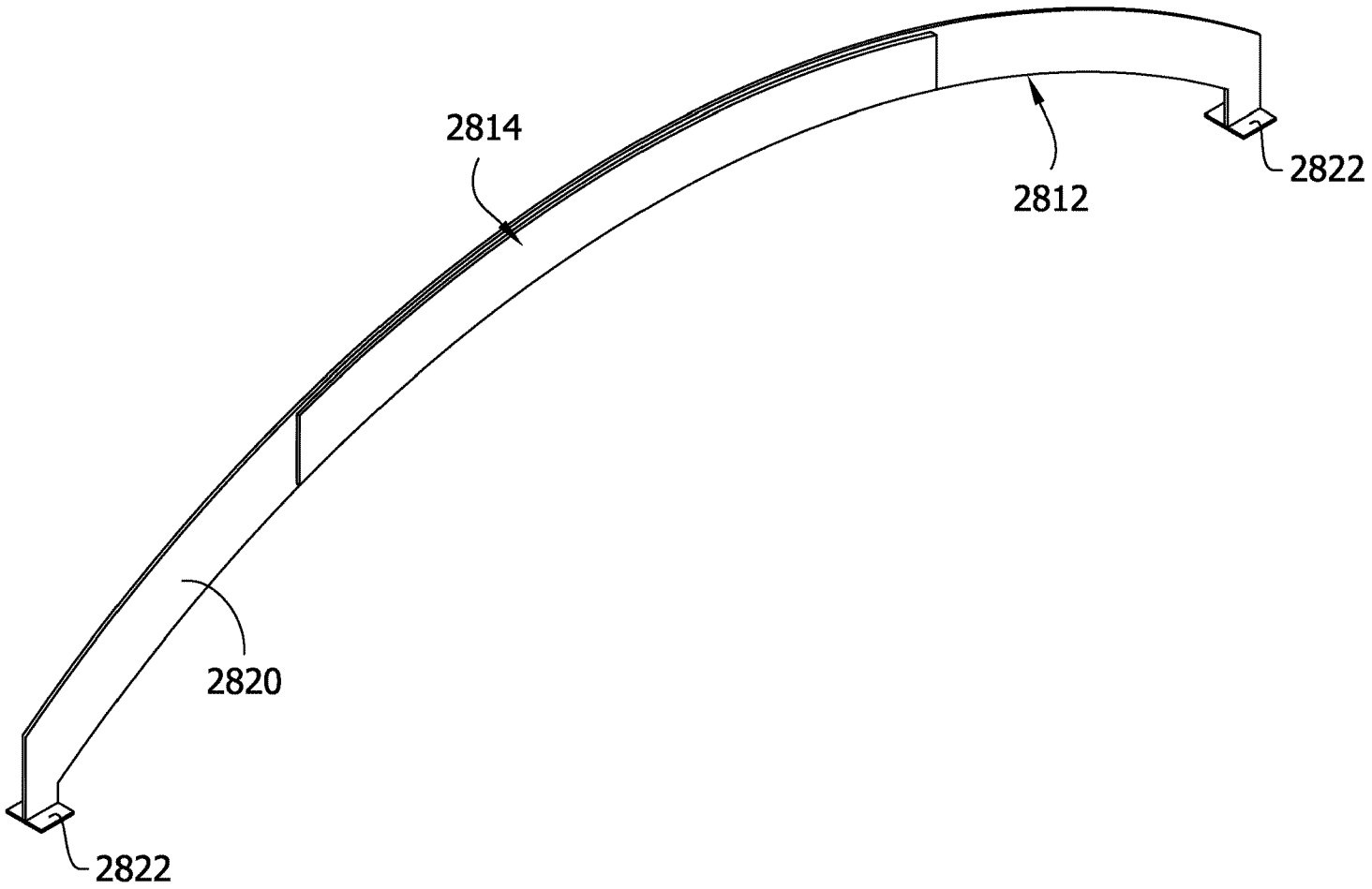
FIG. 54 is a perspective of a lintel of a lintel system of another embodiment.
Figure 55:
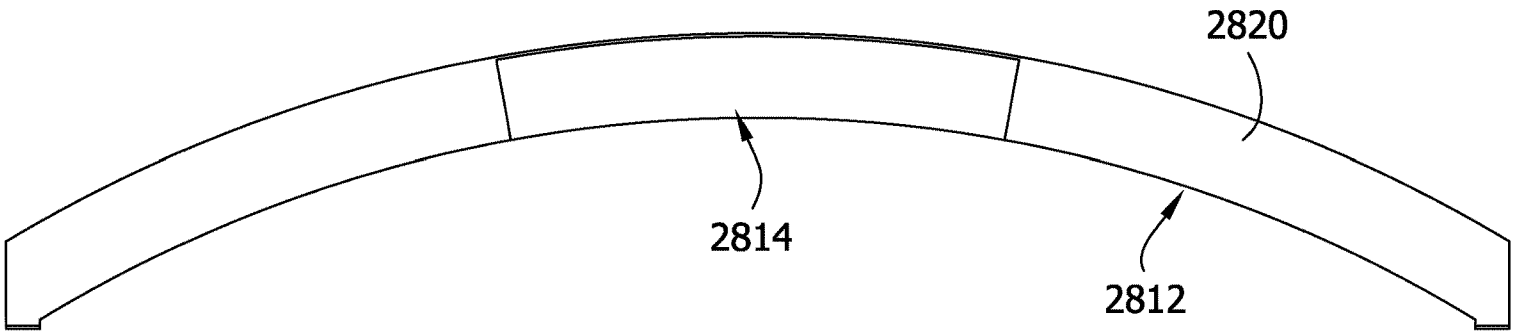
FIG. 55 is a front elevation of the lintel of FIG. 54.
Figure 55A:
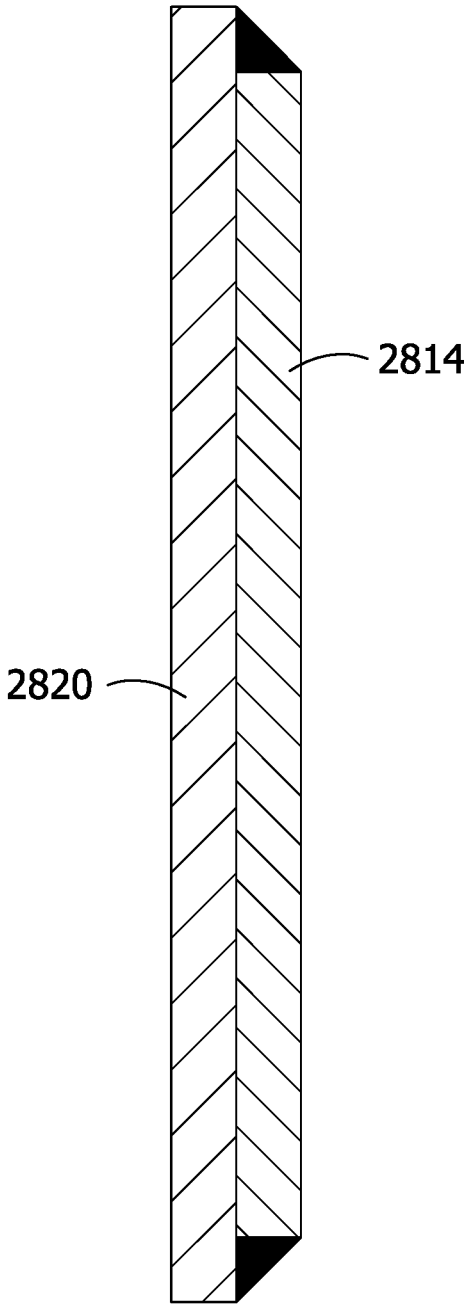
FIG. 55A is a cross section of the lintel of FIG. 54.

Referring to FIGS. 54-55A, a lintel 2812 comprises a stiffener 2814 attached to an arch-shaped spanning member 2820. The lintel 2812 further comprises base members 2822 disposed at longitudinal ends of the arch-shaped spanning member 2820. The base members 2822 extend laterally from the arch-shaped spanning member 2820.

Figure 56:
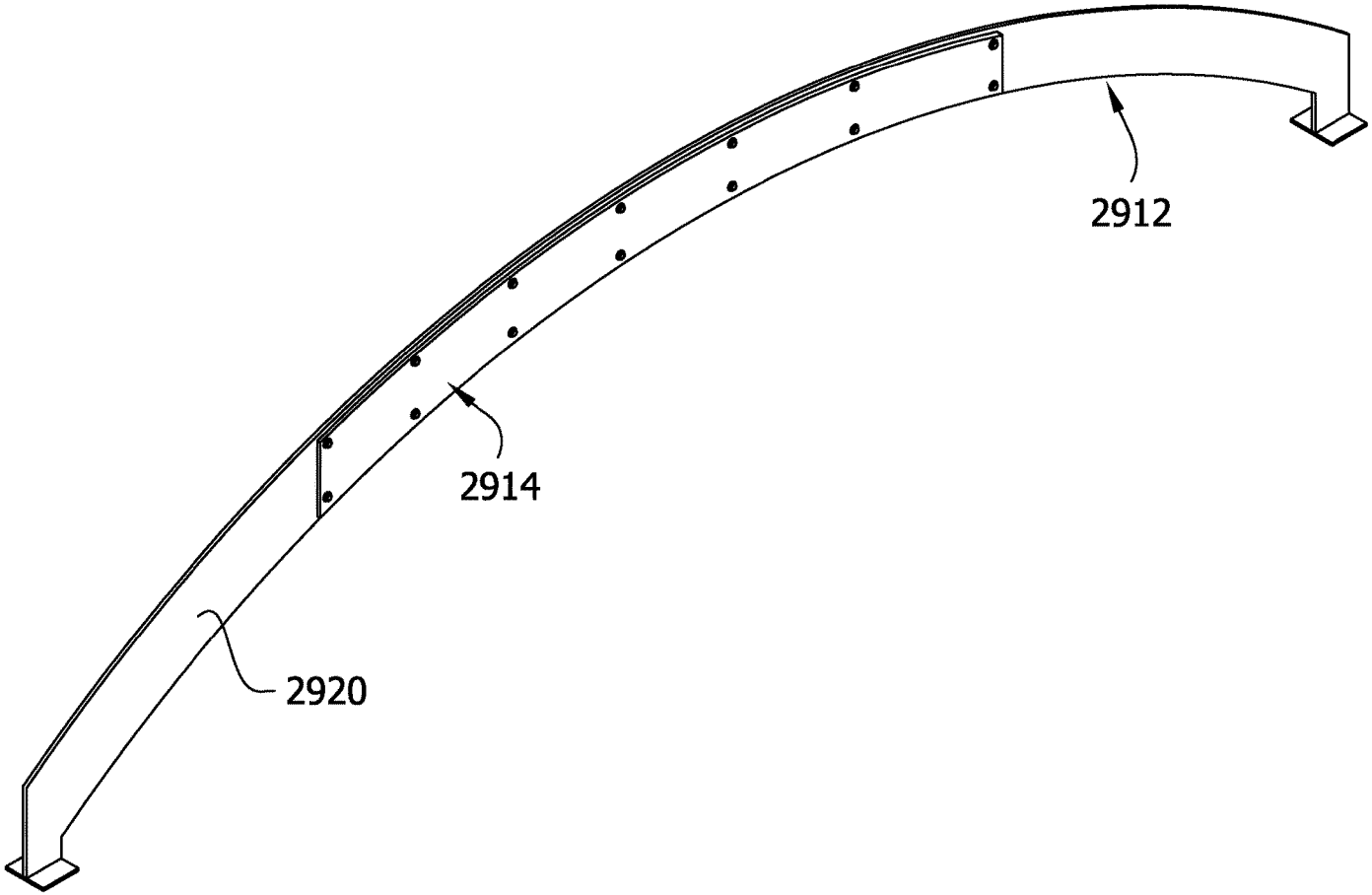
FIG. 56 is a perspective of a lintel of a lintel system of another embodiment.
Figure 57:
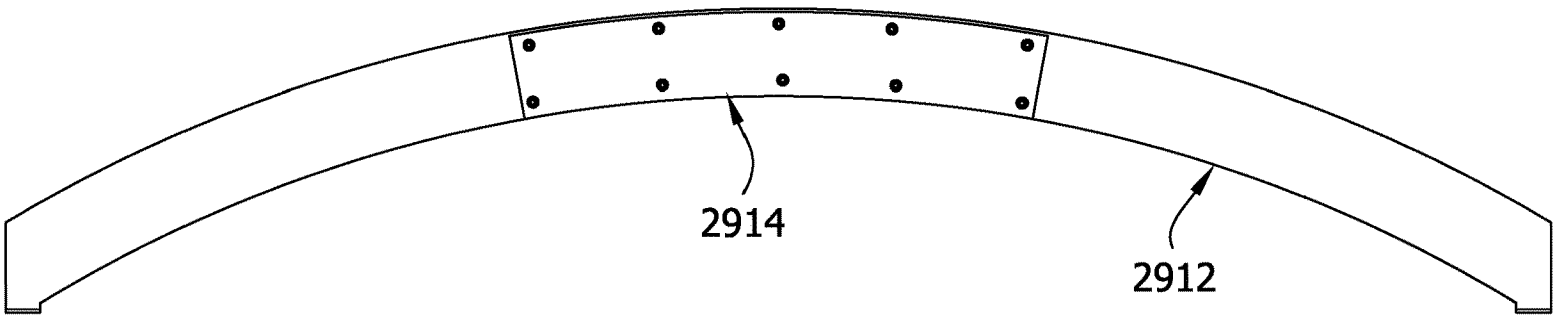
FIG. 57 is a front elevation of the lintel of FIG. 56.
Figure 57A:
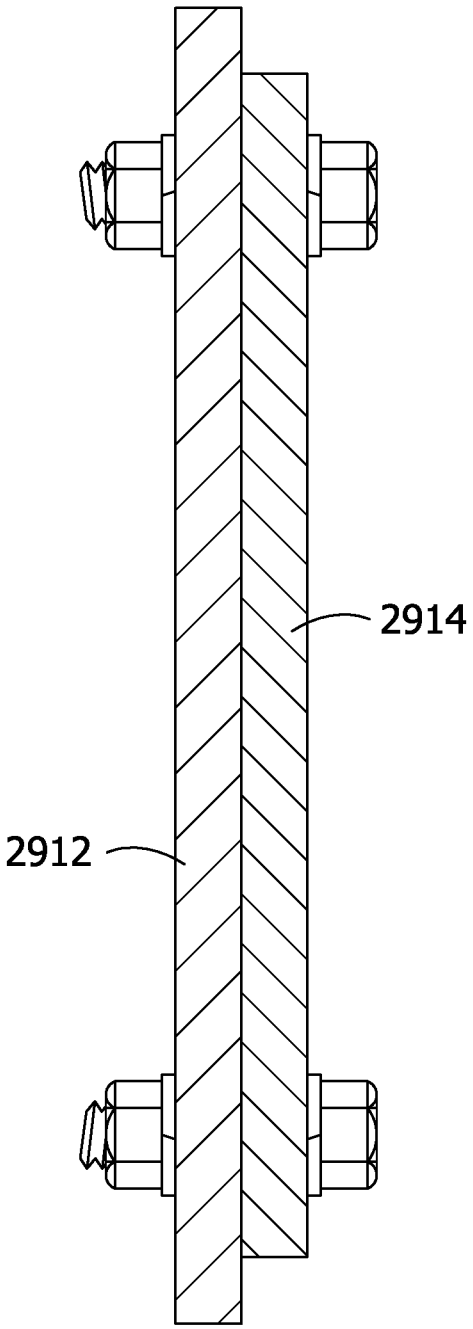
FIG. 57A is a cross section of the lintel of FIG. 56.

The stiffener 2814 comprises a curved rectangular-shaped spanning member disposed on a front side face of the lintel 2812. The stiffener 2814 extends partially along the arch-shaped spanning member 2820. In one embodiment, the stiffener 2814 extends down from adjacent a top edge of the arch-shaped spanning member 2820 to adjacent a bottom edge of the arch-shaped spanning member. In one embodiment, the stiffener 2814 extends over less than about 60% of a length of the arch-shaped spanning member 2820. In another embodiment, the stiffener 2814 extends over less than about 50% of the length of the arch-shaped spanning member 2820. In the illustrated embodiment, the stiffener 2814 is welded to the lintel 2812. However other ways of attaching the stiffener to the lintel are envisioned. For example, as shown in FIGS. 56-57A, a lintel 2912, substantially identical to lintel 2812, comprises a stiffener 2914 bolted to arch-shaped spanning member 2920.

Figure 58:
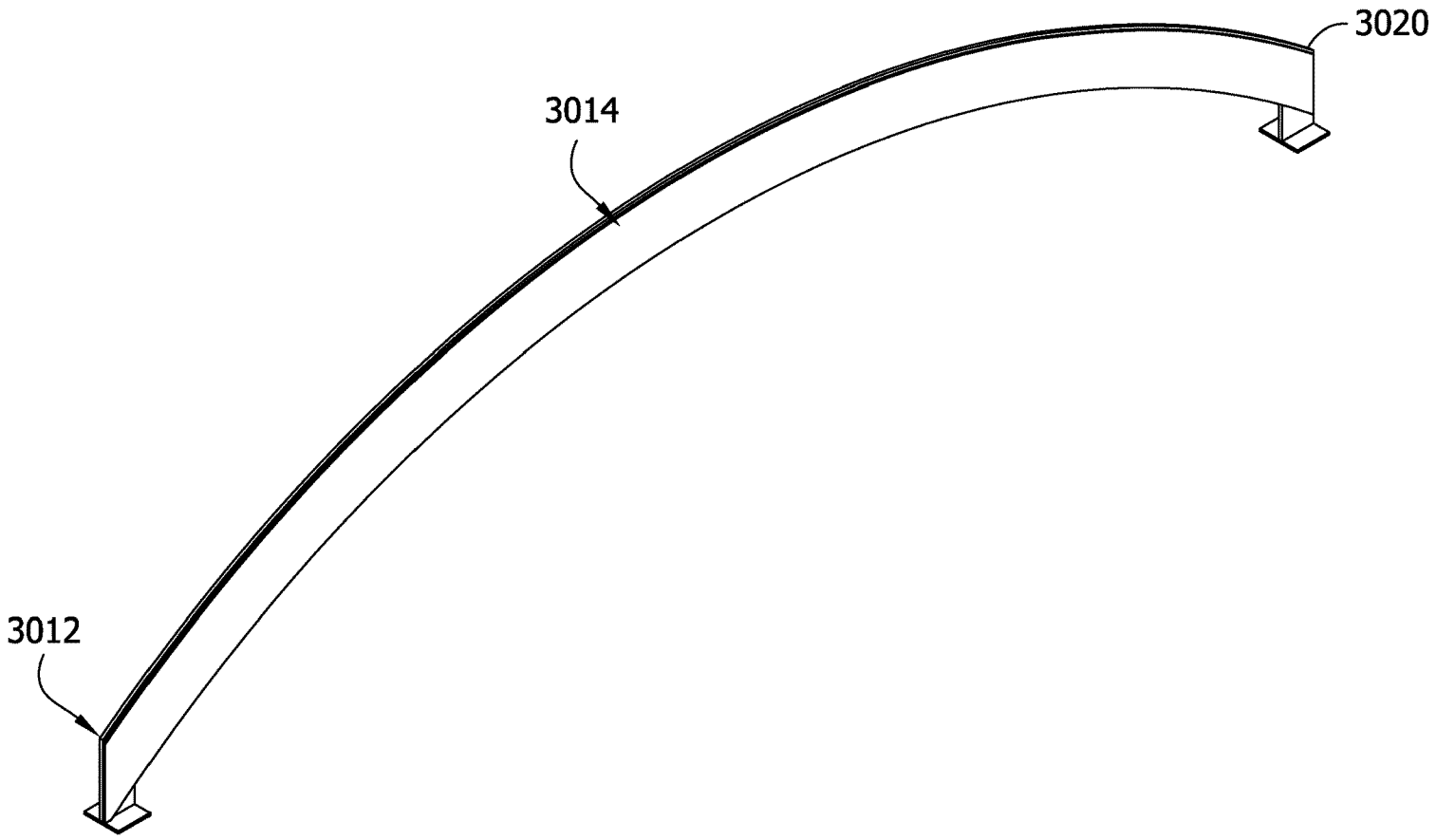
FIG. 58 is a perspective of a system of another embodiment.
Figure 59:
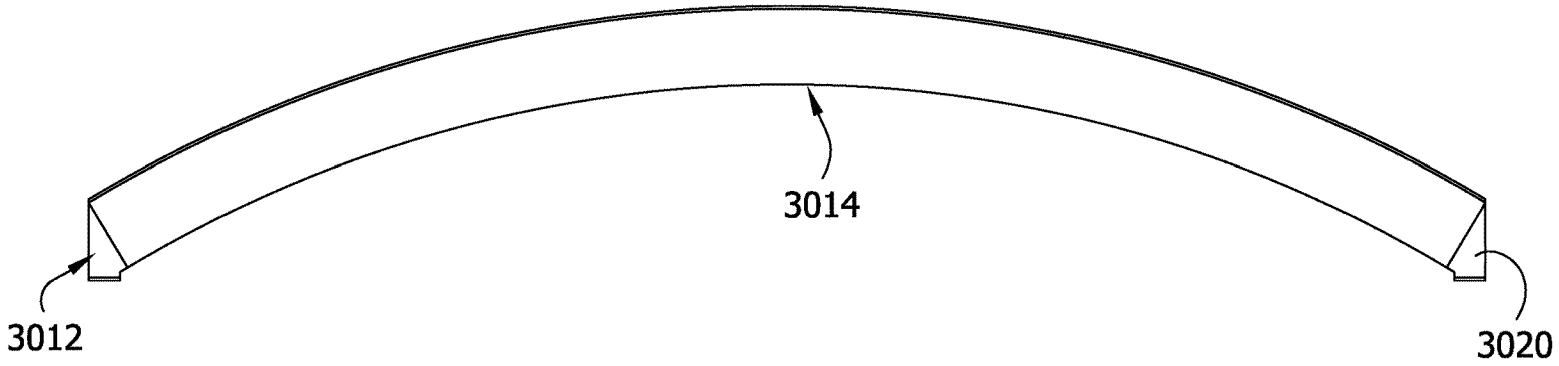
FIG. 59 is a front elevation of the lintel of FIG. 58.
Figure 60:
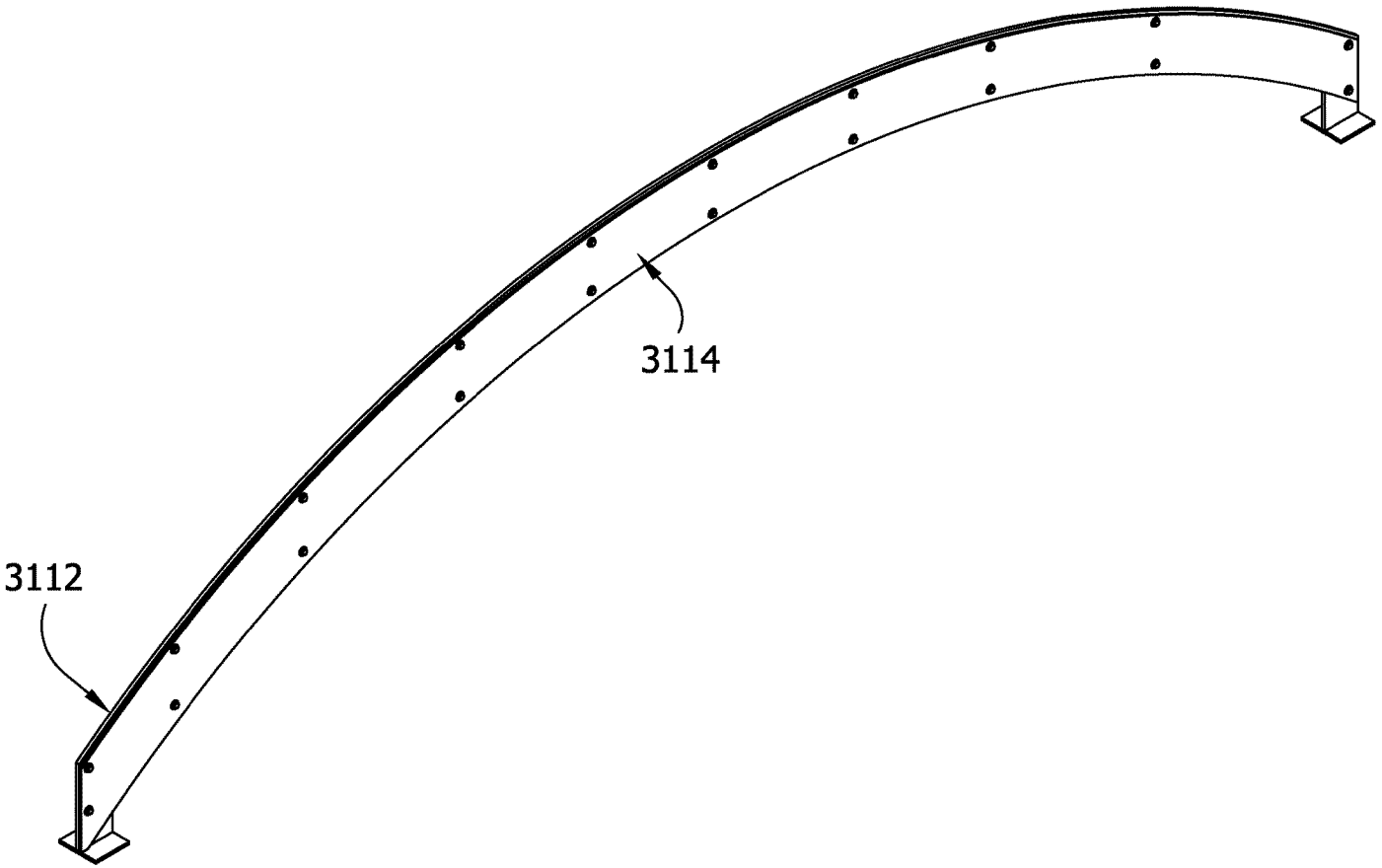
FIG. 60 is a perspective of a lintel of a lintel system of another embodiment.
Figure 61:
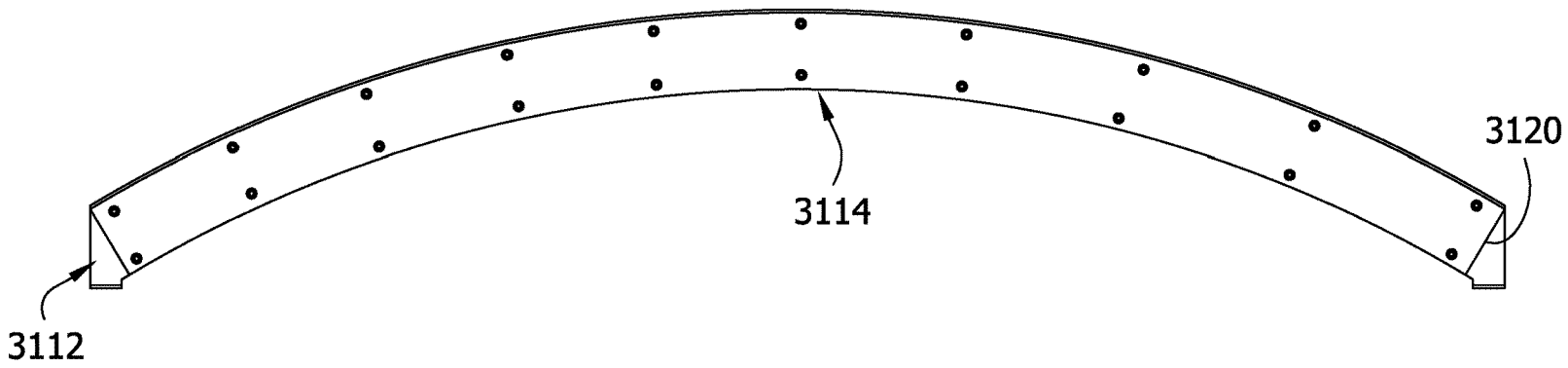
FIG. 61 is a front elevation of the lintel of FIG. 60.

Referring to FIGS. 58 and 59, a lintel 3012 includes a stiffener 3014 attached to arch-shaped spanning member 3020. The lintel 3012 is substantially similar to the lintel 2812 except stiffener 3014 extends substantially along an entire length of the arch-shaped spanning member 3020 of the lintel 3012. In one embodiment, the stiffener 3014 extends over at least about 80% of a length of the arch-shaped spanning member 3020. In another embodiment, the stiffener 3014 extends over at least about 90% of the length of the arch-shaped spanning member 3020. In another embodiment, the stiffener 3014 extends over 100% of the length of the arch-shaped spanning member 3020. In the illustrated embodiment, the stiffener 3014 is welded to the lintel 3012. However other ways of attaching the stiffener to the lintel are envisioned. For example, as shown in FIGS. 60 and 61, a lintel 3112, substantially identical to lintel 3012, comprises a stiffener 3114 bolted to arch-shaped spanning member 3120.

Figure 62:
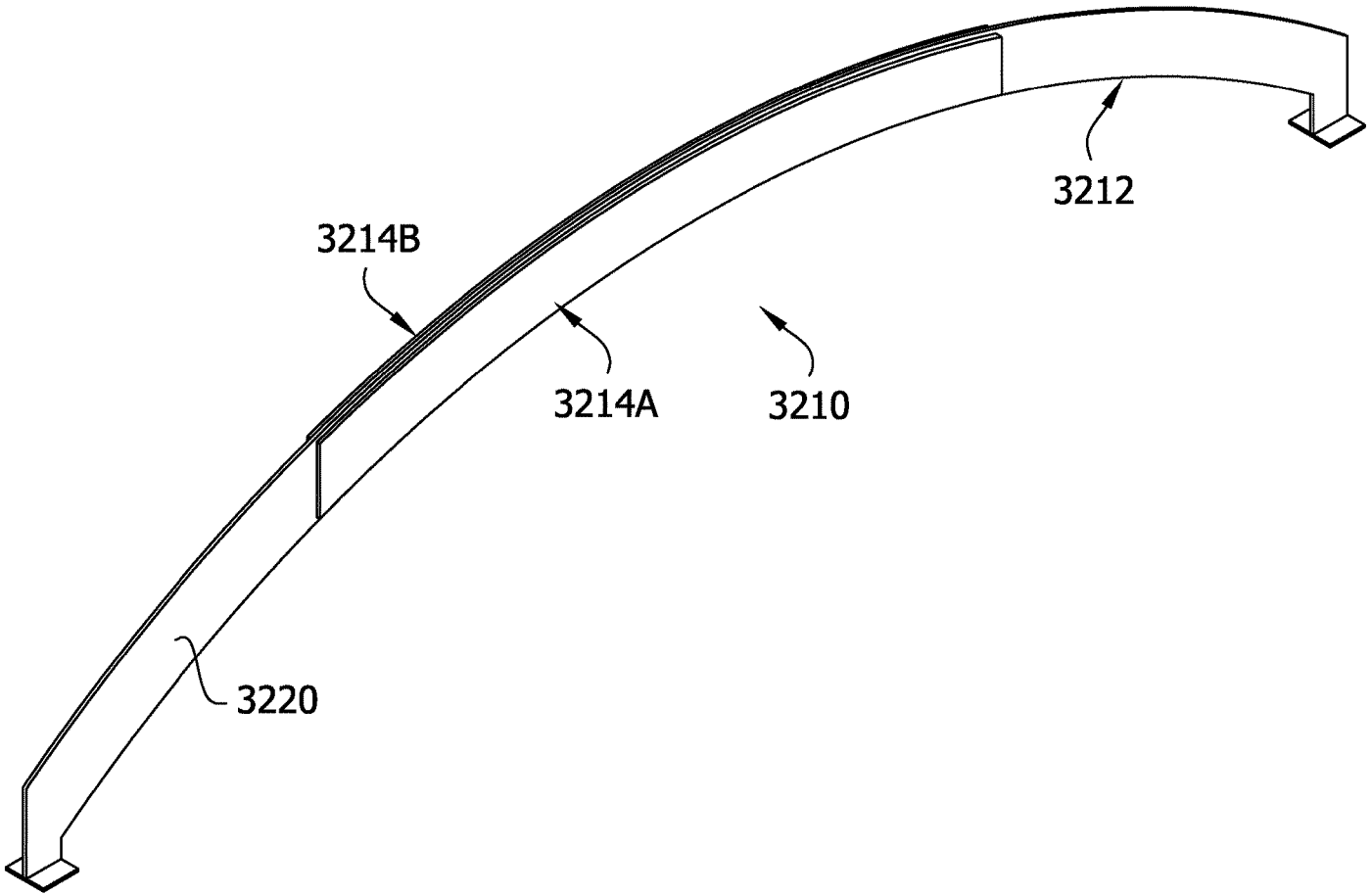
FIG. 62 is a perspective of a lintel of a lintel system of another embodiment.
Figure 62A:
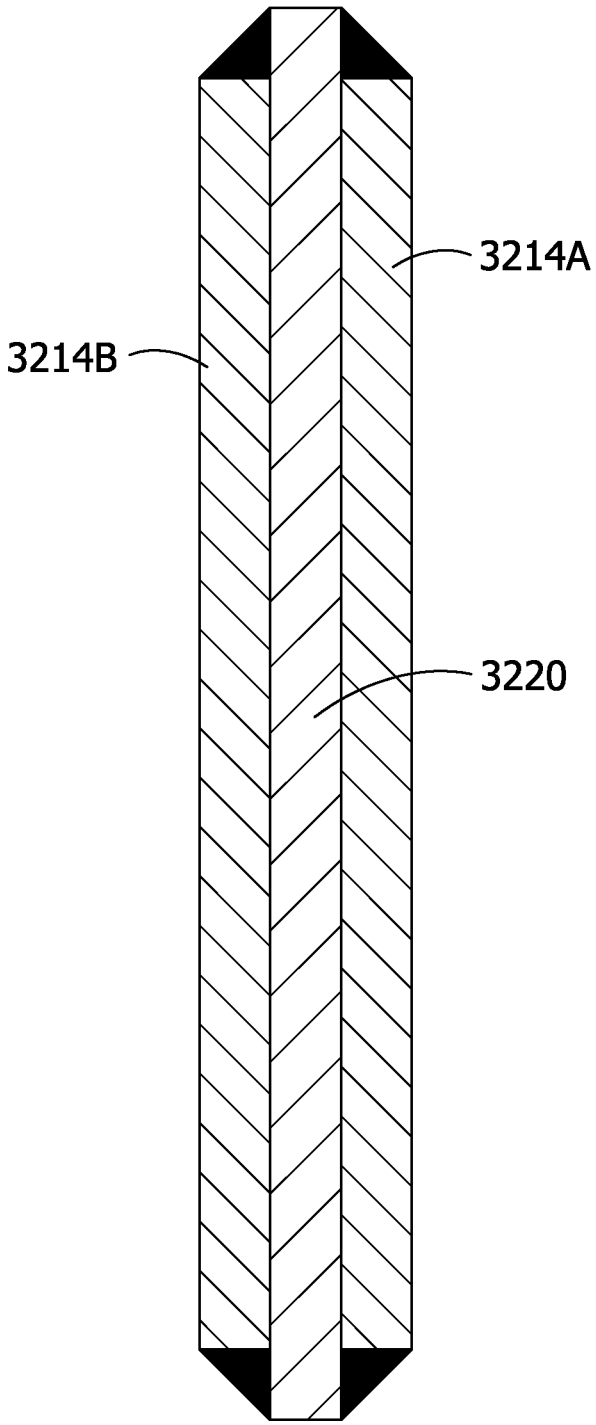
FIG. 62A is a cross section of the lintel of FIG. 62.
Figure 63:
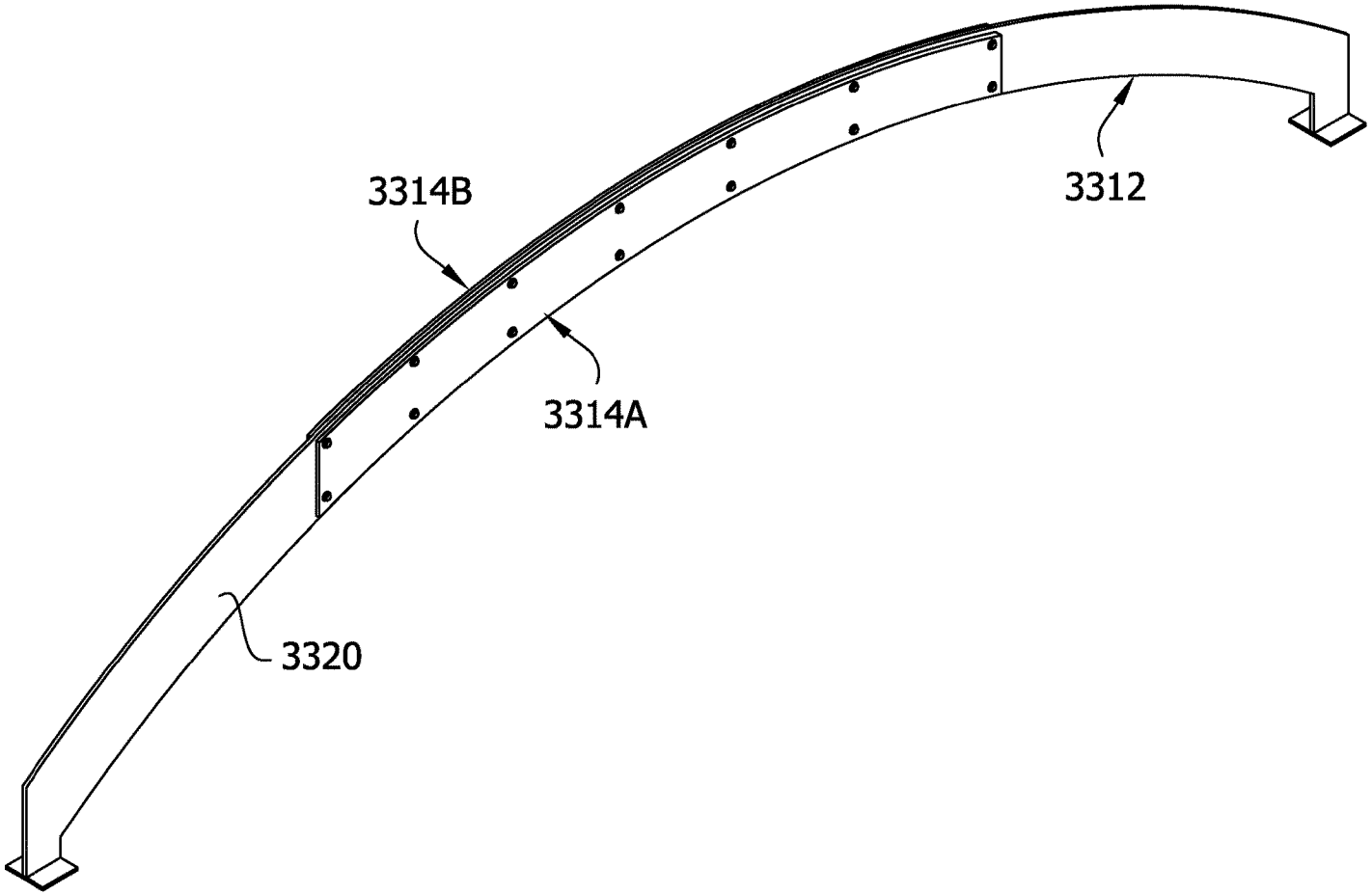
FIG. 63 is a perspective of a lintel of a lintel system of another embodiment.
Figure 63A:
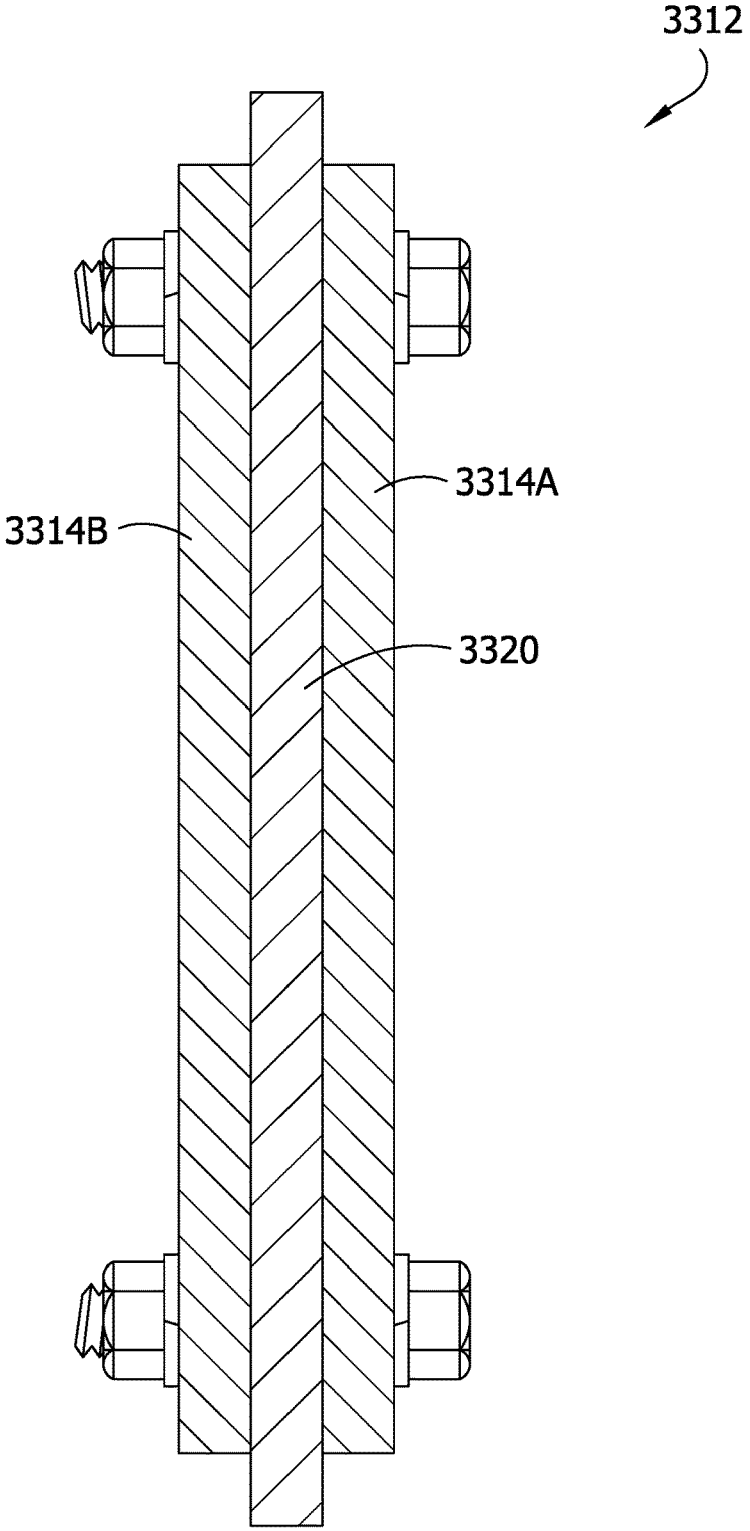
FIG. 63A is a cross section of the lintel of FIG. 63.

Referring to FIGS. 62 and 62A, a lintel 3212 comprises a pair of stiffeners 3214A, 3241B attached to arch-shaped spanning member 3220. The lintel 3212 is substantially similar to the lintel 2812 except an additional stiffener 3214B extends substantially along an opposite rear side face of arch-shaped spanning member 3220. In one embodiment, the stiffeners 3214A, 3214B extend over less than about 60% of a length of the arch-shaped spanning member 3220. In another embodiment, the stiffeners 3214A, 3214B extend over less than about 50% of the length of the arch-shaped spanning member 3220. In the illustrated embodiment, the stiffeners 3214A, 3214B are welded to the arch-shaped spanning member 3220. However other ways of attaching the stiffeners to the arch-shaped spanning member are envisioned. For example, as shown in FIGS. 63 and 63A, a lintel 3312, substantially identical to lintel 3212, comprises stiffeners 3314A, 3314B bolted to arch-shaped spanning member 320.

Figure 64:
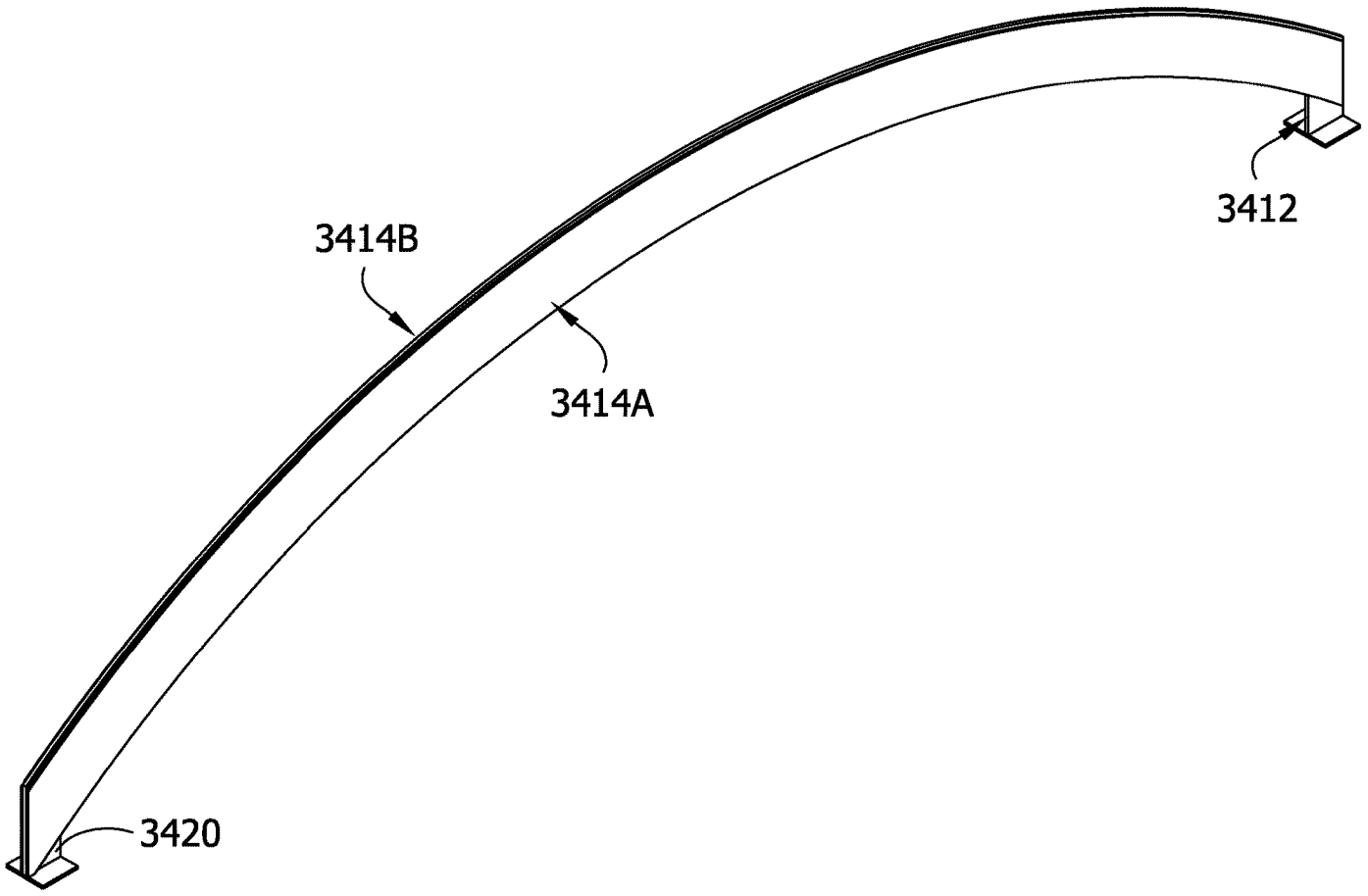
FIG. 64 is a perspective of a lintel of a lintel system of another embodiment.
Figure 65:
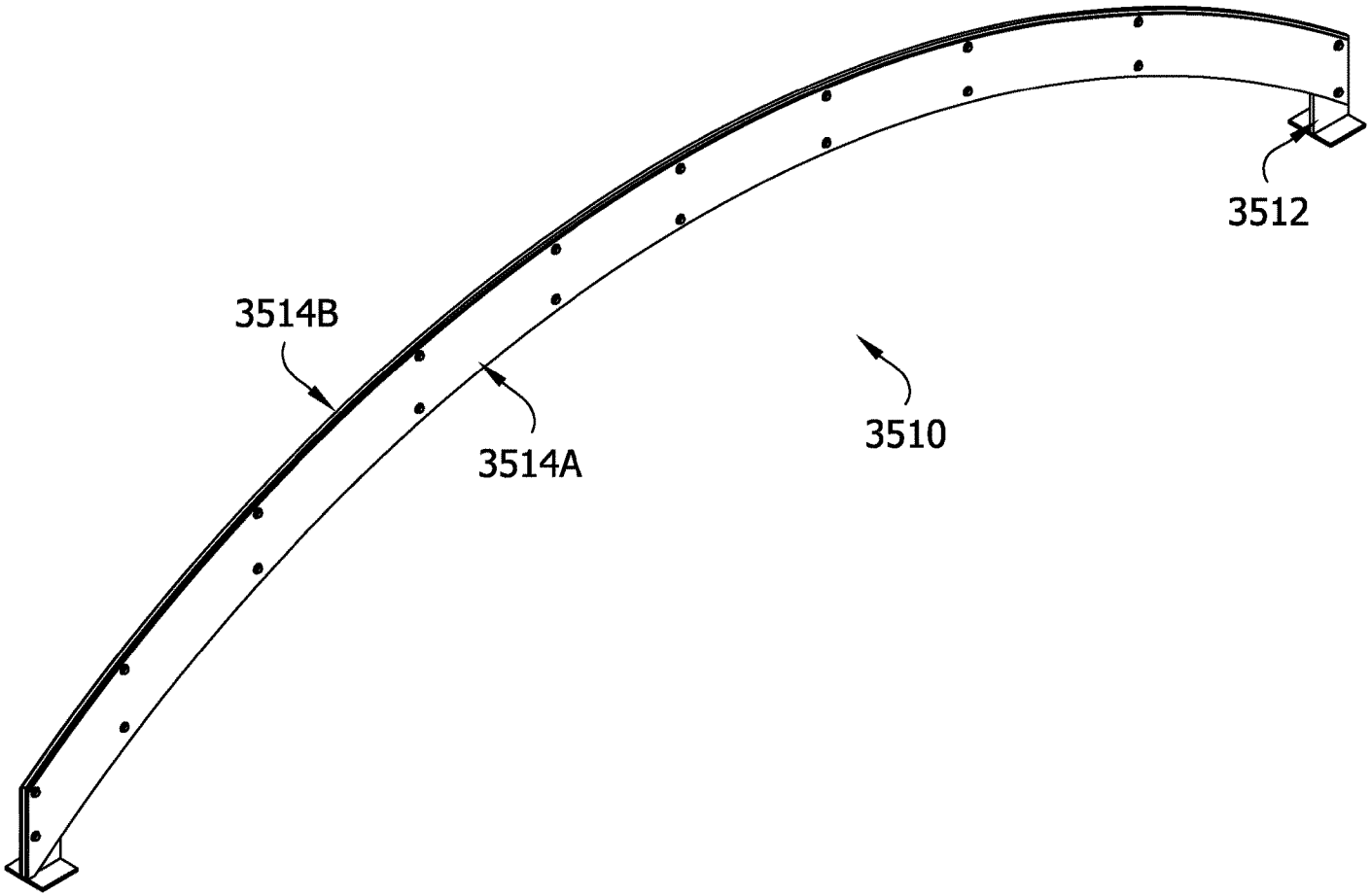
FIG. 65 is a perspective of a lintel of a lintel system of another embodiment.

Referring to FIG. 64, a lintel 3412 comprises stiffeners 3414A, 3414B attached to arch-shaped spanning member 3420. The lintel 3412 is substantially similar to the lintel 3212 except stiffeners 3414A, 3414B extend substantially along an entire length of the arch-shaped spanning member 3420 of the lintel 3412. In one embodiment, the stiffeners 3414A, 3414B extend over at least about 80% of a length of the arch-shaped spanning member 3420. In another embodiment, the stiffeners 3414A, 3414B extend over at least about 90% of the length of the arch-shaped spanning member 3420. In another embodiment, the stiffeners 3414A, 3414B extend over 100% of the length of the arch-shaped spanning member 3420. In the illustrated embodiment, the stiffeners 3414A, 3414B are welded to the lintel 3412. However other ways of attaching the stiffeners to the arch-shaped spanning member 3420 are envisioned. For example, as shown in FIG. 65, a lintel 3512, substantially identical to lintel 3412, comprises stiffeners 3514A, 3514B bolted to arch-shaped spanning member 3520.

Figure 66:
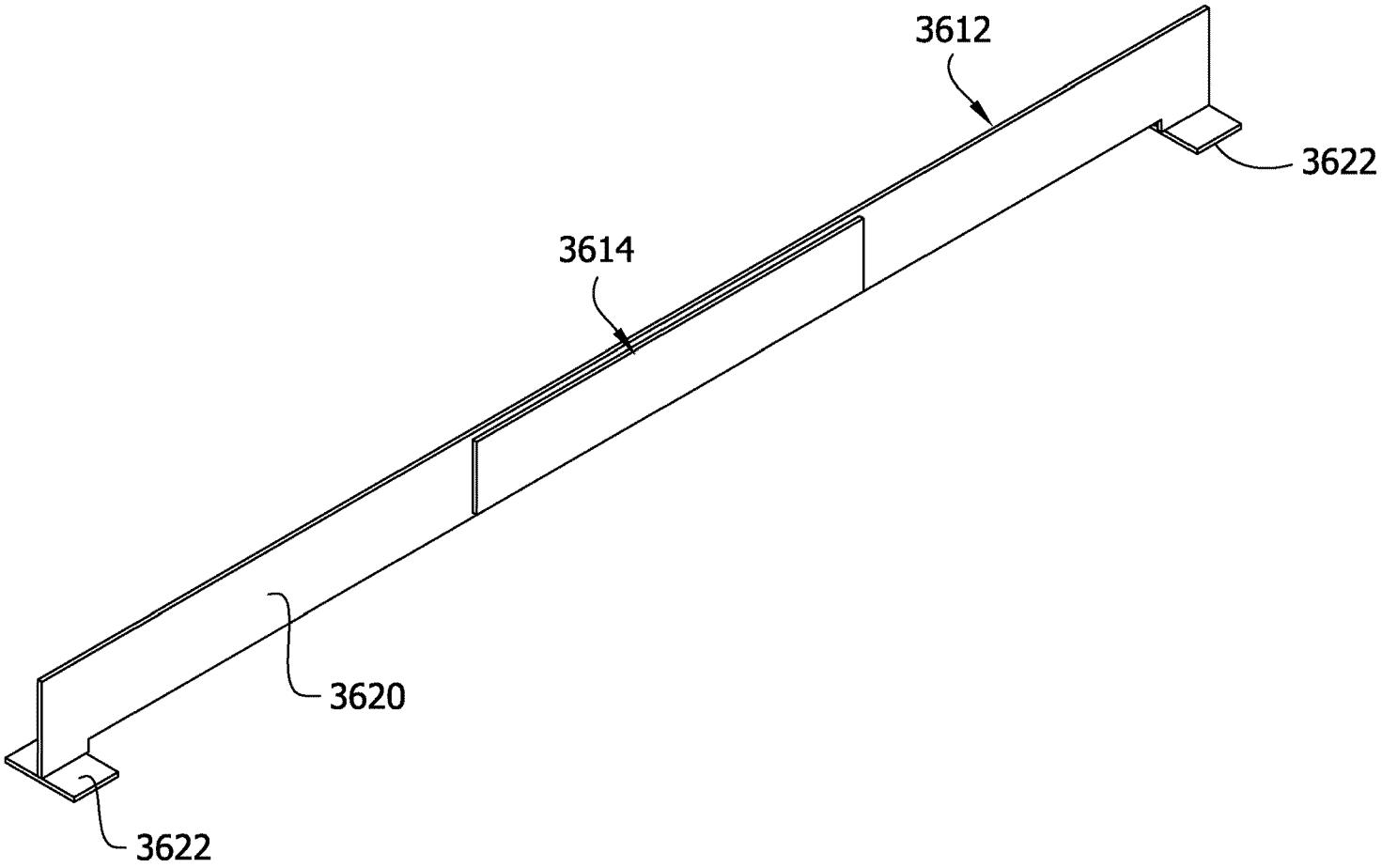
FIG. 66 is a perspective of a lintel of a lintel system of another embodiment.
Figure 67:
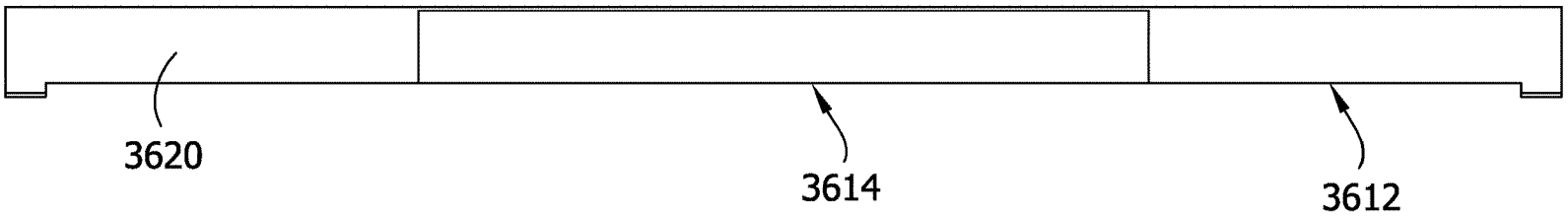
FIG. 67 is a front elevation of the lintel of FIG. 66.

Referring to FIGS. 66 and 67, a lintel 3612 includes a stiffener 3614 attached to rectangular-shaped spanning member 3620. The lintel 3612 further comprises base members 3622 disposed at longitudinal ends of the rectangular-shaped spanning member. The base members 3622 extend laterally from the rectangular-shaped spanning member 3620.

Figure 68:
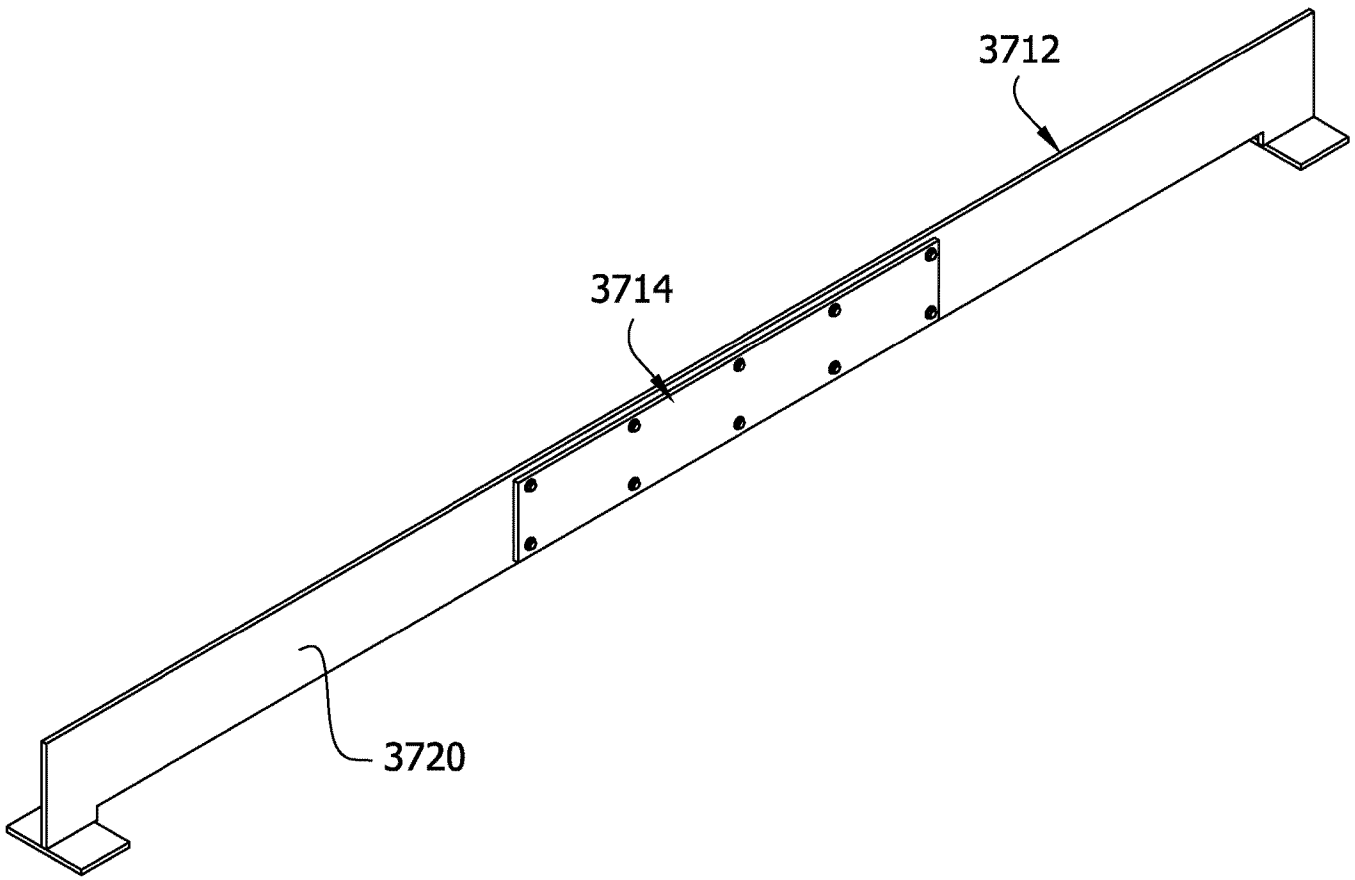
FIG. 68 is a perspective of a lintel of a lintel system of another embodiment.
Figure 69:
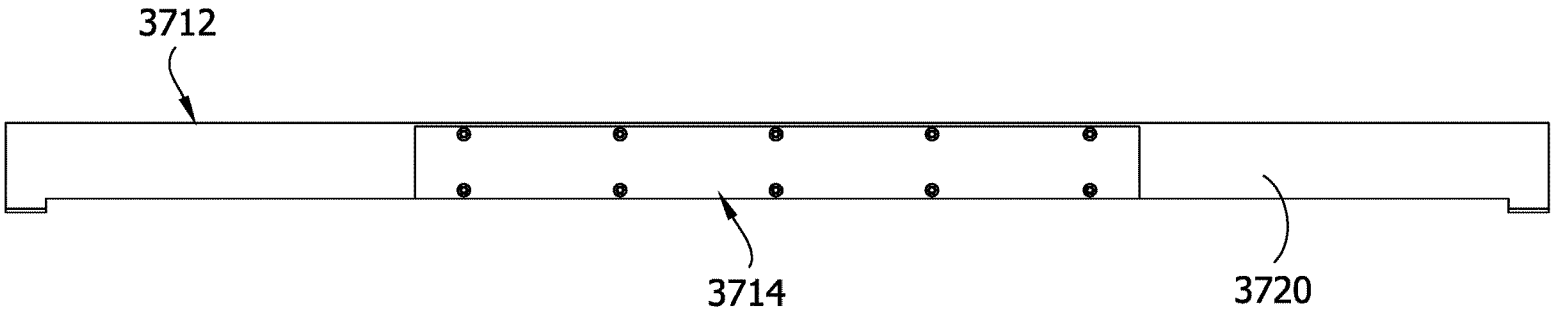
FIG. 69 is a front elevation of the lintel of FIG. 68.

The stiffener 3614 comprises a flat plate disposed on a front side face of the rectangular-shaped spanning member 3620. The stiffener 3614 extends partially along the rectangular-shaped spanning member 3620. In the illustrated embodiment, the stiffener 3614 extends down from adjacent a top edge to adjacent a bottom edge of the rectangular-shaped spanning member 3620. In one embodiment, the stiffener 3614 extends over less than about 60% of a length of the rectangular-shaped spanning member 3620. In another embodiment, the stiffener 3614 extends over less than about 50% of the length of the rectangular-shaped spanning member 3620. In the illustrated embodiment, the stiffener 3614 is welded to the lintel 3612. However other ways of attaching the stiffener to the lintel are envisioned. For example, as shown in FIGS. 68 and 69, a lintel 3712, substantially identical to lintel 3612, comprises a stiffener 3714 bolted to rectangular-shaped spanning member 3720.

Figure 70:
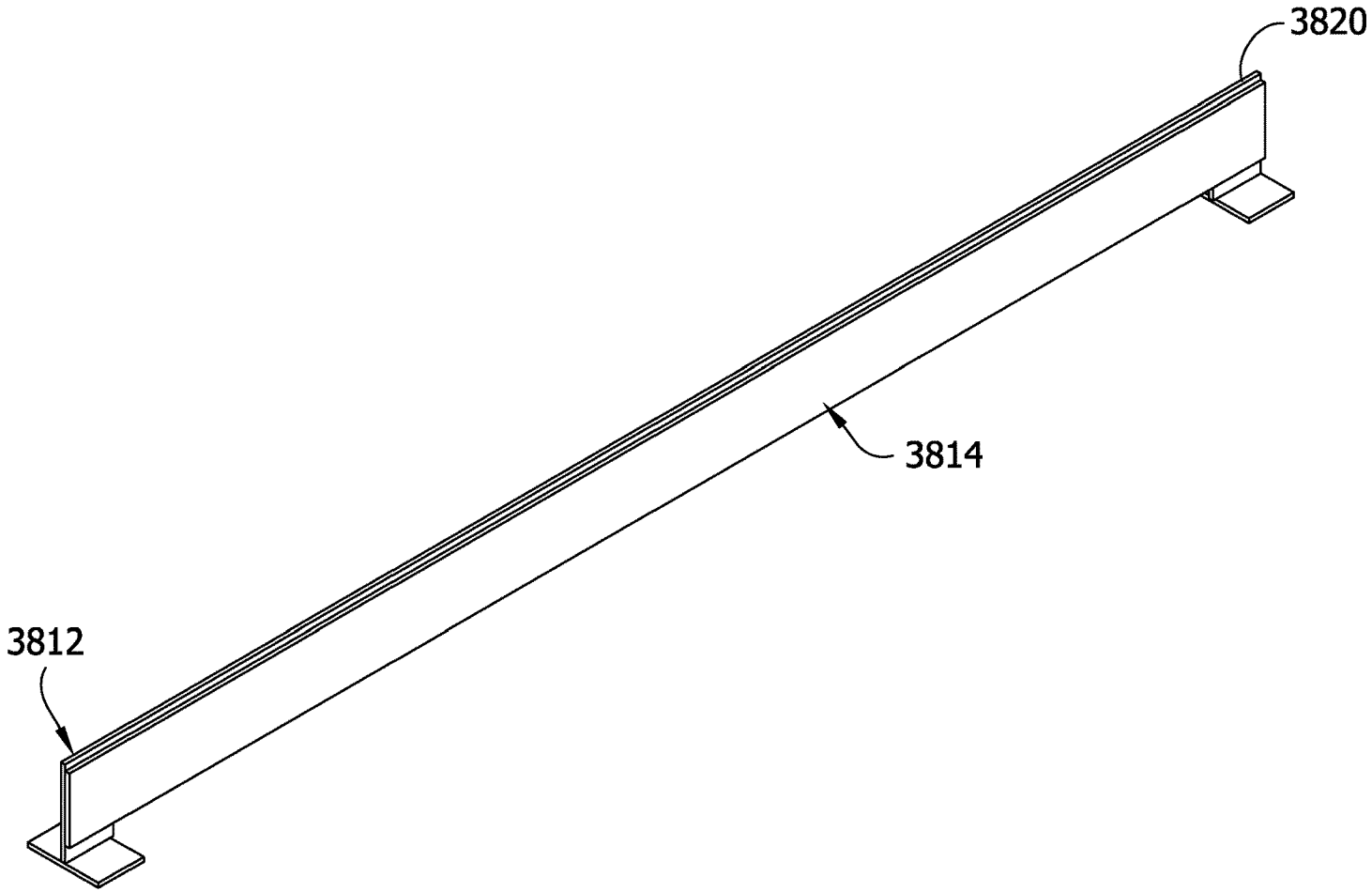
FIG. 70 is a perspective of a lintel of a lintel system of another embodiment.
Figure 71:
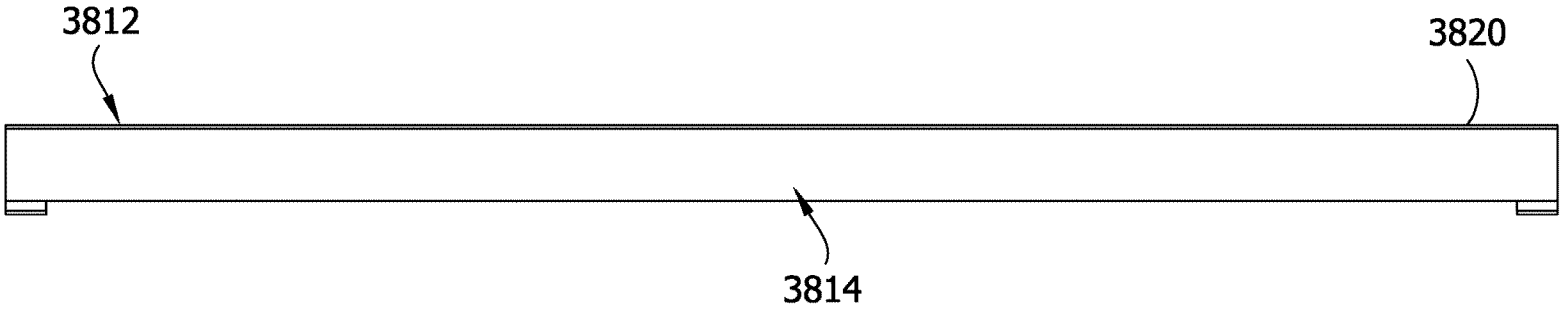
FIG. 71 is a front elevation of the lintel of FIG. 70.
Figure 72:
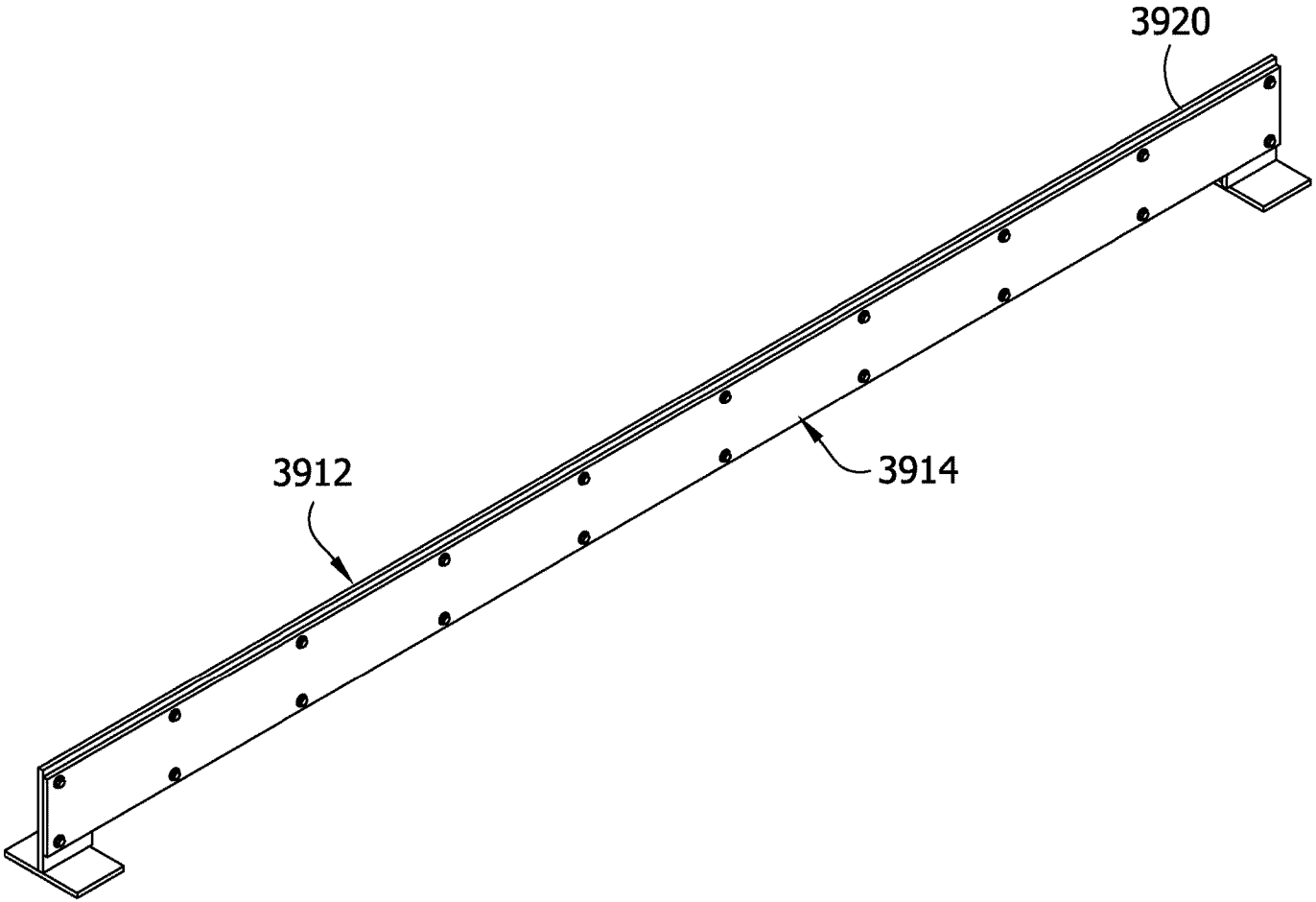
FIG. 72 is a perspective of a lintel of a lintel system of another embodiment.
Figure 73:
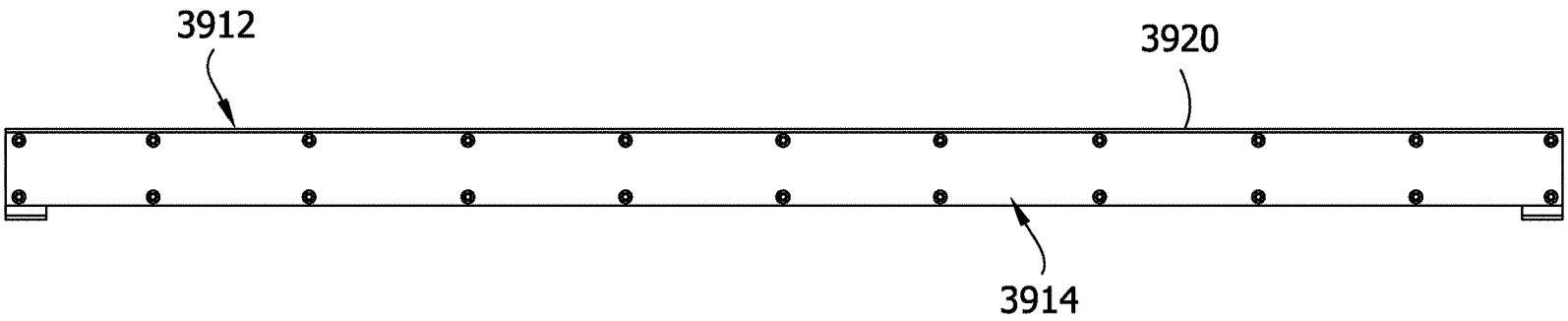
FIG. 73 is a front elevation of the lintel of FIG. 72.

Referring to FIGS. 70 and 71, a lintel 3812 comprises a stiffener 3814 attached to rectangular-shaped spanning member 3820. The lintel 3812 is substantially similar to the lintel 3612 except stiffener 3814 extends substantially along an entire length of the rectangular-shaped spanning member 3820. In one embodiment, the stiffener 3814 extends over at least about 80% of a length of the rectangular-shaped spanning member 3820. In another embodiment, the stiffener 3814 extends over at least about 90% of the length of the rectangular-shaped spanning member 3820. In another embodiment, the stiffener 2614 extends over 100% of the length of the rectangular-shaped spanning member 2620. In the illustrated embodiment, the stiffener 3814 is welded to the rectangular-shaped spanning member 3820. However other ways of attaching the stiffener to the lintel are envisioned. For example, as shown in FIGS. 72 and 73, a lintel 3912, substantially identical to lintel 3812, comprises a stiffener 3914 bolted to rectangular-shaped spanning member 3920.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A lintel system for supporting masonry blocks above an opening in a structure, the system comprising:

a lintel configured to span a width of the opening, the lintel comprising a single spanning member having a top edge, a bottom edge, and a side face extending between the top and bottom edge of the spanning member, and supports disposed at longitudinal ends of the single spanning member;

support plates each having an opening within a perimeter of the support plate, and a slot therein for receiving the spanning member therein for mounting the support plate on the spanning member;

a support rod receivable through the opening in each support plate and configured to be received through the masonry blocks for connecting the masonry blocks to the spanning member; and a stiffener attached to the spanning member for reinforcing the spanning member, the stiffener extending in opposed relation to the side face along at least a portion of the side face.

2. The system of claim 1, wherein the stiffener is welded to the spanning member.

3. The system of claim 1, wherein the stiffener is bolted to the side face of the spanning member.

4. The system of claim 1, wherein the stiffener comprises a first portion positioned opposite the side face of the single spanning member and a second portion positioned opposite the top edge of the single spanning member and extending transverse to the first portion.

5. The system of claim 1, wherein the stiffener extends along only a portion of a length of the single spanning member.

6. The system of claim 1, wherein the stiffener extends from adjacent the top edge toward the bottom edge of the spanning member.

7. The system of claim 1, wherein the stiffener extends from adjacent the top edge to adjacent the bottom edge of the spanning member.

8. The system of claim 1, wherein the stiffener comprises a first stiffener, the system further comprising a second stiffener attached to the spanning member, the second stiffener extending in opposed relation to the side face along at least a portion of the side face.

9. The system of claim 8, wherein the second stiffener comprises a first portion positioned opposite the side face and a second portion positioned opposite the bottom edge and extending transverse to the first portion of the second stiffener.

10. The system of claim 1, wherein the side face of the spanning member comprises a first side face, the spanning member comprises a second side face opposite the first side face, and the stiffener comprises a first stiffener, the system further comprising a second stiffener attached to the spanning member, the second stiffener extending in opposed relation to the second side face along at least a portion of the second side face.

11. The system of claim 1, wherein the spanning member is arch shaped.

12. The system of claim 1, wherein the spanning member comprises a straight spanning member.

13. A lintel system for supporting masonry blocks above an opening in a structure, the system comprising:

a lintel configured to span a width of the opening, the lintel comprising a spanning member having a length greater than the width of the opening, and having a top edge, a bottom edge, and a planar side face extending between the top and bottom edge, the spanning member having a height and a thickness;

support plates each having an opening within a perimeter of the support plate, and a slot therein for receiving the spanning member therein for mounting the support plate on the spanning member;

a support rod receivable through the opening in the each support plate and configured to be received through the masonry blocks for connecting the masonry blocks to the spanning member; and a stiffener attached to the spanning member for reinforcing the spanning member, the stiffener having a height extending parallel to the height of the spanning member and a thickness extending parallel to the thickness of the spanning member, the height of the stiffener being greater than the thickness of the stiffener, the stiffener extending in opposed relation to the planar side face along at least a portion of the planar side face.

14. The system of claim 13, wherein the height of the plate section defines a major surface, the major surface being in opposed relation to the planar side face of the spanning member.

15. The system of claim 13, wherein the stiffener is welded to the spanning member.

16. The system of claim 13, wherein the stiffener is bolted to the side face of the spanning member.

17. The system of claim 13, wherein the stiffener comprises a first plate section positioned opposite the planar side face of the spanning member of the lintel, and a second plate section positioned opposite the top edge of the spanning member and extending transverse to the first plate section.

18. The system of claim 13, wherein the stiffener extends along only a portion of a length of the spanning member of the lintel.

19. The system of claim 13, wherein the stiffener extends from adjacent the top edge of the spanning member toward the bottom edge of the spanning member of the lintel.

20. The system of claim 13, wherein the stiffener extends from adjacent the top edge of the spanning member of the lintel to adjacent the bottom edge of the spanning member.

21. The system of claim 13, wherein the planar side face comprises a first planar side face, the spanning member of the lintel comprises a second planar side face opposite the first planar side face, and the stiffener comprises a first stiffener, the system further comprising a second stiffener attached to the spanning member, the second stiffener having a height extending parallel to the height of the spanning member and a thickness extending parallel to the thickness of the spanning member, the height of the second stiffener being greater than the thickness, the second stiffener extending in opposed relation to the second planar side face of the spanning member along at least a portion of the second planar side face.

22. The system of claim 13, wherein the stiffener comprises a first stiffener, the system further comprising a second stiffener attached to the spanning member, the second stiffener extending in opposed relation to the planar side face of the spanning member of the lintel along at least a portion of the planar side face.

23. The system of claim 22, wherein the second stiffener comprises a first portion positioned opposite the planar side face of the spanning member of the lintel and a second portion positioned opposite the bottom edge of the spanning member.

24. The system of claim 13, wherein the spanning member is arch shaped.

25. The system of claim 13, wherein the spanning member is straight.

26. The system of claim 1, wherein the stiffener extends lengthwise of the spanning member through a midpoint of the length of the spanning member.

27. The system of claim 13, wherein the stiffener extends lengthwise of the spanning member through a midpoint of the length of the spanning member.

28. The system of claim 6, wherein the stiffener extends from adjacent the top edge to approximately a midpoint of a height of the spanning member.

29. The system of claim 19, wherein the stiffener extends from adjacent the top edge to approximately a midpoint of a height of the spanning member.

* * * * *